US011759026B1

(12) United States Patent
Lawlor et al.

(10) Patent No.: US 11,759,026 B1
(45) Date of Patent: Sep. 19, 2023

(54) CRIB

(71) Applicant: Foundations Worldwide, Inc., Medina, OH (US)

(72) Inventors: Joseph A. Lawlor, Medina, OH (US); David Stitchick, Wadsworth, OH (US); Casey R. Getic, Copley, OH (US)

(73) Assignee: FOUNDATIONS WORLDWIDE, INC., Medina, OH (US)

( * ) Notice: Subject to any disclaimer, the term of this patent is extended or adjusted under 35 U.S.C. 154(b) by 0 days.

(21) Appl. No.: 17/476,584

(22) Filed: Sep. 16, 2021

Related U.S. Application Data

(60) Provisional application No. 63/125,616, filed on Dec. 15, 2020, provisional application No. 63/081,634, filed on Sep. 22, 2020.

(51) Int. Cl.
*A47D 7/00* (2006.01)
*A47D 15/00* (2006.01)

(52) U.S. Cl.
CPC ..... *A47D 7/005* (2013.01); *A47D 15/00* (2013.01)

(58) Field of Classification Search
CPC ..... A47D 15/00; A47D 15/005
See application file for complete search history.

(56) References Cited

U.S. PATENT DOCUMENTS 4,670,923 A * 6/1987 Gabriel ..... A47D 15/008 5/100
8,689,379 B2 * 4/2014 Cicci ..... A47D 15/008 5/663

OTHER PUBLICATIONS https://www.youtube.com/watch?v=cnbCA1yx348 by Angeles (Year: 2017).*
https://www.youtube.com/watch?v=0OdQeeV76sE by Foundations (Year: 2012).*

* cited by examiner

*Primary Examiner* — David R Hare
*Assistant Examiner* — Adam C Ortiz
(74) *Attorney, Agent, or Firm* — Ralph E. Jocke; WALKER & JOCKE

(57) ABSTRACT

A child crib arrangement includes a pair of crib sidewalls (14, 16) and a pair of crib end walls (18, 20). A bottom panel (22) extends horizontally and in intermediate relation between the crib walls. A transparent side panel (272) includes a lower side panel end surface (296) that is releasably engaged in a horizontally elongated slot (130). The transparent side panel further includes at least one turned portion (292, 294) that includes a respective aperture (304, 306). A portion of a top rail (84) extends through the aperture. At least one transparent end panel (274) is in operative attached connection with a crib end wall. The transparent end panel may be in interengaging relation with the side panel to provide resistance to relative movement of the side panel and the end panel.

25 Claims, 45 Drawing Sheets

CRIB

TECHNICAL FIELD

Exemplary arrangements relate to cribs for children. Exemplary arrangements relate to crib arrangements that may include walls and/or guards comprised of transparent panels.

BACKGROUND

A crib is designed to hold a child therein. Cribs for children typically include a mattress surrounded by walls that are sufficiently high to prevent a child from falling or climbing out of the crib.

Cribs for children may benefit from improvements.

SUMMARY

Exemplary arrangements include a crib for maintaining a child therein. The exemplary crib includes four walls, a bottom panel, and an interior area bounded by the four walls and the bottom panel. The exemplary four walls may be in operative connection with transparent panels. The exemplary crib may further include transparent guard panels that may extend above and/or below the walls of the crib.

DETAILED DESCRIPTION

Figure 1:
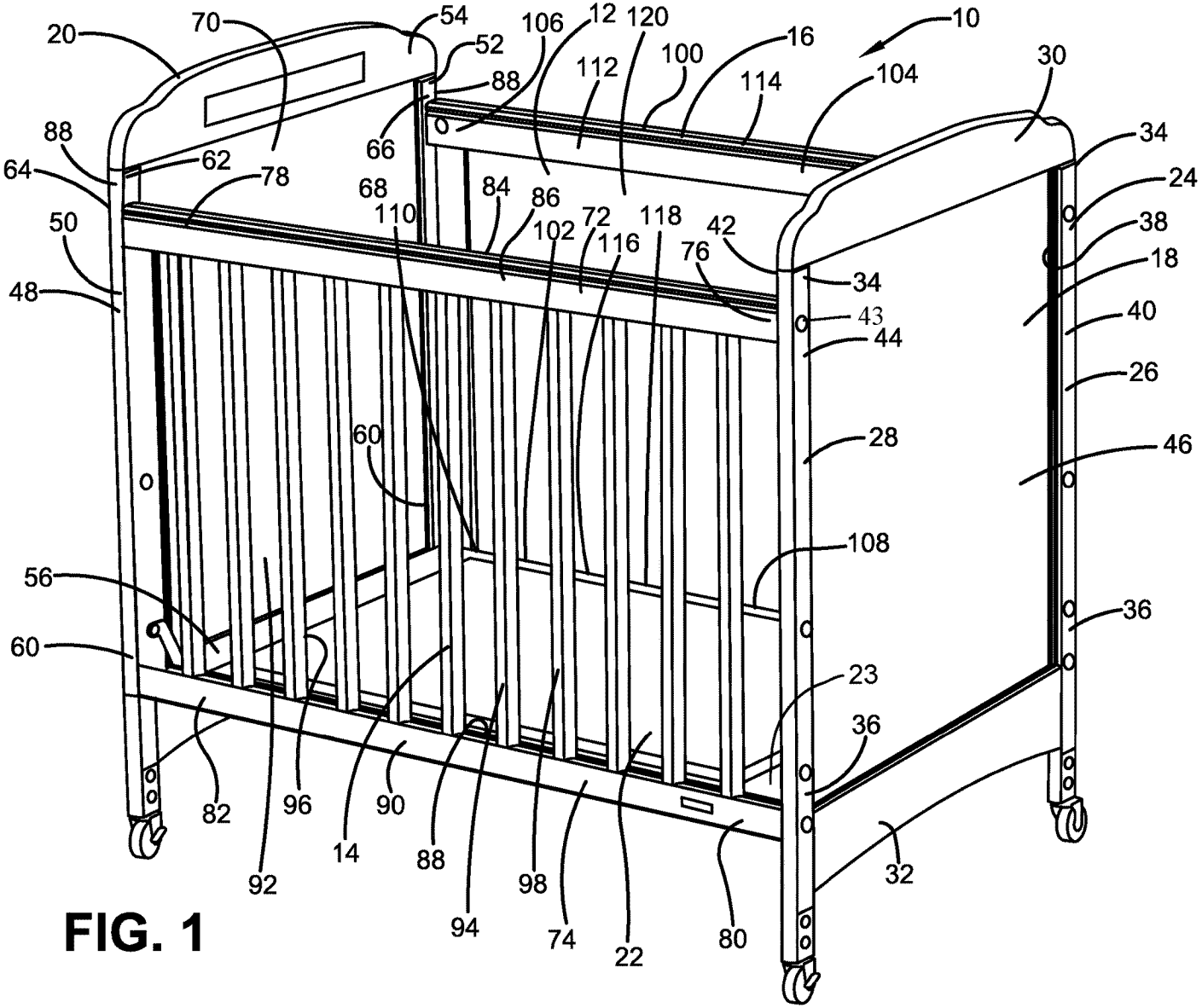
FIG. 1 is a perspective view of an exemplary crib arrangement.

Referring now to FIG. 1, there is shown an exemplary child crib arrangement 10. The exemplary crib arrangement 10 includes an interior space 12, also referred to herein as a crib space. The crib space 12, is bounded by four walls: crib sidewall 14 and crib sidewall 16, crib end wall 18, and crib end wall 20. Sidewall 14 may be referred to herein as front sidewall 14, and sidewall 16 may be referred to herein as back sidewall 16. End wall 18 may be referred to herein as right end wall 18, and end wall 20 may be referred to herein as left end wall 20. Either end wall 18 or end wall 20 may serve as a headboard and either end wall 18 or end wall 20 may serve as a footboard. The exemplary walls 14, 16, 18, and 20 may be comprised of vertical slats, rails, posts, boards, transparent or semi-transparent materials, opaque materials, and/or any other elements operative to form a barrier that maintains a child within the interior space. In an operative condition in which the crib arrangement is suitable for use in housing a child, the crib sidewalls extend parallel to one another. Each of the crib end walls extend perpendicular to the sidewalls. In some exemplary arrangements the crib may be of a foldable construction such that the walls of the crib may be moved from the operative condition to occupy less space. Alternatively or in addition the crib arrangement may be comprised of releasably engageable components which may be readily assembled and disassembled by an adult user. Of course these approaches are exemplary and other arrangements other approaches may be used.

A bottom wall 22 which is alternatively referred to as a bottom panel bounds a lower side of the crib space 12. The exemplary bottom panel 22 includes a bottom panel top surface 23. The bottom panel top surface 23 bounds the lower side of the crib space. In the operative condition of the crib arrangement, the bottom panel extends horizontally in intermediate relation of each of the crib sidewalls and crib end walls. In the exemplary arrangement the crib space is open at the top. Of course in other arrangements crib covers or other similar structures overlying the crib space may be provided. The exemplary bottom panel 22 may include slats, a board, a frame, support members, and/or other types of support structures that are capable of supporting a mattress, pad, or other structure, as well as supporting the weight of the child.

The exemplary crib walls 14, 16, 18, and 20, as well as the bottom panel 22, may be comprised of materials such as wood, plastic, metal, or any combination thereof, and/or other materials used to form such structures. In some arrangements, one or more of these described structures of the crib may be integrally formed and/or may be fastened together via fasteners such as screws, bolts, adhesives, clips, brackets, notches, interlocking edges, as well as any other fasteners or fastening methods. Of course, it should be understood that these materials, fasteners, and fastening methods are exemplary, and in other arrangements, other approaches may be used.

In the exemplary crib arrangements, the exemplary crib right end wall 18 includes a rectangular frame 24. The rectangular frame 24 includes a pair of vertical members 26 and 28, a top crossbar 30, and a bottom crossbar 32. The vertical members 26 and 28 vertically extend in parallel relation and both include an upper end 34 and a lower end 36. The top crossbar 30 extends perpendicular to the vertical members 26 and 28 and extends horizontally from vertical member 26 to vertical member 28. The top crossbar 30 is in operative connection with the upper ends 34 of the vertical members. The bottom crossbar 32 extends perpendicular to the vertical members, extends horizontally from the vertical member 26 to the vertical member 28, and is in operative connection with the lower ends 36 thereof. The top crossbar 30 and bottom crossbar 32 may be operatively connected to the respective upper and lower ends of the vertical members 26 and 28 via a plurality of fasteners such as screws or bolts, notches and projections in either the crossbars or the vertical member with the other extending therein, interlocking edges, clips, adhesives, brackets, or in some arrangements the vertical members may be integrally formed with such crossbars. However, these are merely examples of types of fasteners that may be used to hold the crossbars and the vertical members in engagement, and in other arrangements, other approaches may be used.

The exemplary vertical member 26 includes an inner face 38 and an outer face 40. The inner face 38 is in facing relation with the opposed end wall 20, and the outer face 40 is in facing relation away from the end wall 20. The exemplary vertical member 28 includes an inner face 42 and an outer face 44. The inner face 42 is in facing relation with the end wall 20 of the crib 10, and the outer face 44 is disposed in facing relation away from the opposed end wall 20.

The exemplary rectangular frame 24 of the end wall 18 bounds an intermediate space 46. The exemplary space 46 may house a panel, slats, bars, or other structure to form a barrier portion of the end wall 18. In some arrangements the space may include air permeable material. In some arrangements the space 46 may include a clear or see-through panel comprised of non-air permeable material such as thermoplastic poly (methyl methacrylate)-type polymers commonly known as Plexiglas® (Rohm and Haas Company) or other transparent or semi-transparent sheets comprised of acrylic resin. As referred to herein, the term "clear plastic" includes, but is not limited to, Plexiglass®, and other transparent, semi-transparent, or translucent sheets comprised of polymers, copolymers and other materials having similar properties. For purposes hereof transparent refers to transparent, semi-transparent and/or translucent materials which have properties that enable viewing of the positions of items and things, including a child, through the material. As will be described later in greater detail in some crib arrangements, the space 46 may house such a transparent panel in operative connection with the frame 24 of the right end wall 18.

The exemplary crib end wall 20 includes a rectangular frame 48. The rectangular frame 48 includes vertical members 50 and 52, a top crossbar 54, and a bottom crossbar 56. The exemplary vertical members 50 and 52 extend vertically in parallel relation and include upper ends 58 and lower ends 60. The exemplary top crossbar 54 extends horizontally and perpendicular to the vertical members 50 and 52, extends from vertical member 50 to vertical member 52, and is in operative connection with the upper ends 58 thereof. The exemplary bottom crossbar 56 extends perpendicular to the vertical members 50 and 52, extends from vertical member 50 to vertical member 52, and is in operative connection with the lower ends 60 thereof. The top crossbar 54 and the bottom crossbar 56 may be operatively connected to the upper and lower ends of the respective vertical members 26 and 28 via a plurality of fasteners such as screws or bolts, notches and projections in either the crossbars or vertical members with the other extending in engaged relation therein, interlocking edges, clips, adhesives, brackets, or in some arrangements the vertical members may be integrally formed with other structures. However, these are merely examples of fastener types used to engage the crossbars and the vertical members, and in other arrangements, other approaches may be used.

The exemplary vertical member 50 includes an inner face 62 and an outer face 64. The inner face 62 is in facing relation with crib end wall 18 of the crib 10, and the outer face 64 is disposed in an opposed facing direction. The vertical member 52 includes an inner face 66 and an outer face 68. The inner face 66 is disposed in facing relation with the crib end wall 18 of the crib 10, and the outer face 68 is disposed in an opposed facing direction.

The exemplary rectangular frame 48 of the crib end wall 20 bounds a space 70. The exemplary space 70 may include a panel, slats, bars, or other structures to form a barrier of the end wall 20. In some arrangements the structures in the space 70 may be air permeable. The space 70 may in other arrangements be filled with a transparent panel or other non-air permeable material. As will be described later in greater detail, the space 70 may be filled by such a transparent panel in operative connection with the frame 48 of the end wall 20.

In exemplary arrangements, the crib sidewall 14 and crib sidewall 16 extend between the end wall 18 and the end wall 20. The sidewall 14 includes a top rail 72 and a bottom rail 74. The top rail 72 extends horizontally in the operative condition, and includes an end 76 and an end 78. The top rail 72 bounds the upper side of the crib sidewall 14. The end 76 of top rail 72 is in operative connection with the vertical member 28 at the upper end 34 thereof and is in facing relation with face 42. The end 78 of top rail 72 is in operative connection with the vertical member 50 at the upper end 58 thereof and is in facing relation with face 62.

The bottom rail 74 bounds the bottom side of the crib sidewall 14. The bottom rail includes an end 80 and an end 82. The end 80 of bottom rail 74 is in operative connection with the vertical member 28 and in facing relation with face 42 at the lower end 36 thereof. The end 82 of bottom rail 74 is in operative connection with vertical member 50 at the lower end 60 thereof and is in facing relation with face 62. The ends of top rail 72 and bottom rail 74 of sidewall 14 may be operatively connected to their respective vertical members through any suitable means. For example, the top and bottom rails may extend in notches within the respective vertical members, or the top and bottom rails may be secured to the respective vertical members via a plurality of fasteners, notches and projections, interlocking edges, clips, adhesives, or brackets, or the rails may be integrally formed with the respective vertical members. However, these are merely examples of connection types between the top and bottom rails and the respective vertical members, and in other arrangements, other types of connections may be used. In the exemplary arrangement shown fasteners 43 extend in operative connection between the respective vertical member and the top rail. The respective fasteners may include suitable screws, bolts, dowel pins or other items that extend in the respective top rail and the vertical member. For purposes hereof such respective fasteners will be considered to be a part of the top rail with which they are engaged.

In some arrangements the exemplary bottom rail 74 may extend below the bottom panel top surface 23 of the bottom panel 22. In other arrangements the bottom rail may have its lowest surface horizontally aligned with the panel top surface, or alternatively may be positioned above the bottom panel top surface. The approach taken in the particular arrangement may be dependent on the type of structure utilized for the bottom panel, or alternatively the type of mattress or other structure that the bottom panel is configured to support. As can be appreciated numerous different approaches may be taken in exemplary arrangements.

The exemplary top rail 72 includes an inner face 84 and an outer face 86. The inner face 84 is in facing relation toward the crib space 12 of the crib 10, and the outer face 86 is directed away from the crib space 12. The exemplary bottom rail 74 includes an inner face 88 and an outer face 90. The inner face 88 is directed toward the crib space 12 of the crib 10, and the outer face is directed away from the crib space 12. The inner faces of 84 and 88 bound the crib space of the exemplary arrangement.

The exemplary sidewall 14 includes a space 92 that is bounded by top rail 72, bottom rail 74, vertical member 28, and vertical member 50. As shown in FIG. 1, the space 92 may include slats 94. The slats extend vertically in parallel relation with vertical members 28 and 50, and extend perpendicular to the top rail 72 and bottom rail 74, and extend vertically therebetween. The slats 94 are in operative connection with the top rail 72 and the bottom rail 74. In this exemplary arrangement the slats provide for the crib sidewall 14 to be air permeable. The exemplary slats 94 each include an inner face 96 and an outer face 98. The inner face 96 is directed toward the crib space 12 of the crib 10, and the outer face 98 is directed away from the crib space 12. The inner faces 96 bound the exemplary crib space. The exemplary slats 94 may be in operative connection with the top and bottom rails through any suitable means. For example, the slats 94 may be operatively connected to the top and bottom rails by extending in notches within the respective rails, or the slats may be secured to the rails via a plurality of fasteners, notches and projections, interlocking edges, clips, adhesives, or brackets, or the slats may be integrally formed with the rails. However, these are merely examples of connection types between the slats and the top and bottom rails, and in other arrangements, other approaches may be used.

In other arrangements, the space 92 of sidewall 14 may include non-air permeable panels or other structures to form a barrier of the sidewall 14. The space 92 may include a transparent or panel such as clear plastic, or other suitable material. As will be described later in greater detail, the space 92 may be filled or partially filled by such a transparent panel in operative connection with the crib sidewall 14.

The crib sidewall 16 is similar to crib sidewall 14. Sidewall 16 includes a top rail 100 and a bottom rail 102. The top rail 100 includes an end 104 and an end 106. The end 104 of top rail 100 is in operative connection with the vertical member 26 at the upper end 34 thereof and in facing relation with face 38. The end 106 of top rail 100 is in operative connection with vertical member 52 at the upper end 58 thereof and in facing relation with face 66. The bottom rail 102 includes an end 108 and an end 110. The end 108 of bottom rail 102 is in operative connection with vertical member 26 at the lower end 36 thereof and in facing relation with face 38. The end 110 of bottom rail 102 is in operative connection with vertical member 52 at the lower end 60 thereof and in facing relation with face 66.

The respective ends of top rail 100 and bottom rail 102 of crib sidewall 16 may be operatively connected to their respective vertical members through any suitable connection means. For example the top and bottom rails may extend in notches in the respective vertical members, or the top and bottom rails may be secured to the respective vertical members via a plurality of fasteners, notches and projections, interlocking edges, clips, adhesives, brackets, or the rails may be integrally formed with the respective vertical members. However, these are merely examples of connection types between the rails and the vertical members, and in other arrangements, other types of connections may be used. In the exemplary crib arrangement top rail 100 is held in fixed operative engagement with the respective crib end walls through fasteners such as fasteners 43 previously discussed. For purposes hereof such fasteners are considered to be a part of the top rail 100.

The exemplary top rail 100 includes an inner face 112 and an outer face 114. The inner face 112 is in facing relation toward the crib space 12 of the crib 10, and the outer face 114 is directed away from the crib space 12. The exemplary bottom rail 102 includes an inner face 116 and an outer face 118. The inner face 116 is directed in facing relation toward the crib space 12 of the crib 10, and the outer face 118 is directed away from the crib space 12. The inner faces 112 and 116 bound the exemplary crib space.

The exemplary crib sidewall 16 includes intermediate space 120 that is bounded by top rail 100, bottom rail 102, vertical member 26, and vertical member 52. Similar to space 92 of crib sidewall 14, the structures within space 120 may be air permeable and include vertical slats similar to slats 94 which extend vertically in parallel relation with vertical members 26 and 52, and extend perpendicular to the top rail 100 and the bottom rail 102, and extend therebetween. The slats 94 may be in operative connection with the top rail 100 and the bottom rail 102 through any suitable fastening means including notches and projections in either of the slats or the top and bottom rails, interlocking edges, a plurality of fasteners, clips adhesives, brackets, or in some arrangements the slats may be integrally formed with the top and bottom rails.

The exemplary slats 94 also each include an inner face 96 and an outer face 98. The inner face 96 is directed in facing relation toward the crib space 12 of the crib 10, and the outer face 98 is directed away from the crib space 12. The inner faces bound the exemplary crib space. In other exemplary arrangements such as shown in FIG. 1, the intermediate space 120 may include structures such as panels to form a non-air permeable sidewall. As can be appreciated, the intermediate space 12 of the sidewall 16 may include a suitable structure to maintain a child in the crib space 12. The space 120 may include a transparent panel such as clear plastic panel material. As will be described later in greater detail, the interior space 120 may be filled or partially closed by such a transparent panel in operative connection with the sidewall 16.

Figure 2:
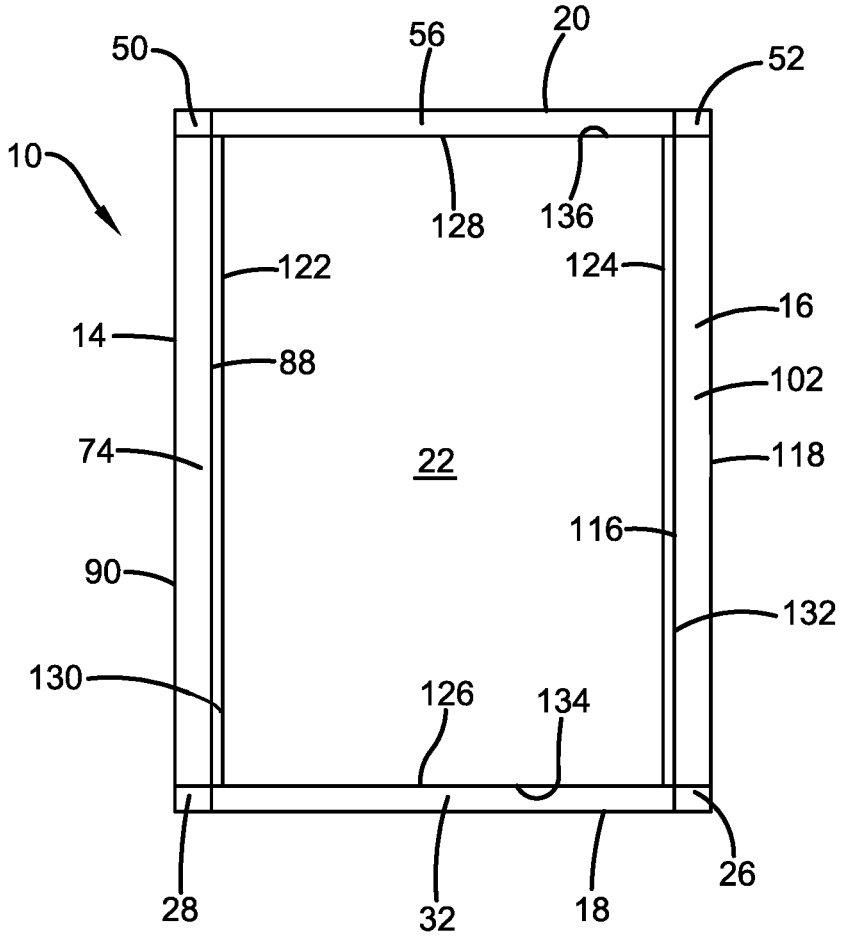
FIG. 2 is a plan view of an exemplary bottom panel of the crib bounded by bottom crossbars of end walls and bottom rails of exemplary sidewalls.

Now referring to FIG. 2 which shows a view of the lower area of the crib arrangement 10 from above. As shown, the bottom panel 22 is bounded laterally by bottom crossbar 32 of crib end wall 18, the bottom crossbar 56 of crib end wall 20, the bottom rail 74 of crib sidewall 14, and the bottom rail 102 of crib sidewall 16. The bottom panel 22 includes a sidewall 122, a sidewall 124, an end wall 126, and an end wall 128. In an exemplary arrangement, the sidewall 122 of bottom panel 22 extends in parallel relation with an immediately adjacent the inner face 88 of bottom rail 74 of crib sidewall 14. The sidewall 124 of bottom panel 22 extends in parallel relation with an immediately adjacent inner face 116 of bottom rail 102 of crib sidewall 16. The end wall 126 of bottom panel 22 extends in parallel relation with an immediately adjacent inner surface 134 of bottom crossbar 32 of right end wall 18. The end wall 128 of bottom panel 22 extends in parallel relation with an immediately adjacent inner surface 136 of end wall 20. Of course, these arrangements are merely exemplary, and in other arrangements, other configurations may be used. For example, the walls 122, 124, 126, and 128 of bottom panel 22 may be in immediately abutting engagement, operatively abutting engagement, in operative connection with, or integrally formed with their respective panels of the crib walls 14, 16, 18, and 20.

In the exemplary arrangement shown in FIG. 2, an elongated slot 130 extends horizontally between the sidewall 122 of bottom panel 22 and the inner face 88 of bottom rail 74 of crib sidewall 14. An elongated slot 132 extends horizontally between the sidewall 124 of bottom panel 22 and the inner face 116 of bottom rail 102 of crib sidewall 16. As will be described in greater detail later, each of slots 130 and 132 are configured to releasably accept a respective lower side panel end surface of a side panel barrier structure therein, and to maintain the side panel engaged with the slot in a fixed position.

In other exemplary arrangements, a slot may extend between the inner surface 134 of bottom crossbar 32 and the end wall 126 of bottom panel 22. A slot may extend between the inner surface 136 of bottom crossbar 56 of end wall 20 and end wall 128 of bottom panel 22. In a similar manner, other slot configurations may be included in the exemplary crib arrangement 10 that are operative to accept structures therein and to maintain such structures in a fixed position.

Figure 3A:
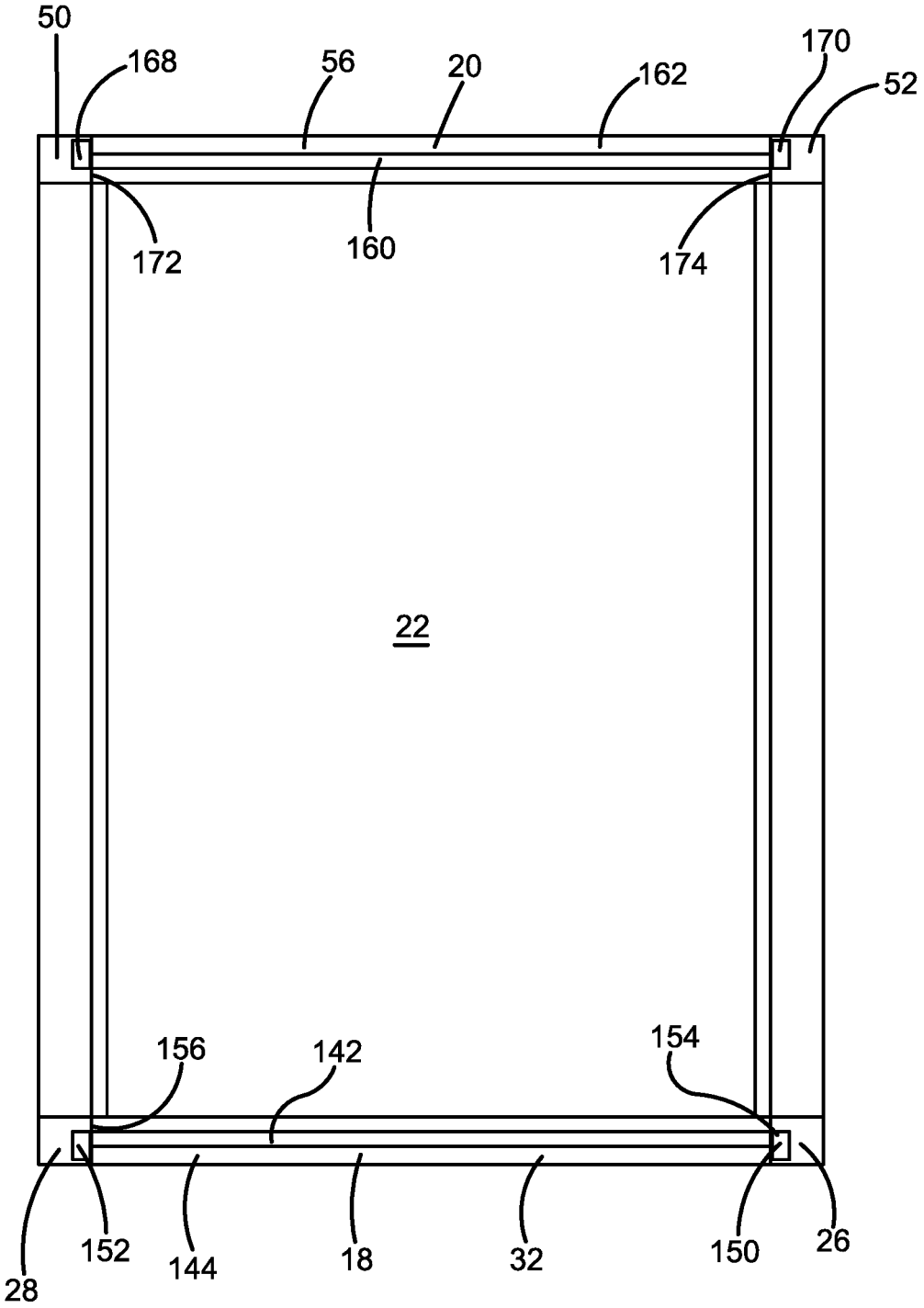
FIG. 3A is a top plan view of an exemplary bottom panel of the crib and adjacent structures with slots in upper surfaces of bottom crossbars of the end walls and vertically extending slots in the vertical members of the end walls.
Figure 3B:
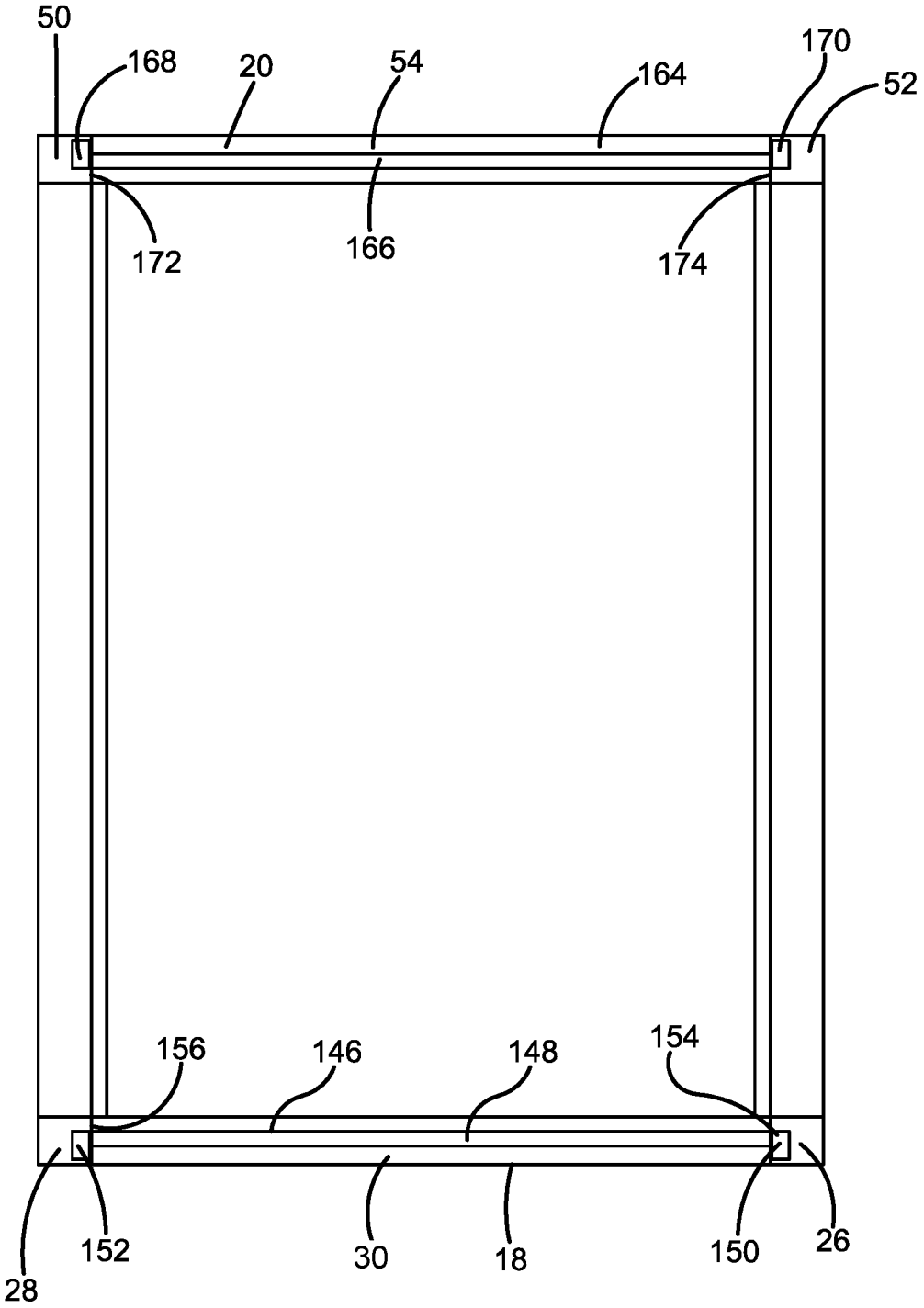
FIG. 3B is a bottom plan view of an exemplary upper area of the crib showing slots in bottom surfaces of top crossbars of the end walls and the vertically extending slots in the vertical members of the end walls.

In still further exemplary arrangements such as shown in FIG. 3A, the bottom crossbar 32 of crib end wall 18 includes a slot 142 in an upper surface 144 of the crossbar 32. The slot 142 extends horizontally along the upper surface 144 of crossbar 32 between the vertical members 26 and 28. As shown in FIG. 3B, the top crossbar 30 of crib end wall 18 may include a bottom surface 146 that includes a slot 148 therein. The slot 148 may extend along the bottom surface 146 of crossbar 30 between the vertical members 26 and 28. The vertical members 26 and 28 may each include respective slots 150 and 152. Slot 150 may extend in an interior side face 154 of vertical member 26. Slot 152 may extend in an interior side face 156 of vertical member 28. Slots 150 and 152 may extend along their respective interior side faces 154 and 156 and extend between the top crossbar 30 and the bottom crossbar 32. The exemplary slots 142, 148, 150, and 152 are in aligned relation such that they form a continuous rectangular slot 158, best shown in FIG. 4.

In such exemplary arrangements, as shown in 3A, bottom crossbar 56 of end wall 20 includes a slot 160 in an upper surface 162 of the bottom crossbar 56. The slot 160 extends along the upper surface 162 of crossbar 56 between the vertical members 50 and 52. As shown in 3B, the top crossbar 54 of end wall 20 includes a bottom surface 164 that includes a slot 166 extending therein. The slot 166 extends along the bottom surface 164 of top crossbar 54 between the vertical members 50 and 52. The vertical members 50 and 52 each include opposed facing slots 168 and 170 respectively. Slot 168 extends in an interior side face 172 of vertical member 50. Slot 170 extends in an interior side face 174 of vertical member 52. Slots 168 and 170 extend along their respective interior side faces 172 and 174 and extend between the top crossbar 54 and bottom crossbar 56. The slots 160, 166, 168, and 170 are in aligned relation such that they form a continuous rectangular slot 176.

Figure 4:
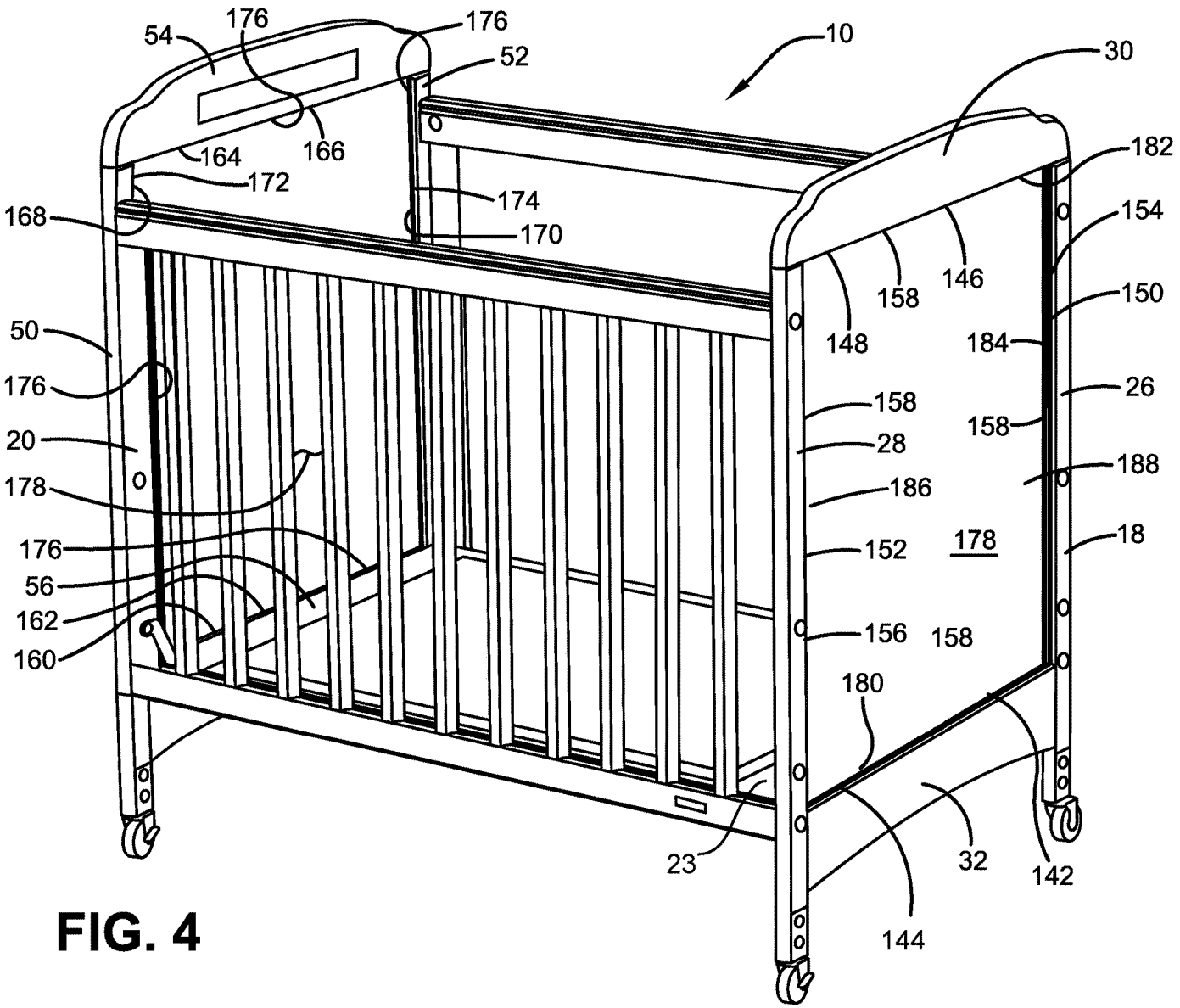
FIG. 4 is a perspective view of an exemplary crib arrangement with transparent end wall panels extending in the slots of the exemplary crossbars and vertical members.
Figure 5:
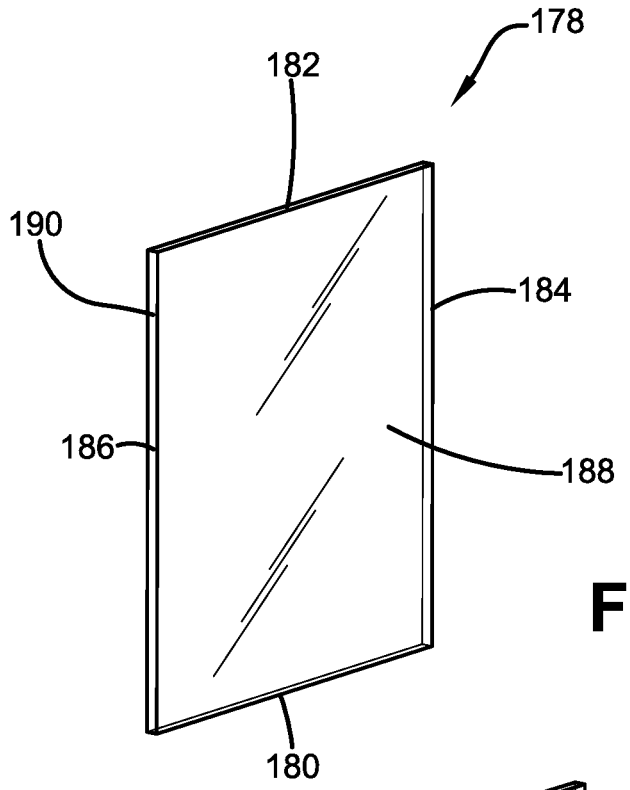
FIG. 5 is a perspective view of an exemplary transparent end wall panel.

In such exemplary arrangements including the continuous rectangular slots 158 and 176, as shown in FIG. 4, the structures included in the end wall 18 and the end wall 20 that fill the respective spaces 46 and 70 respectively, may be transparent non-air permeable end wall panels 178. As shown in FIGS. 4 and 5, the exemplary transparent panels 178 include perimeter edges 180, 182, 184, and 186. The transparent end wall panels 178 further each include an outer panel surface 188 that is directed away from the crib space 12 of the crib 10, and an inner surface 190 that is directed in facing relation toward the crib space 12 and which bounds the crib place. The exemplary perimeter edges 180, 182, 184, and 186 extend in the respective continuous rectangular slots 158 and 176 of respective crib walls. For example, perimeter edge 180 extends in the slot 142, perimeter edge 182 extends in the slot 148, perimeter edge 184 extends in slot 150, and perimeter edge 186 extends in slot 152. A transparent end wall panel 178 forming a barrier portion of the end wall 20 extends in continuous rectangular slot 176 in a similar manner. However, it should be understood that this arrangement is merely exemplary, and in other arrangements, other approaches may be used. For example, transparent panels in end walls may be operatively secured in fixed relation to inner or outer surfaces of the respective vertical members of crib end walls 18 or 20 through fasteners, brackets, clips, notches and projections, interlocking edges, adhesives. Alternatively in some arrangements the transparent panels 178 in end walls may be integrally formed with the structures of the end walls 18 and 20.

Figure 6:
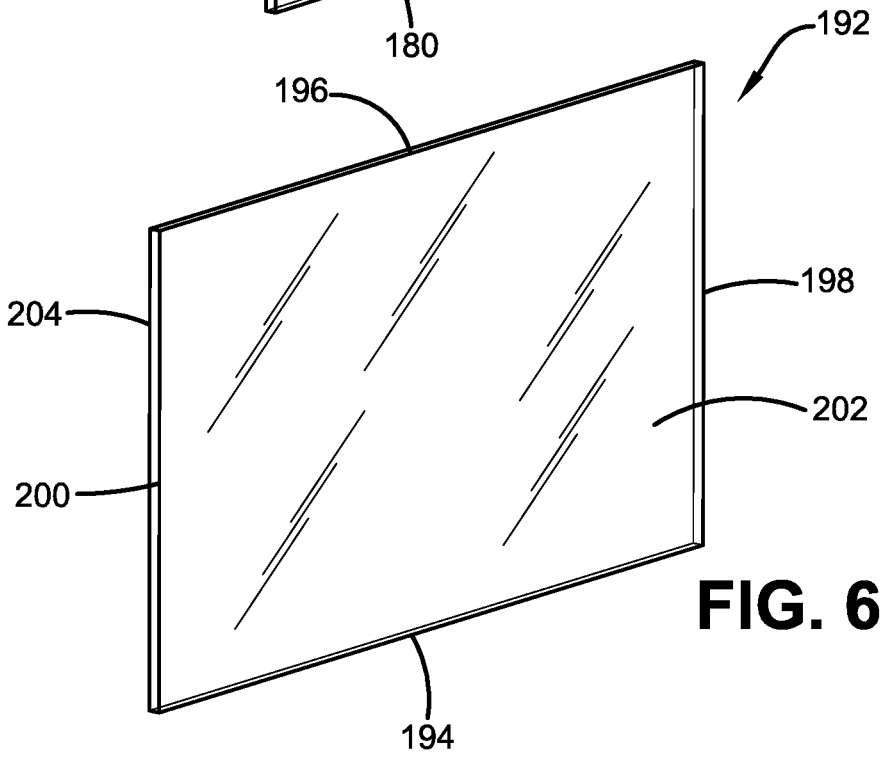
FIG. 6 is a perspective view of an exemplary transparent sidewall panel.
Figure 7:
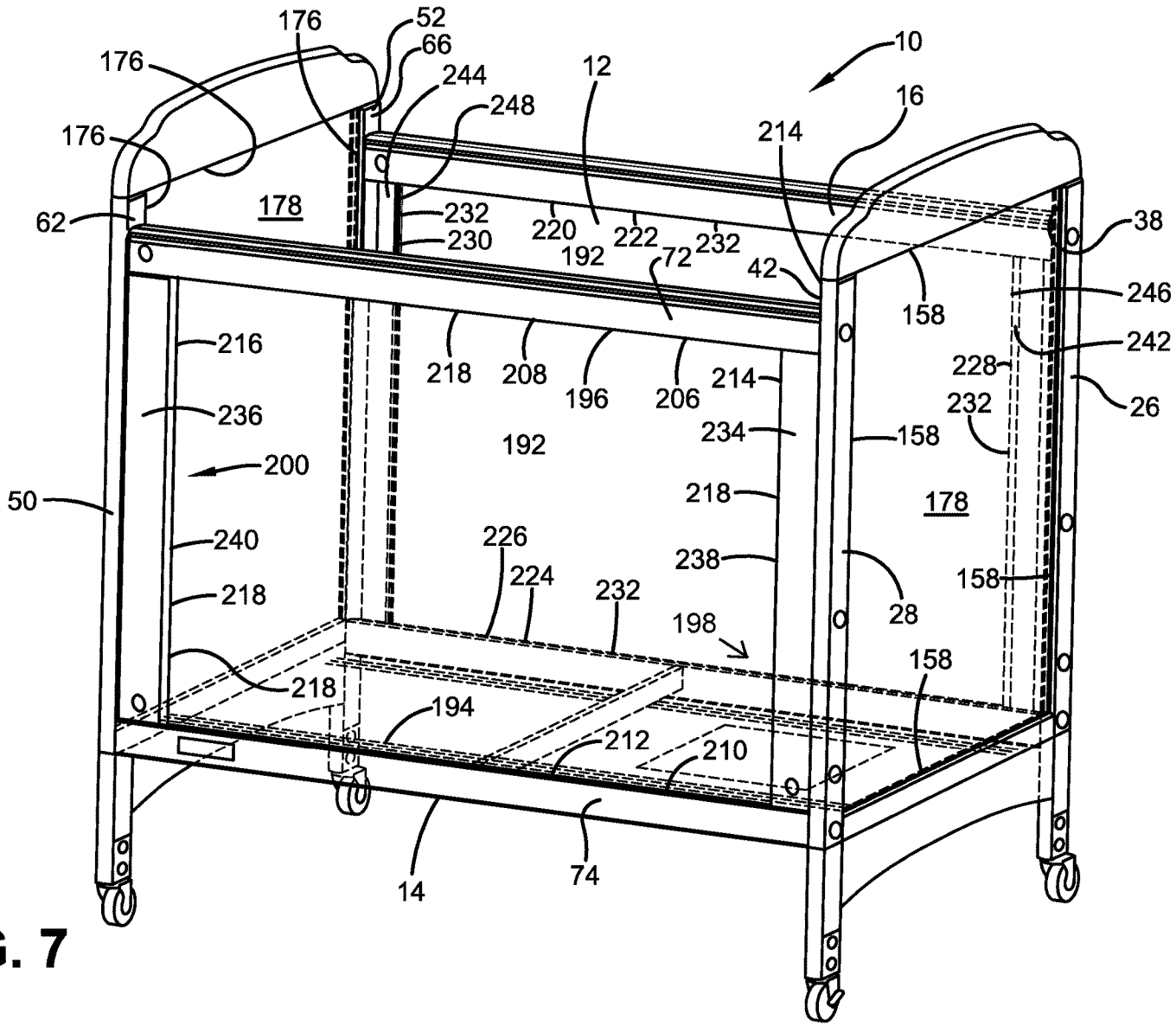
FIG. 7 is a perspective view of an alternative exemplary crib arrangement including transparent end wall panels and sidewall panels extending in generally continuous slots.

In alternative exemplary arrangements, such as shown in FIG. 7, the crib end walls 18 and 20 may include transparent end wall panels 178, and the crib sidewalls 14 and 16 may include transparent sidewall panels 192. As shown in FIG. 6, exemplary transparent sidewall panels 192 include perimeter edges 194, 196, 198, and 200. Transparent sidewall panels 192 also include an outer surface 202 and an inner surface 204. Outer surface 202 is directed away from the crib space 12 of the crib 10, and the inner surface 204 is directed toward and bounds the crib space 12. In the exemplary arrangement the sidewall panels are generally planar sidewall panels. As used herein generally planar means that a majority of the structure referred to herein as generally planar, or the portion of the structure referred to herein as being generally planar, extends in centered symmetrical relation about a common plane.

Referring to FIGS. 3, 7, 8A, and 8B in this exemplary arrangement, the crib sidewall 14 includes support members 234 and 236. The support members 234 and 236 extend vertically between a bottom surface 206 of top rail 72 and a top surface 210 of bottom rail 74. The support members 234 and 236 are in operative connection with the bottom surface 206 and the top surface 210 through a suitable connection such as notches and projections in either of the rails or support members, interlocking edges, clips, adhesives, fasteners, brackets, or alternatively the support members may be integrally formed with the top and bottom rails. The support member 234 is in vertically extending parallel relation with and adjacent the inner face 42 of vertical member 28, and the support member 236 is in parallel extending relation with and adjacent the inner face 62 of vertical member 50. The support member 234 includes an inner face 238 that is directed in facing relation toward the opposing support member 236. The support member 236 includes an inner face 240 that is directed in facing relation toward the opposing support member 234. Of course, these arrangements are exemplary, and in other arrangements, other configurations may be used. For example, the support members 234 and 236 may be in immediately abutting engagement, operatively abutting engagement, in operative connection with, or integrally formed with their respective associated vertical members.

The exemplary crib sidewall 16 shown in FIG. 7 includes support members 242 and 244. The support members 242 and 244 extend vertically between a bottom surface 220 of top rail 100 and a top surface 224 of bottom rail 102. The support members 242 and 244 are in operative fixed connection with the bottom surface 220 and the top surface 224 through a suitable connection approach such as notches and projections in either the top and bottom rails and the support members, interlocking edges, clips, adhesives, fasteners, brackets, or in some exemplary arrangements the support members may be integrally formed with the top and bottom rails. The support member 242 is in immediately abutting operative engagement with inner face 38 of vertical member 26, and the support member 244 is in immediately abutting operative engagement with the inner face 66 of vertical member 52. The support member 242 includes an inner face 246 that is directed in facing relation toward the opposing support member 244. The support member 244 includes an inner face 248 directed in facing relation toward opposing support member 242. Of course, these arrangements are exemplary, and in other arrangements, other configurations may be used. For example, in some arrangements the support members 242 and 244 may be in immediately abutting operative engagement, in operatively abutting engagement, in operative connection with, or integrally formed with the respective associated vertical members.

Figure 8A:
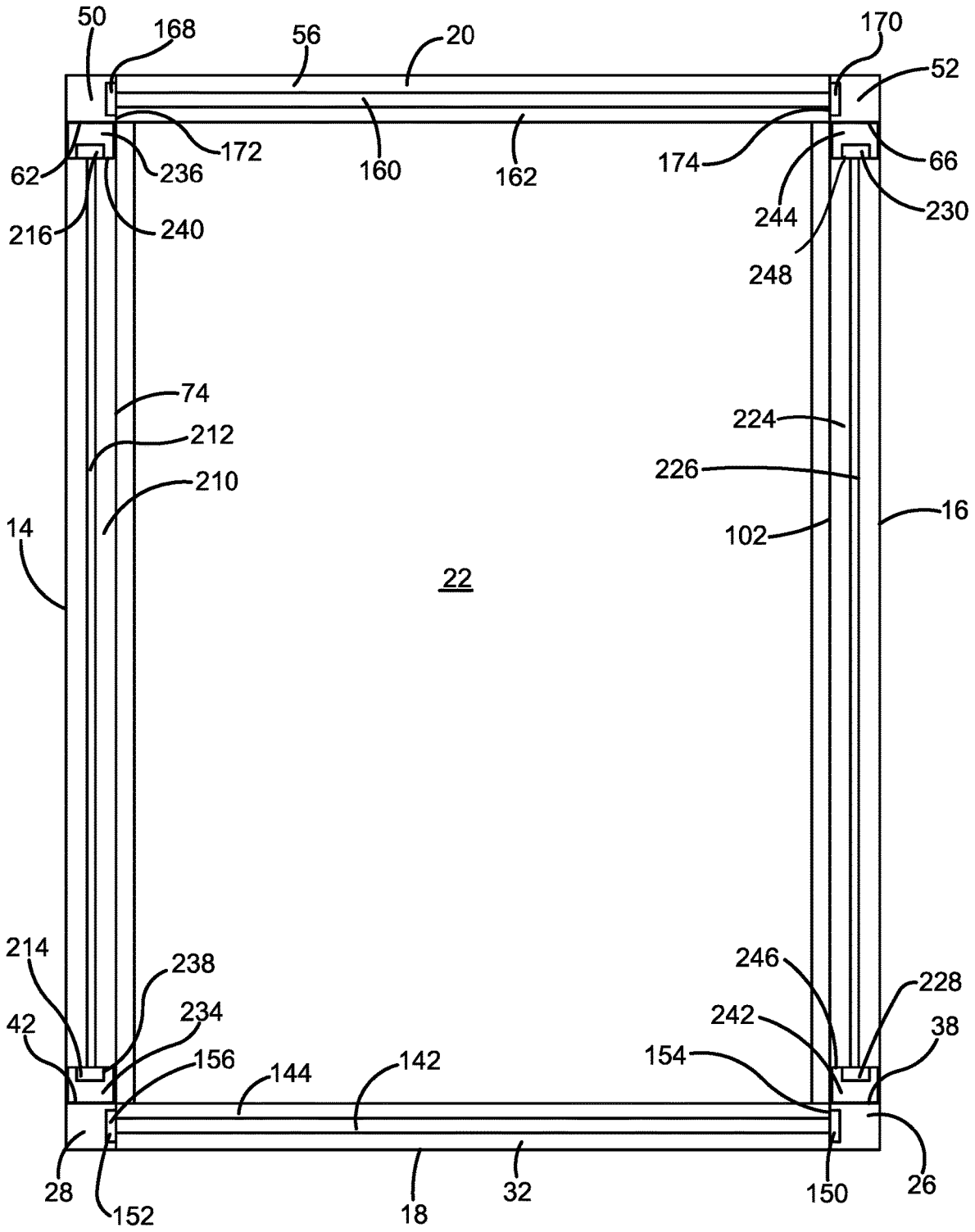
FIG. 8A is a top plan view of an exemplary bottom panel of the alternative crib arrangement and adjacent structures with slots extending in top surfaces of the bottom rails of the sidewalls, slots extending in the top surfaces of the bottom crossbars of the end walls, vertically extending slots in the vertical members of the end walls, and vertically extending slots in the support members of the sidewalls.
Figure 8B:
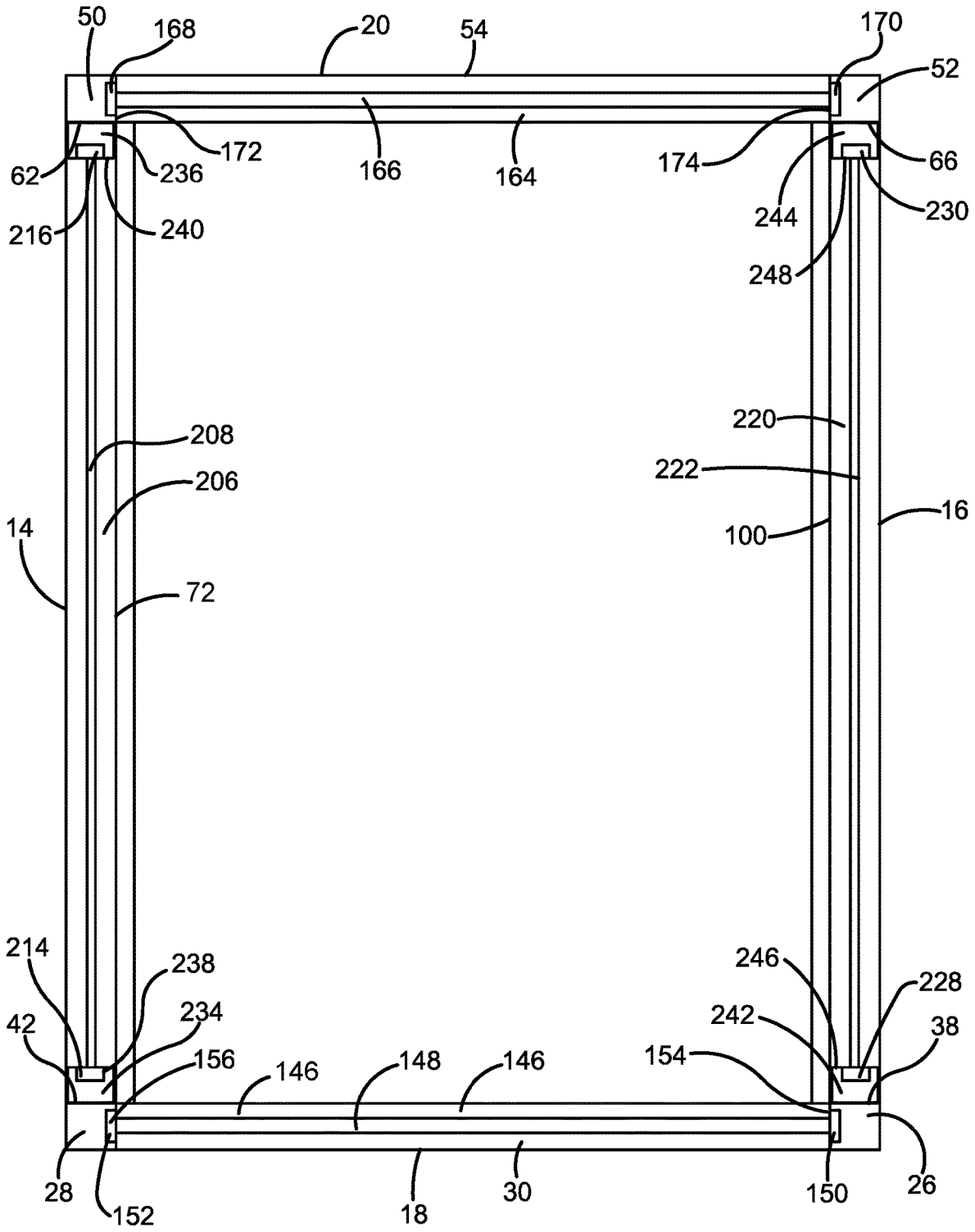
FIG. 8B is a bottom plan view of an exemplary upper area of the alternative crib arrangement showing slots extending in the bottom surfaces of top rails of the sidewalls, slots extending in bottom surfaces of the top crossbars of the end walls, vertically extending slots in the vertical members of the end walls, and vertically extending slots in the support members of the sidewalls.

In addition, in this exemplary arrangement, as shown in FIG. 8B, the top rail 72 of sidewall 14 includes a bottom surface 206 which includes a slot 208 extending therein. The slot 208 extends along the bottom surface 206 of top rail 72 between vertical members 28 and 50. As shown in FIG. 8A, the bottom rail 74 includes a top surface 210 that includes a slot 212 extending therein. The slot 212 extends along the top surface of bottom rail 74 and extends between vertical members 28 and 50. Further, the inner face 238 of support member 234 include a slot 214 extending therein. The slot 214 extends along the inner face 238 and extends between the top rail 72 and the bottom rail 74. Still further, the inner face 240 of support member 236 includes a slot 216 extending therein. The slot 216 extends along the inner face 240 and extends between the top rail 72 and the bottom rail 74. The slots 208, 212, 214, and 216 are in aligned relation such that they form a continuous rectangular slot 218, as best shown in FIG. 7.

As shown in FIG. 8B, the top rail 100 of exemplary crib sidewall 16 includes a bottom surface 220 that includes a slot 222 extending therein. The slot 222 extends along the bottom surface 220 of top rail 100 between vertical members 26 and 52. As shown in FIG. 8A, the bottom rail 102 of crib sidewall 16 includes a top surface 224 that includes a slot 226 extending therein. The slot 226 extends along the top surface 224 of bottom rail 102 and extends between vertical members 26 and 52. Further, the inner face 246 of support member 242 includes a slot 228 extending therein. The slot 228 extends along the inner face 246 and extends between the top rail 100 and the bottom rail 102. Still further, the inner face 248 of support member 244 includes a slot 230 extending therein. The slot 230 extends along the inner face 248 and extends between the top rail 100 and the bottom rail 102. The slots 220, 226, 228, and 230 are in aligned relation such that they form a continuous rectangular slot 232, as best shown in FIG. 7.

As can be appreciated, the perimeter edges 194, 196, 198, and 200 of the transparent generally planar sidewall panels 192 extend respectively in the continuous rectangular slots 218 and 232. For example, perimeter edge 194 extends in the slot 212, perimeter edge 196 extends in the slot 206, perimeter edge 198 extends in the slot 214, and the perimeter edge 200 extends in the slot 216. A transparent sidewall panel 192 included in the crib sidewall 16 extends in respective portions of the continuous rectangular slot 232 in the same manner. However, it should be understood that this arrangement is exemplary, and in other arrangements, other configurations may be used. For example, the transparent sidewall panels may be operatively connected to the vertical members of the respective crib sidewall through suitable fasteners, adhesives, clips, brackets, interlocking edges, a plurality of notches and projections, or in some arrangements the panels may be integrally formed therewith, and/or the vertical members may directly include the slots for the transparent sidewall panels formed therein. Still further, the transparent sidewall panels may be operatively secured in fixed relation to the inner or outer surfaces of the respective support members, or external or internal surfaces of the vertical members through suitable fasteners, clips, brackets, adhesives, interlocking edges, notches and projections, or the transparent sidewall panels may be integrally formed with the support members or vertical members. Numerous approaches may be used in exemplary arrangements.

Figure 9:
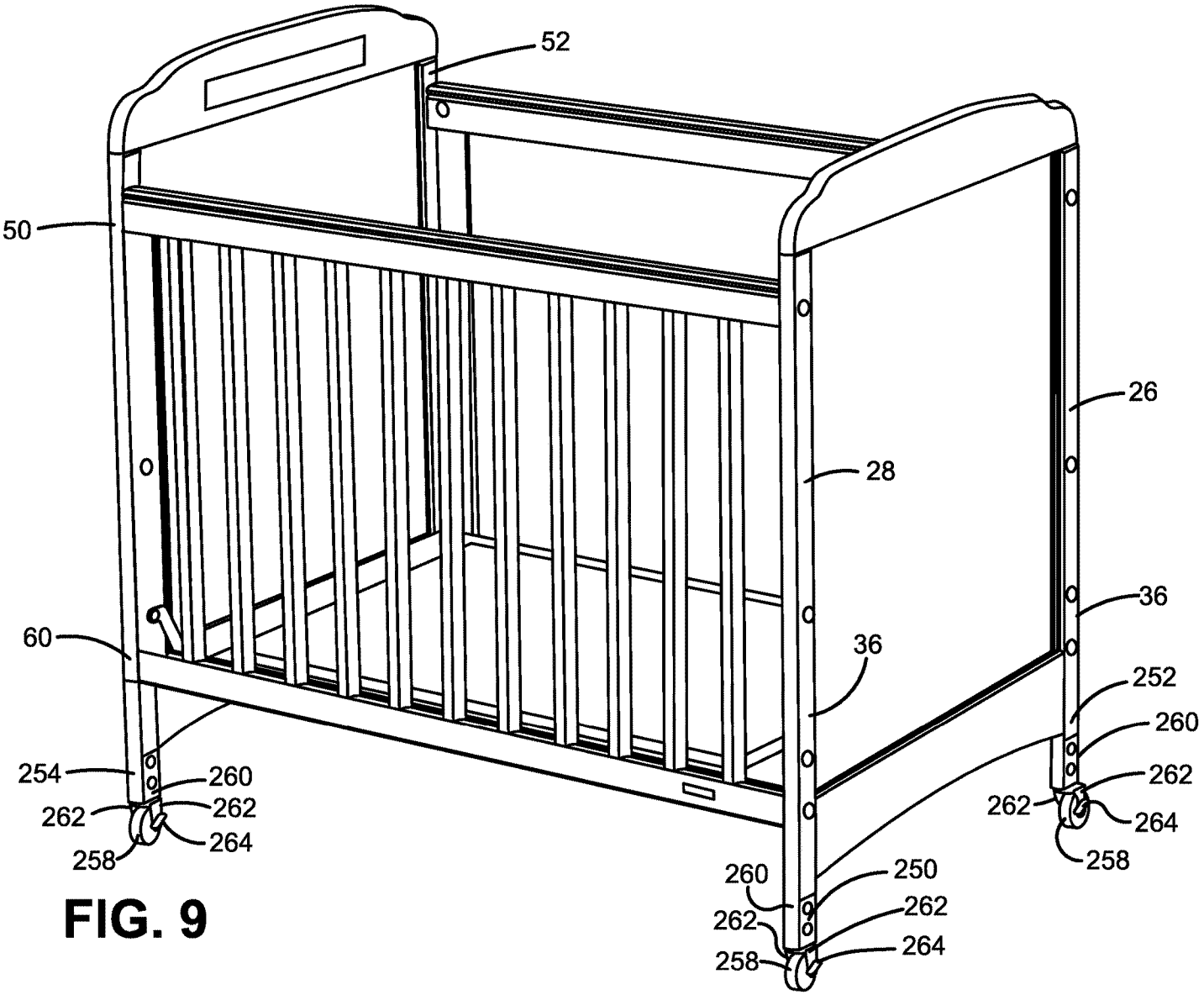
FIG. 9 is a perspective view of the exemplary crib of FIG. 1 including castors to facilitate movement of the crib.
Figure 18:
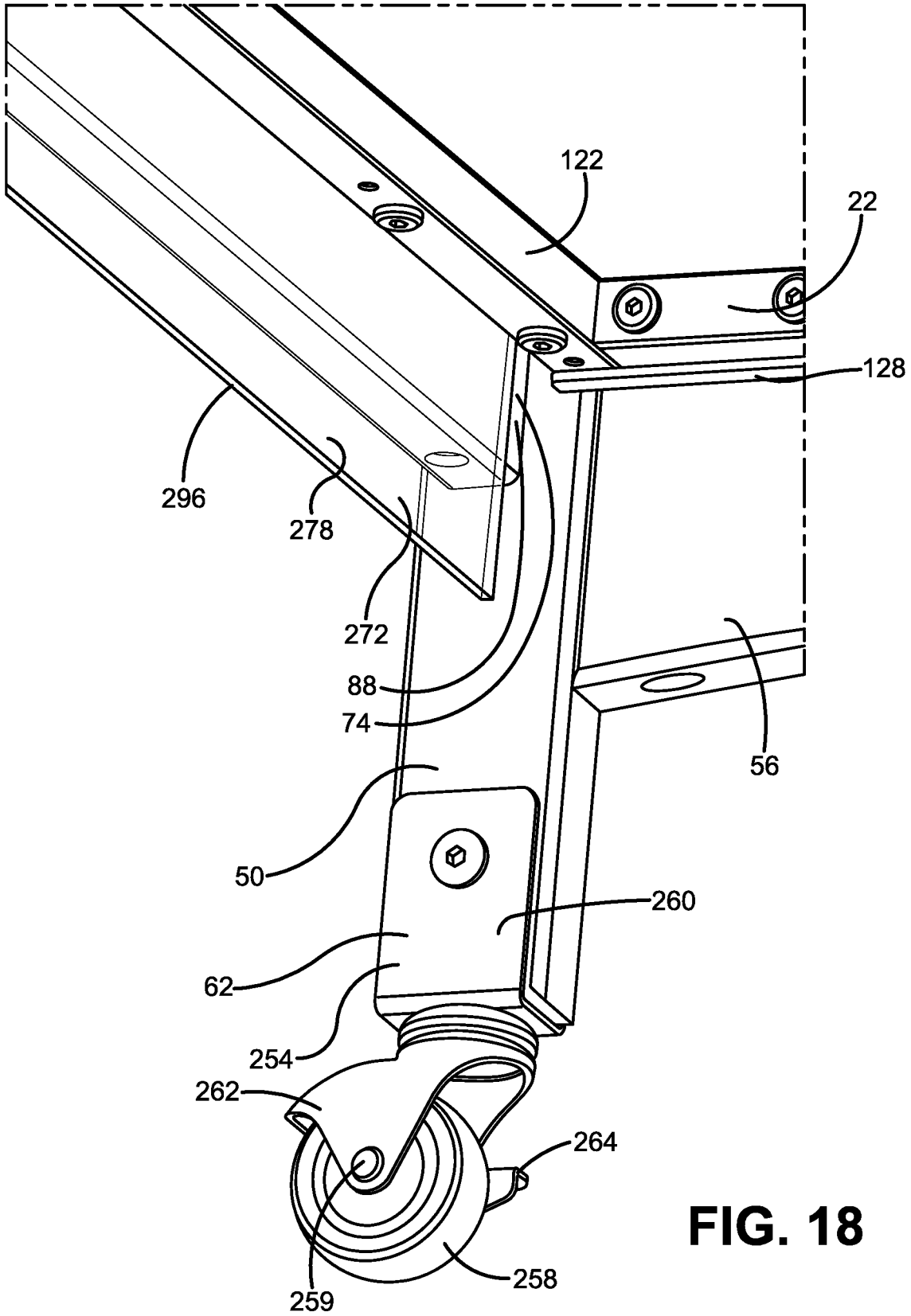
FIG. 18 is an enlarged bottom perspective view of a bottom panel of the crib of FIG. 11 showing a caster as well as the side panel extending through a slot between the bottom panel and the bottom rail.
Figure 19:
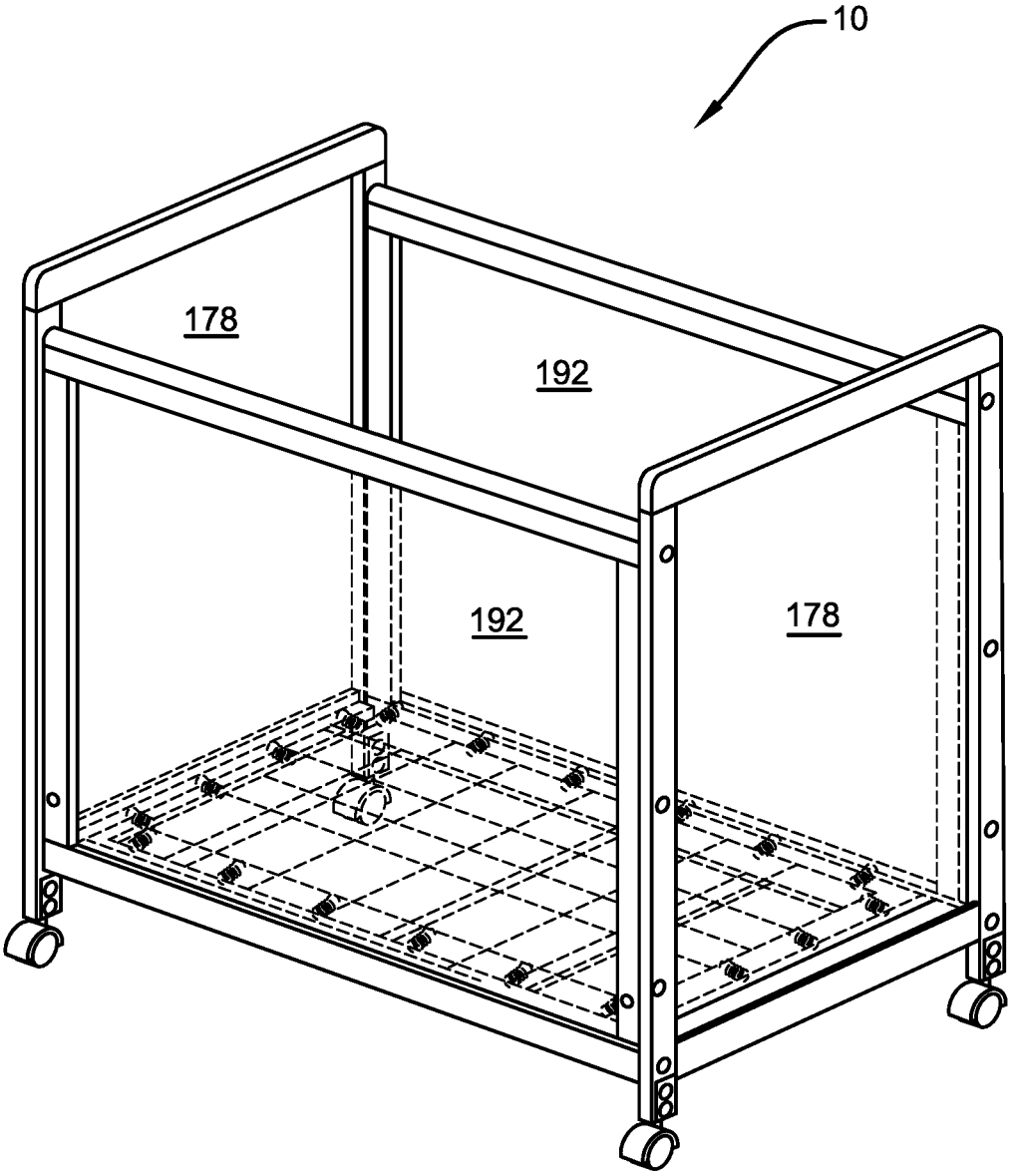
FIG. 19 is a perspective view of an alternative exemplary crib arrangement including transparent sidewall panels and transparent end wall panels.
Figure 20:
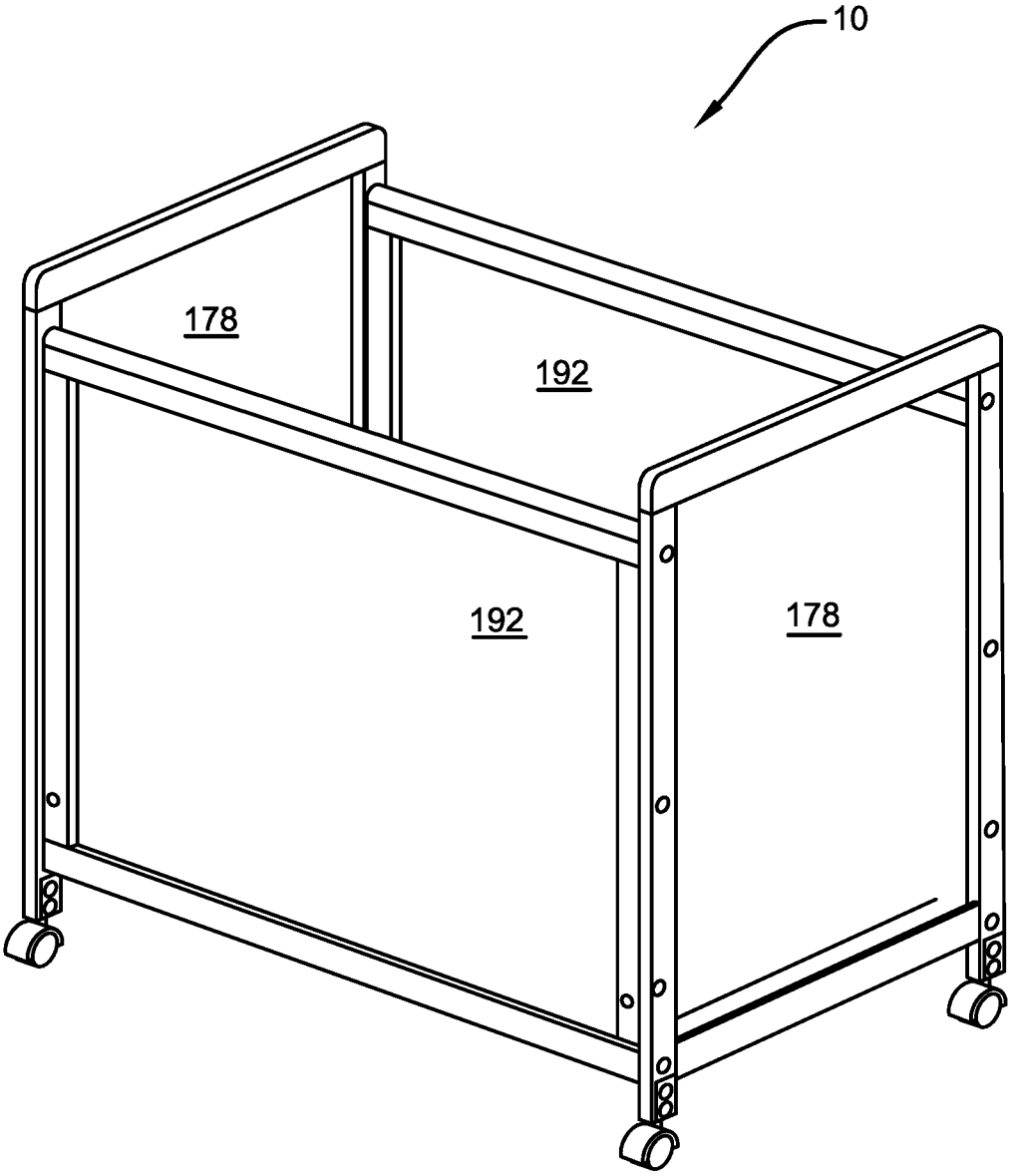
FIG. 20 is a perspective view of the crib arrangement of FIG. 19.
Figure 21:
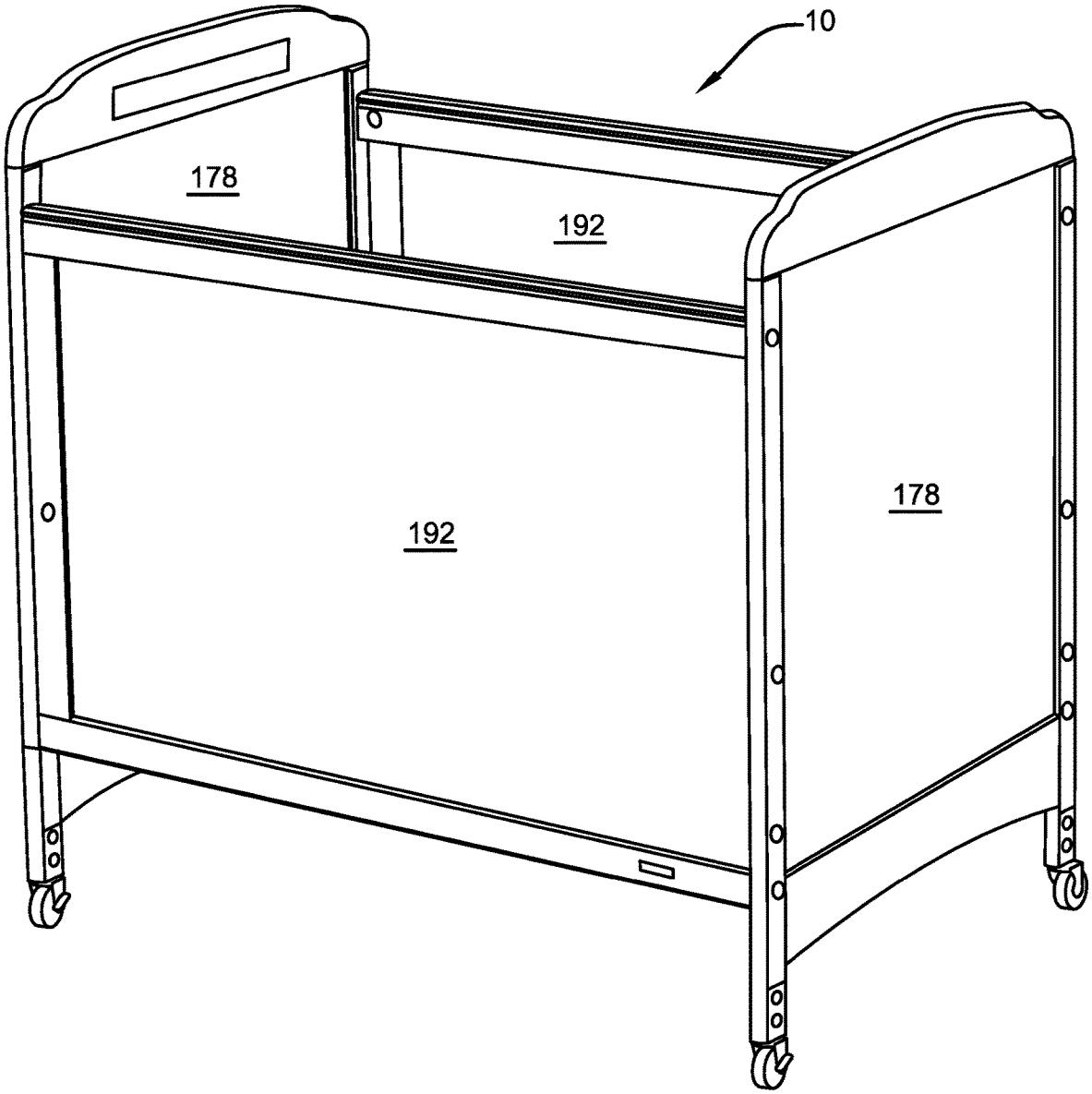
FIG. 21 is a perspective view of a further alternative exemplary crib arrangement.
Figure 22:
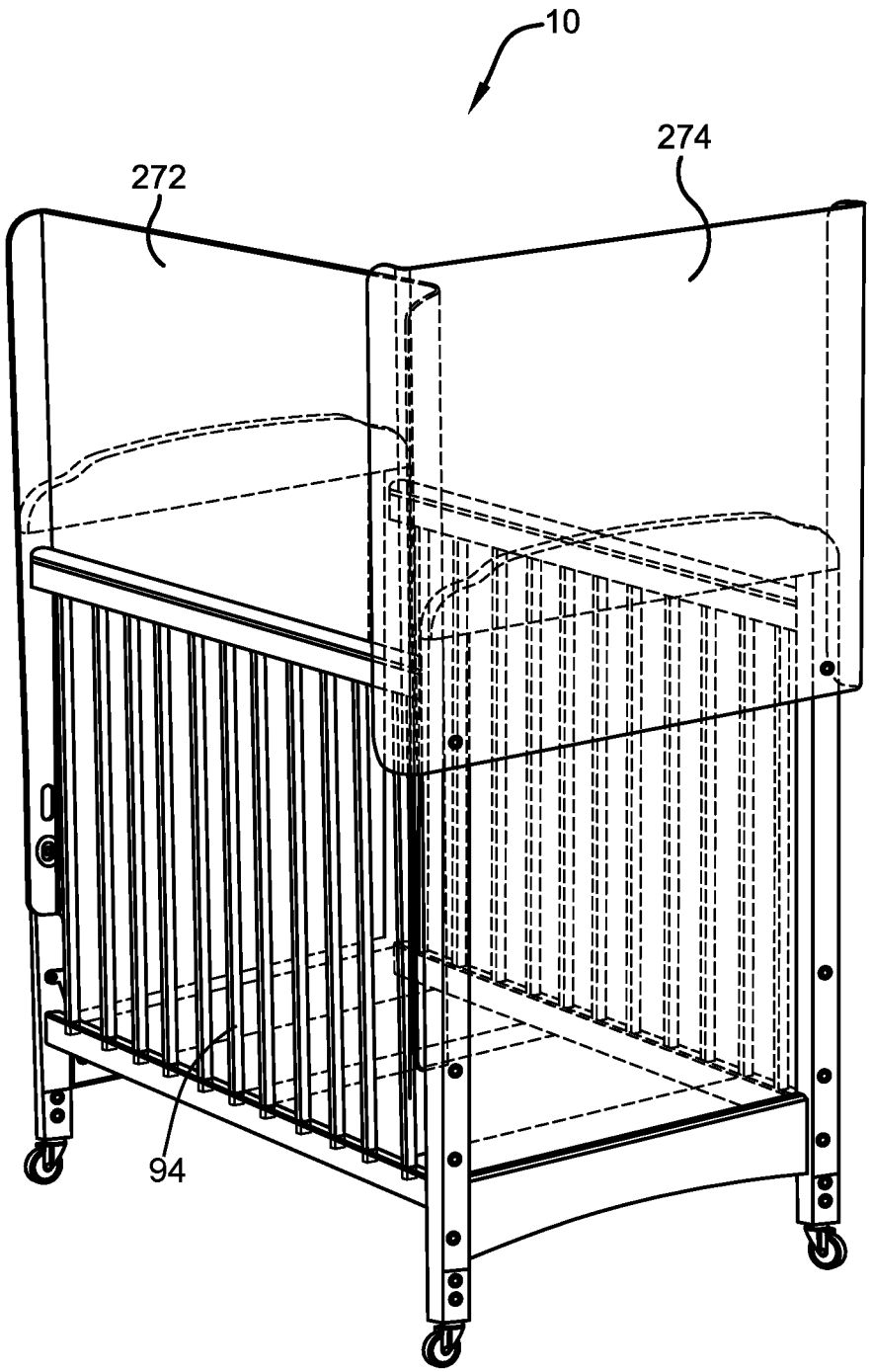
FIG. 22 is a perspective view of an alternative exemplary crib arrangement including an end panel and a side panel as well as exemplary transparent end wall panels.

In some exemplary arrangements, such as shown in FIGS. 9 and 18, a respective caster may be in operative connection with the lower end of each of the vertical members. For example, a caster 252 may be in operative connection with the lower end 36 of vertical member 26, a caster 250 may be in operative connection with the lower end 36 of vertical member 28, a caster 254 may be in operative connection with lower end 60 of vertical member 50, and a caster (not shown) may be in operative connection with the lower end 60 of vertical member 52. Each caster includes a roller 258 that is cylindrical and includes an axle 259 that rotates about an axis 261 that is parallel to the floor. The exemplary casters include a housing 260 that is in operative engagement with the respective vertical member and may include openings and fasteners to secure the housing 260 thereto. The housing 260 is in operative connection with caster support members 262 that are in operative engagement with the axle 259. The caster support members 262 are disposed on either side of the cylindrical roller 258. The axle 259 extends through the support members 262 and through the cylindrical roller 258 disposed therebetween. The axle 259 may be held in place through fasteners such as bolts disposed on the outside of the support members 262. In addition, the casters may also include brakes 264. The brakes 264 are enabled to be changed between an engaged position and a disengaged position. In the engaged position of the brakes 264, the rollers 258 are prevented from rolling, and the crib 10 is relatively immovable. In the disengaged position, the caster rollers 258 are enabled to roll and the crib 10 is selectively movable. Of course, these arrangements of the casters are merely exemplary, and in other arrangements, other caster types and configurations may be used.

Figure 10:
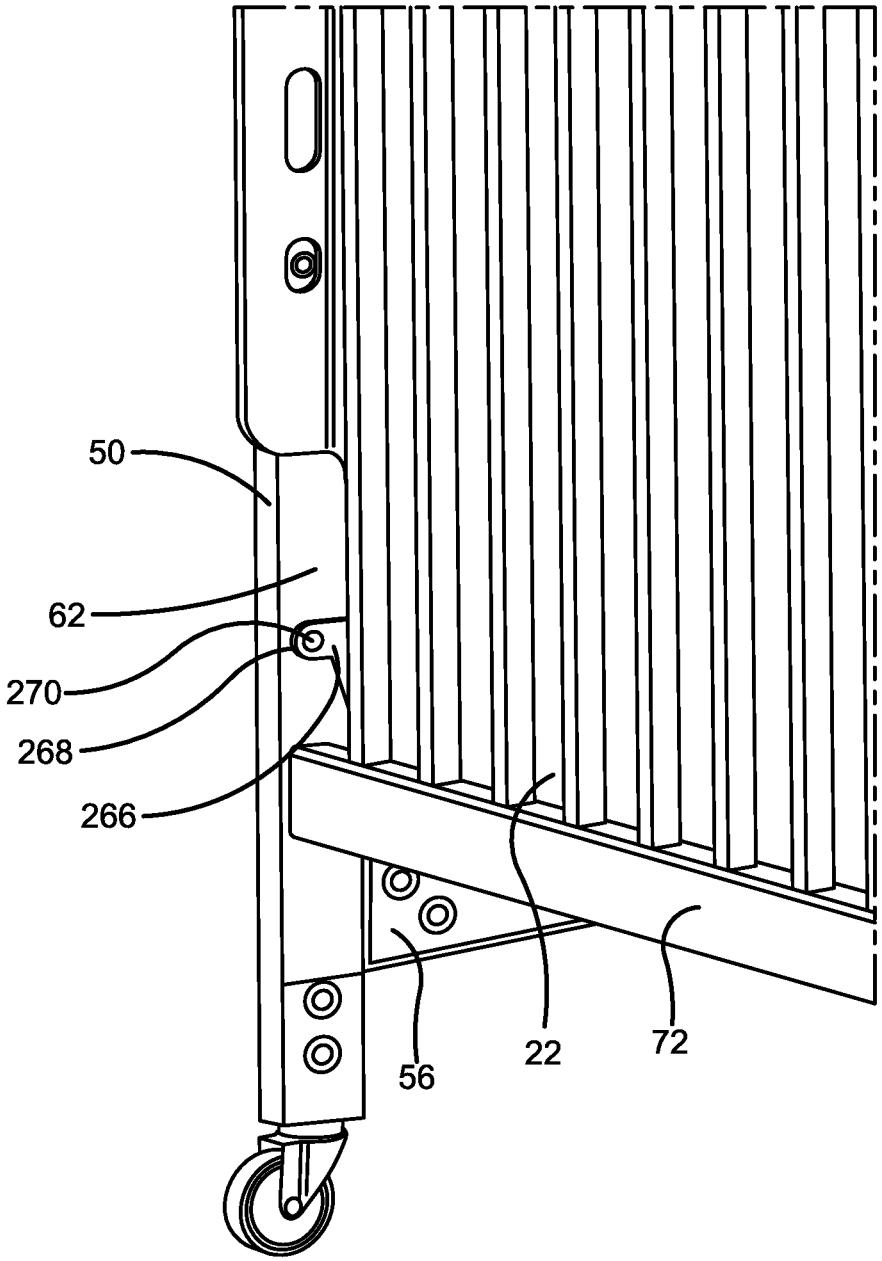
FIG. 10 is an enlarged perspective view of the exemplary casters of the exemplary crib and an exemplary reinforcing member in operative connection with an exemplary vertical member.

In exemplary arrangements, the crib 10 may further include reinforcing members 266, as shown in FIG. 10. The reinforcing members 266 are in operative connection with the bottom panel 22 and are operatively connected to the inner face of each respective adjacent vertical member. For example, as shown in FIG. 10, exemplary reinforcing member 266 is operatively connected to the inner face 62 of vertical member 50 through a fastener 268 extending through an opening 270 of the reinforcing member 266. As can be appreciated, a similar reinforcing member 266 and means of connection is utilized at each of the other vertical members 26, 28, and 52. Of course, this arrangement is exemplary, and in other arrangements, other configurations may be used.

For example, in arrangements in which the crib sidewalls 14 and 16 are comprised of transparent sidewall panels 192, the inner face of each of the respective adjacent vertical members may not be available for such a connection between the reinforcing member 266 and the respective vertical member. In such arrangements, the bottom panel 22 may be directly connected to the respective vertical member, bottom rails, and bottom crossbar, or the bottom panel 22 may be integrally formed with the respective vertical member. However, these alternative arrangements are merely exemplary, and in other arrangements, other alternative structures may be used for connection of the bottom panel 22 and the respective crib walls 14, 16, 18, and 20.

Although not shown, in some arrangements the reinforcing member 266 may be operatively connected to the end wall 128 of bottom panel 22. For example, the reinforcing member 266 may be operatively connected to an outer face of the end wall 128 of bottom panel 22 through similar fasteners and reinforcing member openings operatively arranged on the panel reinforcing member in engagement with the bottom panel 22. The reinforcing member 266 may be disposed between the outer face of the end wall 128 and the inner face 136 of bottom crossbar 56. Of course, these arrangements are merely exemplary, and in other arrangements other configurations may be used. For example, in some arrangements the reinforcing member 266 may be integrally formed with the end wall 128 of bottom panel 22. In other exemplary arrangements, the bottom panel 22 may be directly connected to, or integrally formed with the bottom rail 74 of crib sidewall 14, and/or the bottom panel 22 may be directly connected to, or integrally formed with the bottom cross bar 56. However, these alternative arrangements are merely exemplary, and in other arrangements, other structures and configurations may be used. As can be appreciated, a similar arrangement and connection of each reinforcing member in operative connection with a respective vertical member is present in the exemplary crib 10, although not clearly shown in the Figures.

Figure 11:
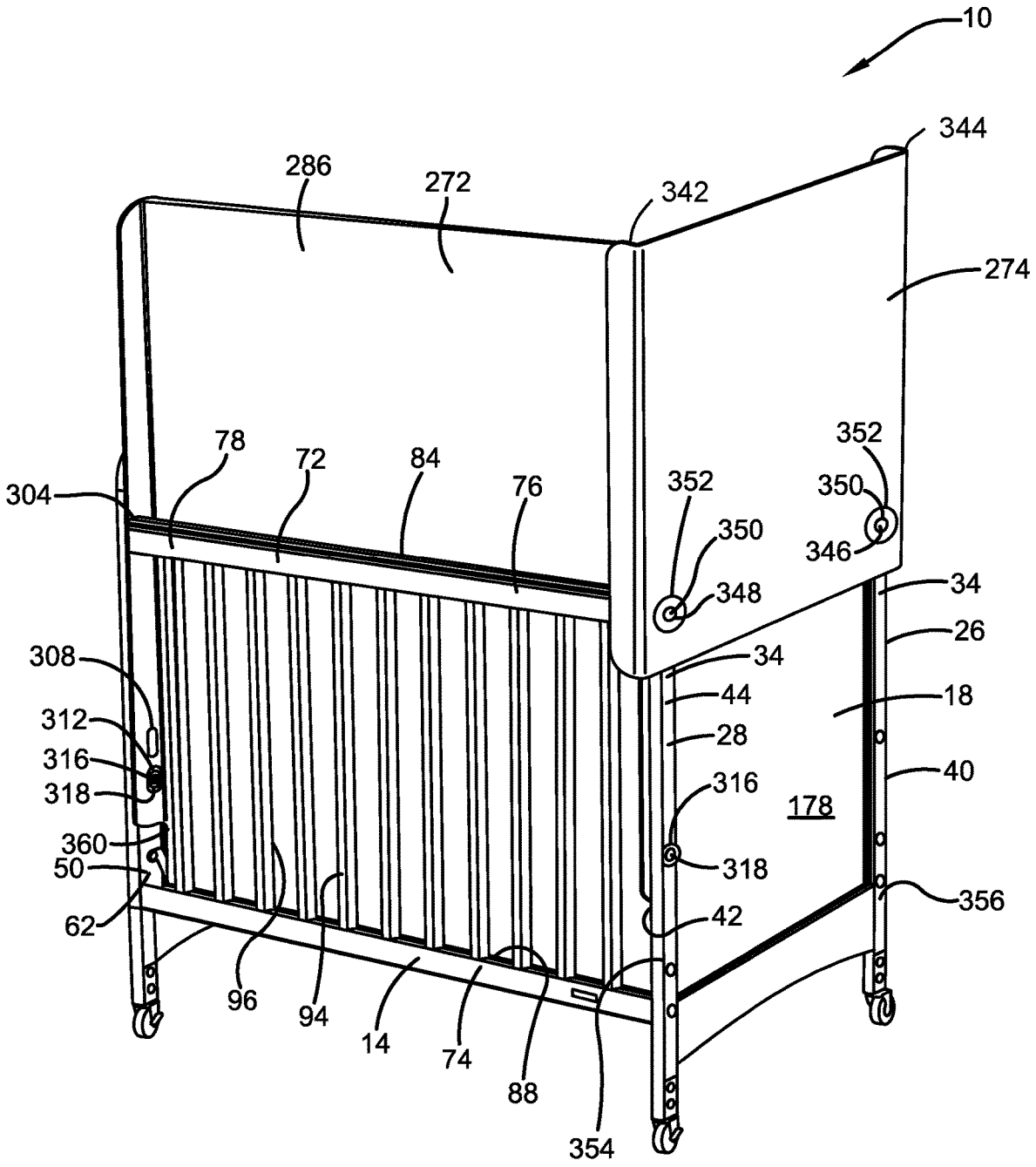
FIG. 11 is a perspective view of an alternative exemplary crib arrangement including an end panel and a side panel.
Figure 12:
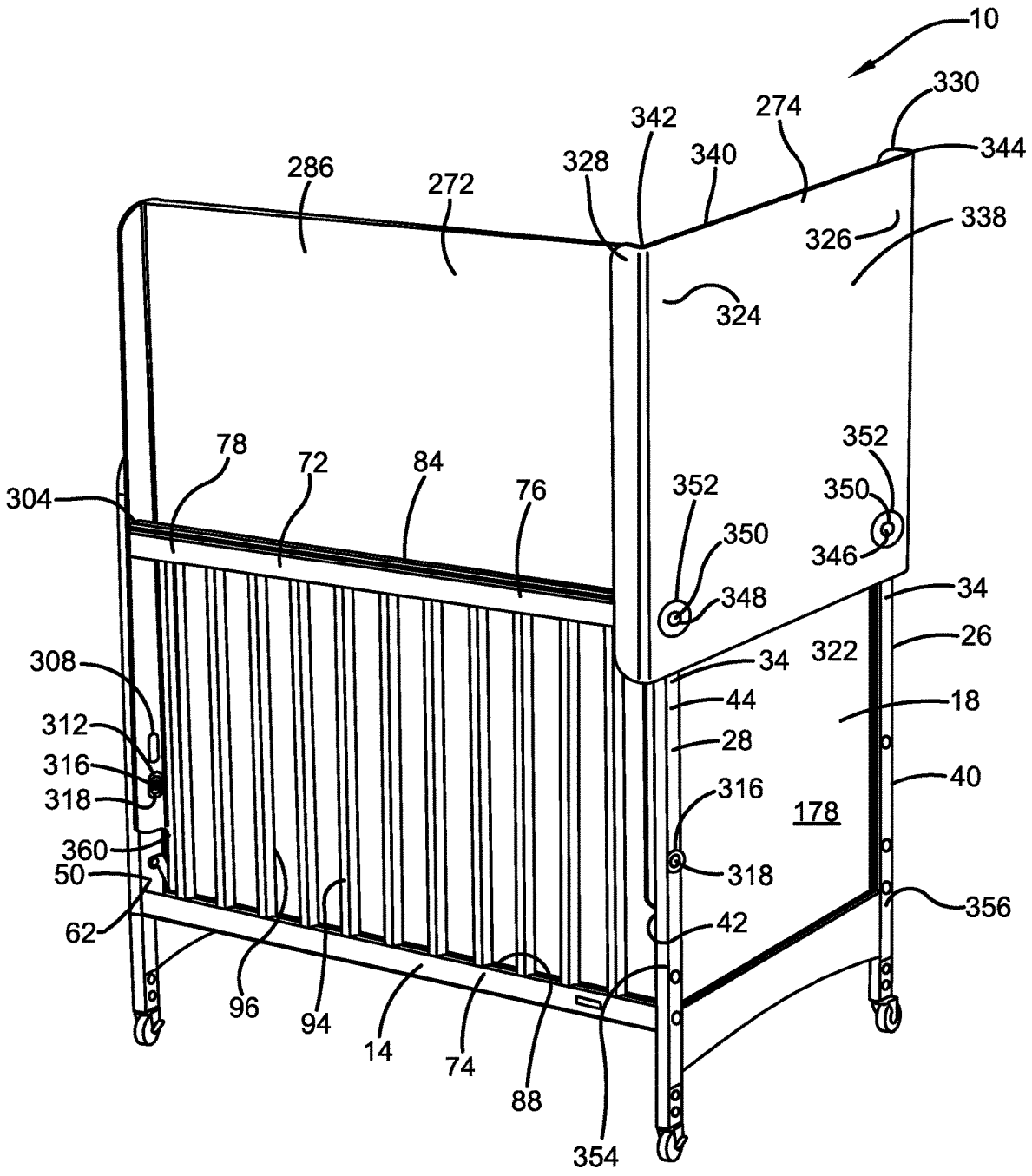
FIG. 12 is a perspective view of the alternative exemplary crib arrangement of FIG. 11 including an end panel and a side panel as well as resilient retaining washers.

Now referring to FIGS. 11 and 12 which show an exemplary crib arrangement with an exemplary side panel 272 and an exemplary end panel 274. As shown in FIGS. 11 and 12, the exemplary crib arrangement 10 shown therein includes the crib sidewall 14 with slats 94 and an end wall 18 with a transparent end wall panel 178. In this exemplary arrangement, the crib sidewall 14 includes side panel 272 in operative connection therewith. In addition, in this exemplary arrangement, the end wall 18 includes an end panel 274 in operative connection therewith.

Figure 13:
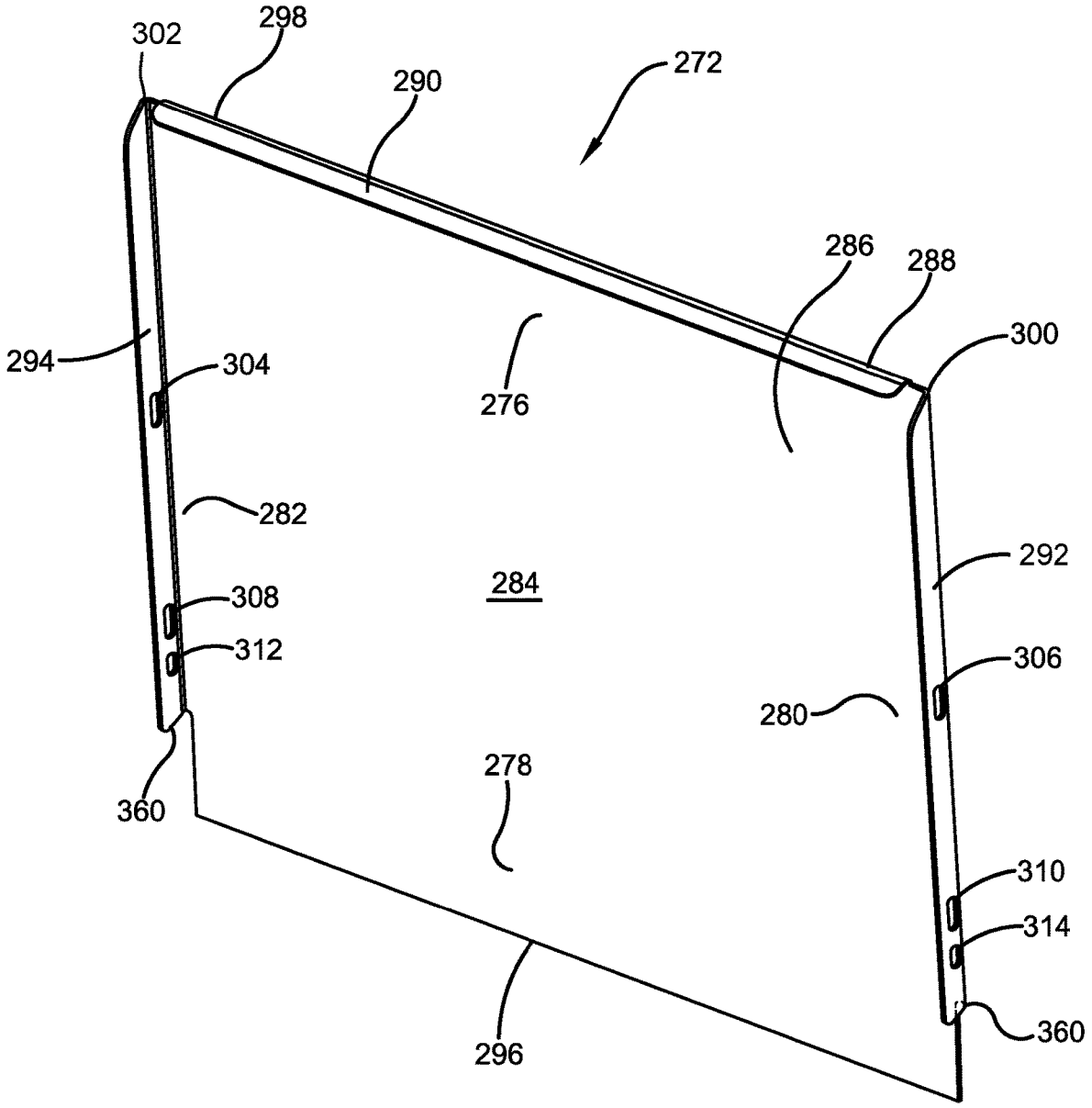
FIG. 13 is a perspective view of an exemplary side panel.

Referring now to FIG. 13, there is shown an exemplary side panel 272. The exemplary side panel 272 is comprised of non-air permeable, transparent rigid material such as clear plastic. However, in other arrangements side panel 272 may be comprised of other materials, transparent or not transparent. Exemplary side panel 272 is rectangular and includes an upper side panel end 276, a lower side panel end 278, a side end 280, and a side end 282. The exemplary side panel 272 further includes a generally planar middle portion 284 that extends vertically within the crib space between the upper side panel end 276, lower side panel end 278, side end 280, and side end 282. Side panel 272 further includes an outward facing face 286 and an inner facing face 288. In the operative condition of this exemplary arrangement the side panel is within the crib space.

Still referring to FIG. 13, the exemplary side panel 272 includes an upper flange portion 290, a turned portion 292, a turned portion 294, and a lower side panel end surface 296. Upper flange portion 290 is in operative connection with the upper end 276 of the side panel 272. Upper flange portion 290 extends horizontally or near horizontally and perpendicular to the generally planar vertically extending middle portion 284. The upper flange portion 290 further extends perpendicular to the turned portions 292, 294. The upper flange portion 290 extends outward from the outer face 286 and extends away from the inner face 288 and away from the crib space. The upper flange portion extends above and vertically overlies the top rail of the crib sidewall. The exemplary side panel 272 may further include a horizontally extending extension part 298 that horizontally extends outward away from the inner face 288 of side panel 272 at an obtuse angle. The horizontally extending extension part 298 operatively connects the upper flange 290 and the upper end 276. The horizontal extension part 298 may be integrally formed with the upper end 276 and the upper flange portion 290, or in alternative exemplary arrangements, the upper flange portion 290 may be directly integrally formed with the side panel upper end 276.

Turned portion 292 is in operative connection with the side end 280 of the side panel 272. Turned portion 292 extends vertically and extends perpendicular to the generally planar vertically extending middle portion 284. The turned portion 292 extends outward from the outer face 286 and extends away from the inner face 288. The exemplary side panel 272 further includes a horizontally extending extension part 300 that extends horizontally outward away from the inner face 288 of side panel 272 at an obtuse angle. The horizontally extending extension part 300 operatively connects the turned portion 292 and the side end 280. The horizontally extending extension part 300 may be integrally formed with the side end 280 and the turned portion 292, or in alternative exemplary arrangements, the turned portion 292 may be integrally formed with the side end 280 and the side panel.

Turned portion 294 is in operative connection with the side end 282 of the side panel 272. Turned portion 294 extends vertically and perpendicular to the generally planar vertically extending middle portion 284. The turned portion 294 extends outward from the outer face 286 and extends away from the inner face 288. The exemplary side panel 272 may further include a horizontally extending extension part 302 that horizontally extends outward away from the inner face 288 of side panel 272 at an obtuse angle. The horizontally extending extension part 302 operatively connects the turned portion 294 and the side end 282. The horizontally extending extension part 302 may be integrally formed with the side end 282 and the turned portion 294, or in other exemplary arrangements, the turned portion 294 may be directly integrally formed with the side end 282 and the side panel.

The exemplary side panel 272 further includes a pair of upper securing openings 304 and 306 and a pair of lower securing openings 308 and 310. The securing openings are alternatively referred to herein as apertures. The upper securing openings 304 and 306 and the lower securing openings 308 and 310 extend through the respective turned portions 292 and 294. For example, upper aperture 304 and lower aperture 308 extend through the turned portion 294, and the upper aperture 306 and the lower aperture 310 extend through turned portion 292. In certain exemplary arrangements, the turned portions 292 and 294 may additionally include further securing openings such as further securing openings 312 and 314.

Figure 15:
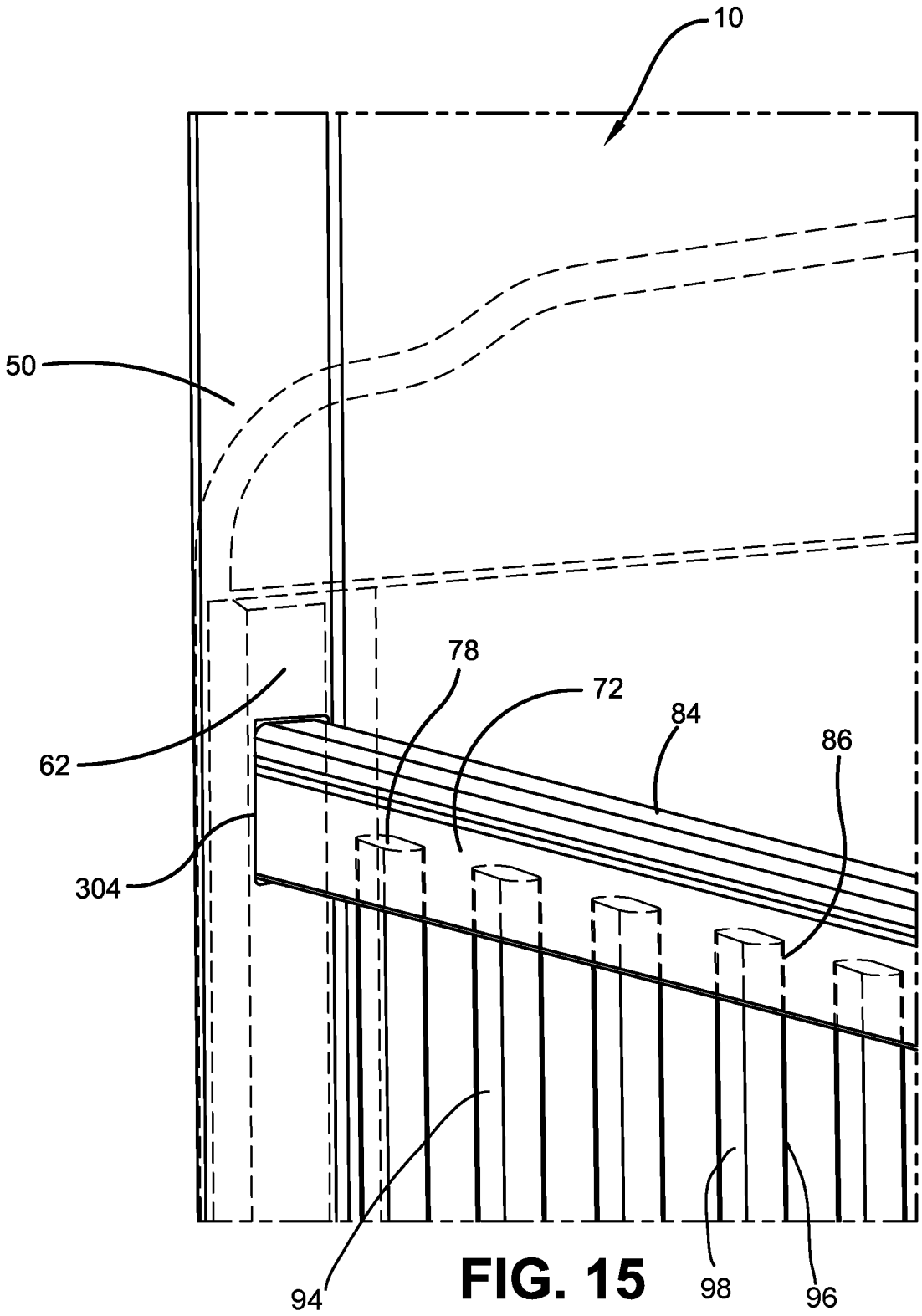
FIG. 15 is a partial perspective view of a side panel of the crib of FIG. 11 showing a top rail in operative connection with a vertical member of the crib and extending through an aperture in the side panel.

Referring again to FIGS. 11 and 12, the exemplary side panel 272 is in operative engagement with the crib sidewall 14 of the crib 10. In the exemplary arrangement, the side panel 272 is disposed within the crib space on an inner side of the crib sidewall 14 such that the outer face 286 of side panel 272 is in immediately adjacent relation with the inner face 84 of top rail 72, the inner face 96 of slats 94, and the inner face 88 of bottom rail 74. Further, the side panel 292 is in immediately adjacent relation with the face 42 of vertical member 28, and the side turned portion 294 is in immediately adjacent relation with the face 62 of vertical number 50. As shown in FIGS. 11, 12, and 15 a portion 78 of the top rail 72 extends through the upper aperture 304 to thereby operatively engage the vertical member 50 on an external facing side of turned portion 294. This exemplary arrangement causes the side panel, the top rail and the vertical member to be in operatively engaged relation. Also in the exemplary arrangement a further portion 76 of top rail 72 extends through the aperture 306 to operatively engage the top rail, side panel and vertical member 28 on an opposed side of the side panel 272 through turned portion 292 in a similar manner to that achieved via the engagement of turned portion 294, portion 78 of top rail 72, and aperture 304.

It should be understood that while in this exemplary arrangement the portion of the top rail that extends through the aperture includes an outer periphery of the top rail immediately adjacent to an adjacent vertical member, in other arrangements other portions of the top rail may extend through a respective aperture. This may include for example a respective fastener, projection, dowel pin or other item which shall be considered for purposes hereof to be a portion of the top rail. In some such arrangements the side panel may extend in sandwiched relation between at last some of the top rail and the adjacent vertical member with the aperture occupying only a portion of the cross-sectional area of an end face of the top rail. In such arrangements the abutting sandwiched relation between the side panel, top rail and vertical member may provide added strength, rigidity and support to the side panel and may further help to resist deformation and hold the side panel in the desired position. Of course it should be understood that this approach is exemplary and in other arrangements other approaches may be used.

The exemplary side panel 272 includes a horizontally extending lower side panel end surface 296 that bounds the lower end of the panel. In this exemplary arrangement, the side panel end surface 296 of side panel 272 extends downward to be in immediately adjacent relation with the inner face of the bottom rail 74. The lower side panel end surface 296 extends in releasable engagement in the slot 130 intermediate of the sidewall 122 of bottom panel 22 and the inner face 88 of bottom rail 74. In the exemplary arrangement the lower side panel end surface 296 extends in the slot and below the bottom panel top surface 23. Further in the exemplary arrangement the lower side panel end surface 296 extends in the slot substantially the entire horizontal width of the slot across the side of the crib. As used herein substantially the entire horizontal width refers to at least 75% of the full width of the slot. Further it should be appreciated that while in the exemplary arrangement the lower side panel end surface is continuous across the bottom of the side panel 272, in other arrangements the lower side panel end surface may include projecting areas that extend further downward than other areas of the end surface when in the operative condition. Of course this configuration is exemplary and in other arrangements other configurations may be used In alternative exemplary arrangements, as shown in FIG. 18 for example, the lower end 278 of side panel 272 and the lower side panel end surface 296 may extend below the bottom panel 22 and below the respective bottom rail. For example, as shown in FIG. 18, the side panel 272 in operative connection with crib sidewall 14 has a lower end 278 with the lower side panel end surface 296 that extends through slot 130 below the bottom panel 22 and the bottom rail 74. As can be appreciated, a similar arrangement and side panel may be included on the crib sidewall 16 of the exemplary crib arrangement 10. For example, the crib sidewall 16 may include a side panel 272 in operative connection therewith that includes a lower side panel end surface 296 that extends through the slot 132 below the bottom panel 22 and the bottom rail 102. Of course, these arrangements are merely exemplary, and in other arrangements, other structural configurations may be used.

As can be appreciated, the portion of the top rail 72 extending through the upper apertures 304 and 306 is operative to fix the upper end 276 of side panel 272 in position immediately adjacent and in some arrangements in abutting connection with the inner faces of the top rail 72, slats 94, and bottom rail 74. As also can be appreciated, the engagement of the lower side panel end surface 296 of the side panel 272 in slot 130 between the inner face 122 of bottom panel 22 and the inner face 88 of bottom rail 74 is operative to fix the lower end 278 of the side panel 272 relative to the inner faces of the structures of crib sidewall 14 as well. In some exemplary arrangements engagement of the upper end 276 and the lower end 278 with the inner faces of crib sidewall 14 is operative to fix the generally planer middle portion 284 of the side panel 272 in place in adjacent relation to the inner faces 96 of the slats 94.

In addition, the engagement of the top rail 72, the vertical members 28 and 50, and the side panel through the upper apertures 304 and 306, and the engagement of the lower side panel end surface 296 of the side panel 272 in the slot 130 between the inner face 122 of bottom panel 22 and the inner face 88 of bottom rail 74, is operative to fix the turned portions 292 and 294 in aligned relation with the respective crib sidewall and vertical members 28 and 50. However, in alternative exemplary arrangements, the generally planar middle portion 284 of the side panel 272 may be further secured to the vertical members 28 and 50 and the slats 94 through additional rails or other securing members, that are in operative connection with the slats and vertical members, and that extend through the further securing openings 312 and 314.

Further, in alternative exemplary arrangements, the turned portions 292 and 294 may be further secured to their respective immediately adjacent vertical members 28 and 50 via releasable fasteners 316 extending through the further securing openings 312 and 314 and operatively engaging the respective vertical member.

In some arrangements the fasteners 316 may include resilient washers 318. Resilient washers 318 may be comprised of rigid or semi-flexible rubber, metal washers encased in rubber or other resilient material, or other washer materials operative to spread the fastening force to prevent cracking, splintering, and breaking of side panels 272. However, the functions of the resilient washers 318 and the fasteners 316 may be alternatively operatively achieved through other structures such as brackets in operative engagement with the side panel 272, vertical members, and top and bottom rails. Such brackets may be comprised of sufficiently rigid yet flexible materials to prevent breaking, cracking, and splintering of the side panels 272. Of course, these arrangements are merely exemplary, and in other arrangements, other approaches and materials may be used.

Figure 16:
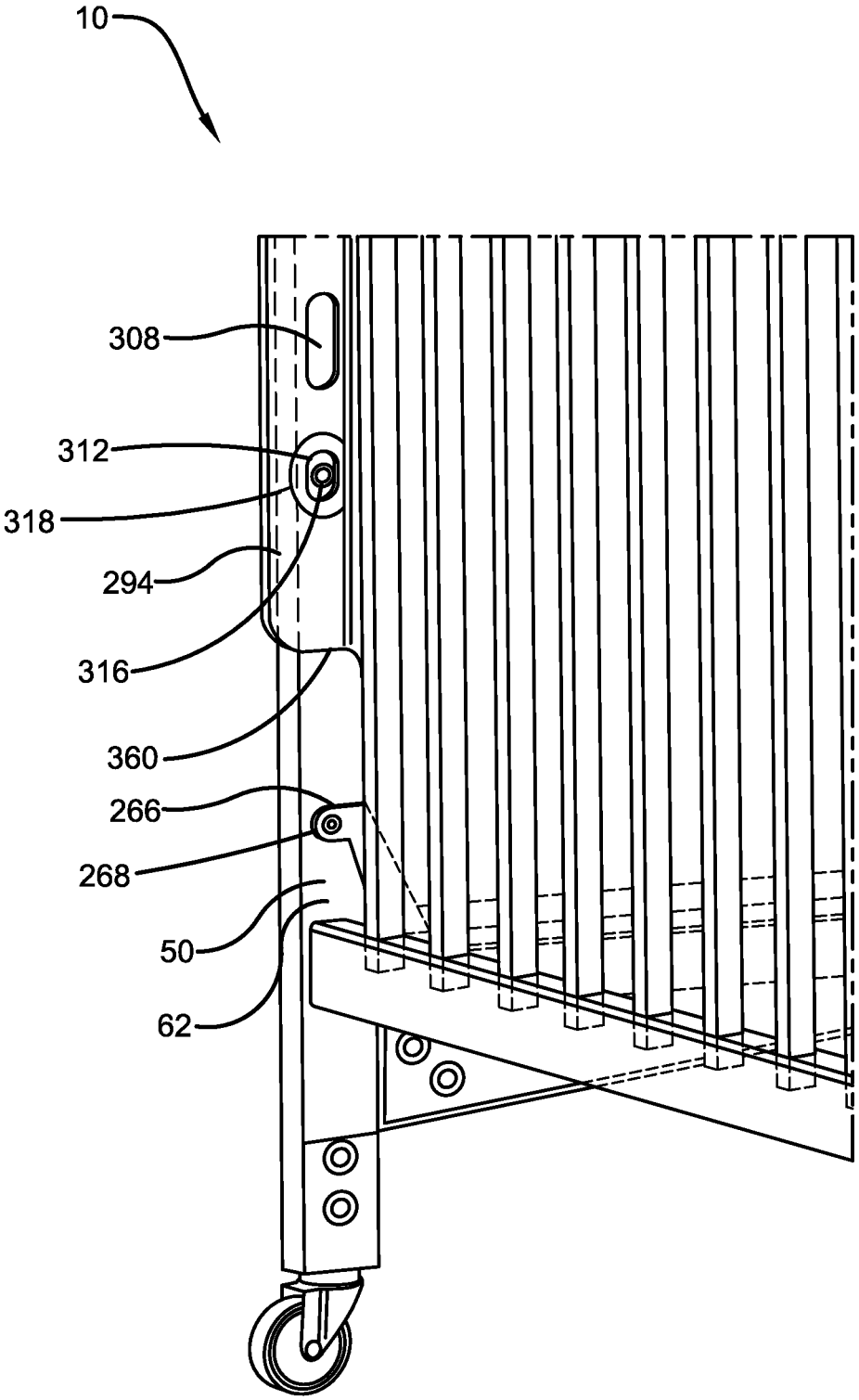
FIG. 16 is an enlarged perspective view of a sidewall of the crib of FIG. 11 showing a reinforcing member in operative connection with a vertical member and an exemplary side panel recess.

As shown in FIG. 16, the exemplary side panel 272 further includes a turned portion recesses 360 that extends in the turned portions 292 and 294. The recesses 360 extend in the respective turned portions 292 and 294 adjacent the lower end 278 of side panel 272. The exemplary recesses 360 enable the reinforcing members 266 to be operatively engaged with the inner face of the respective vertical member to which the reinforcing member is attached. For example, FIG. 16 shows an exemplary side panel recess 360 that extends in the turned flange 294 of exemplary side panel 272. As shown in FIG. 16, the exemplary recess 360 provides enough space for the reinforcing member 266 to be operatively connected to the inner face 62 of vertical member 50 through fasteners 268. A similar arrangement is present between the side panel 292, which also includes a recess 360, and the vertical member 28 to which another reinforcing number 266 of the bottom panel 22 is connected. Of course, these arrangements are merely exemplary, and in other arrangements, other approaches may be used.

Figure 17:
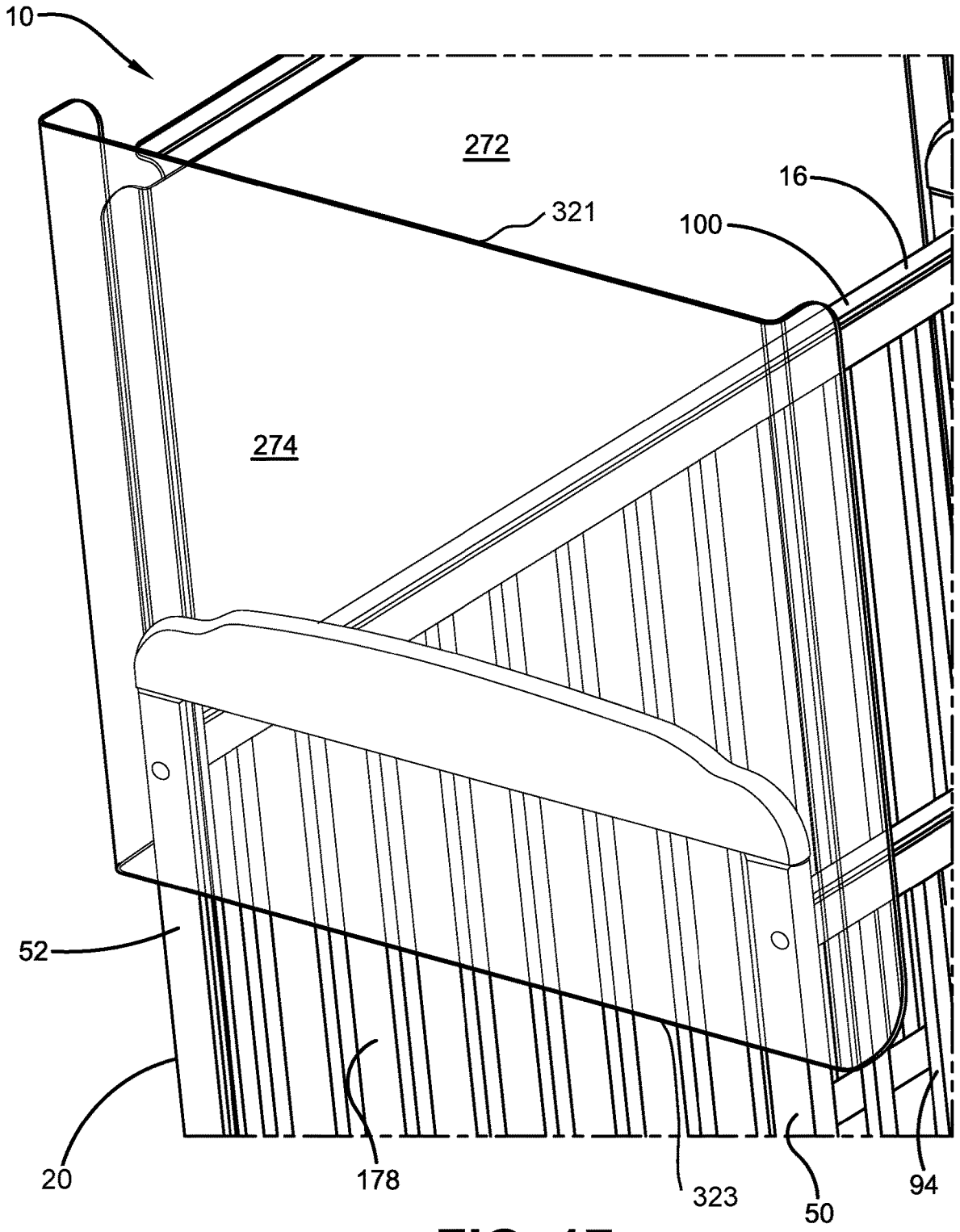
FIG. 17 is an enlarged perspective view of the crib arrangement of FIG. 11 including an end panel and a side panel in operative connection with the exemplary crib.

As can be appreciated, as shown in FIG. 17, a side panel 272 may be in operative connection with the crib sidewall 16 of exemplary crib 10 in a manner similar to that of the side panel 272 that is in operative connection with the crib sidewall 14. In further arrangements, a respective side panel 272 may be included in operative connection with each of the crib sidewalls 14 and 16.

Figure 14:
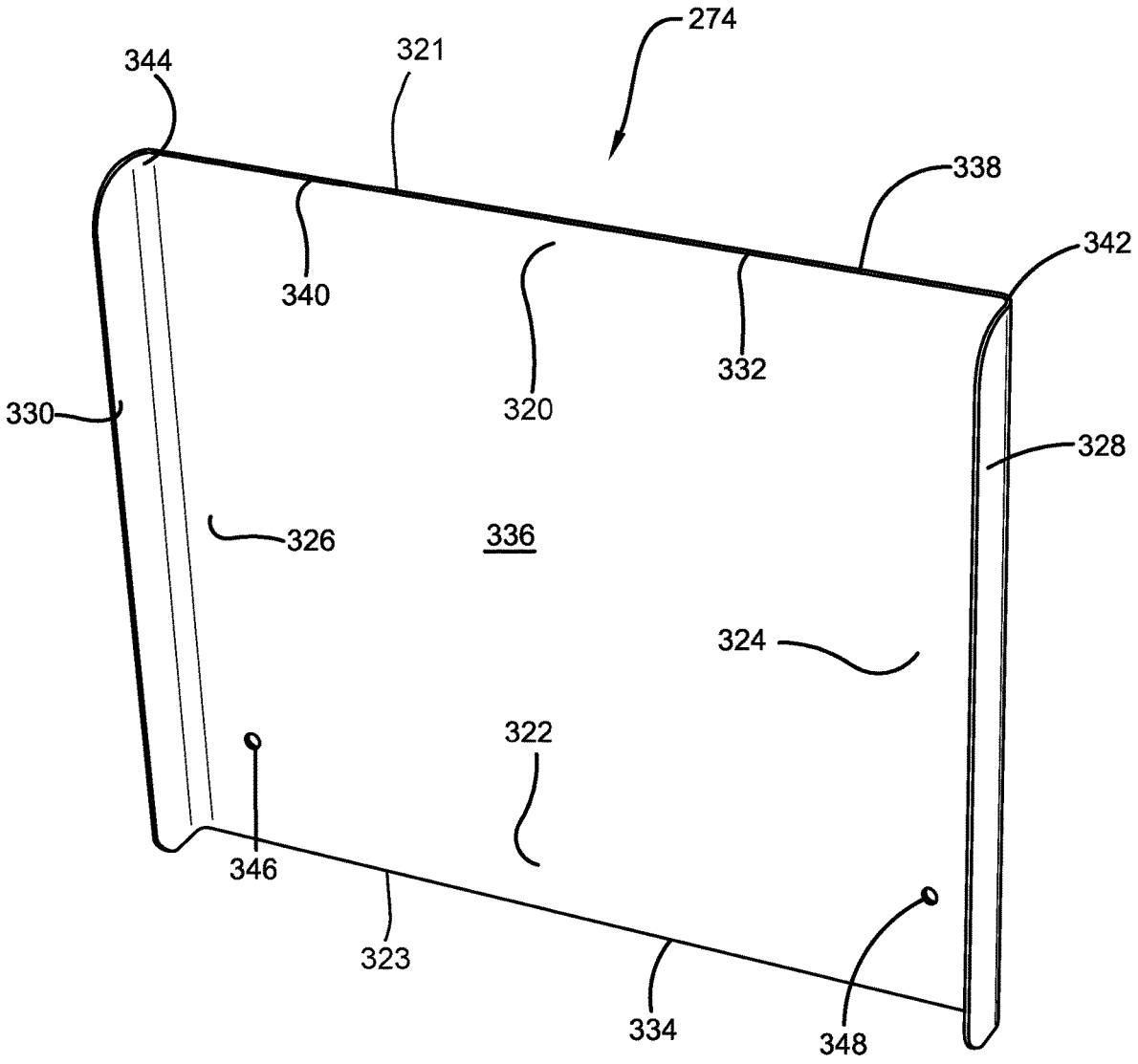
FIG. 14 is a perspective view of an exemplary end panel used in the arrangement shown in FIG. 11.

Referring now to FIG. 14, there is shown an exemplary end panel 274. Exemplary end panel 274 is comprised of non-air permeable, transparent rigid material such as clear plastic. However, end panel 274 may be comprised of other materials, transparent or not transparent. Exemplary end panel 274 is rectangular and includes an upper end 320, a lower end 322, a side end 324, and a side end 326. The exemplary end panel includes an end panel top 321 and an end panel bottom 323. While the end panel top and end panel bottom extend continuously horizontally in the operative condition of the exemplary crib arrangement, in other arrangements other configurations may be used. The exemplary end panel 274 further includes a substantially planar middle portion 336 that extends vertically between the upper end 320, the lower end 322, the side end 324, and the side end 326. End panel 274 further includes an outer face 338 and an inner face 340, that extends in facing relation toward the crib space.

Still referring to FIG. 14, the exemplary end panel 274 includes an end panel side flange 328 and an end panel side flange 330. The side flange 328 is in operative connection with the side end 324 of the end panel 274. Side flange 328 extends perpendicular to the generally planar vertically extending middle portion 336 and the immediately adjacent crib end wall when in the operative condition. Each exemplary end panel side flange is further configured to extend parallel to the generally planar portion of the immediately adjacent side panel 272 when the end panel is mounted and is in the operative condition in the crib arrangement. Side flange 328 extends vertically and inward toward the crib space 12 from the inner face 340 and extends away from the outer face 338. The exemplary end panel 274 may further include a horizontally extending extension part 342 that horizontally extends at an obtuse angle inward from the inner face 340 and away from the outer face 338. The exemplary horizontally extending extension part 342 operatively connects the side flange 328 and the side end 324. The horizontally extending extension part 342 may in some arrangements be integrally formed with the side end 324 and the side flange 328. As can be appreciated, the side flange 328 may be integrally formed with the side end 324 of the end panel 274.

The side flange 330 is in operative connection with the side end 326 of the end panel 274. Side flange 330 extends vertically and perpendicular to the substantially planar vertically extending middle portion 336. The side flange 330 extends inward toward the crib space 12 from the inner face 340 and extends away from the outer face 338. The exemplary end panel 274 may further include a horizontally extending extension part 344. Horizontally extending extension part 344 horizontally extends inward at a relatively obtuse angle from the inner face 340. The extension part 344 operatively connects the side flange 330 and the side end 326. The extension part 344 may be integrally formed with the side end 326 and the side flange 330. As can be appreciated, the side flange 330 may be integrally formed with the side end 326 of the end panel 274.

The exemplary end panel 274 further includes a pair of securing openings 346 and 348 which are alternatively referred to as apertures. The exemplary securing openings 346 and 348 extend through the middle portion 336 of the end panel 274 in close proximity to the lower end 322 of the end panel 274. However, as can be appreciated, the securing openings 346 and 348 may be positioned elsewhere on the end panel 274 in other arrangements. In addition, the end panel 274 may include additional securing openings (not shown), for example, securing openings that extend through the side flanges 328 and 330.

Referring again to FIGS. 11 and 12, the exemplary end panel 274 is in operative connection with the crib end wall 18 of the exemplary crib 10. In the exemplary arrangement, the end panel 274 is disposed on an outer side of the crib end wall 18 such that the inner face 340 of the end panel 274 is in immediately adjacent relation with the outer faces 40 and 44 of vertical members 26 and 28. For example, in some arrangements the inner face 340 of the end panel 274 near the lower end 322 and near the side end 326 is in immediately adjacent abutting relation with the outer face 40 of vertical member 26. In this exemplary arrangement the inner face 340 of the end panel 274 near the lower end 322 and near the side end 324 is in immediately adjacent abutting relation with the outer face 44 of vertical member 28. It should be understood however that although in the exemplary arrangement shown the end panel is mounted externally of the crib space, in other arrangements the end panel may be mounted within the crib space that is bounded by the crib end walls.

As shown in FIGS. 11 and 12, the lower end 322 of the exemplary end panel 274 is in immediately adjacent abutting horizontal relation with the upper ends 34 of the vertical members 26 and 28. The securing openings 346 and 348 are in aligned relation with bores (not shown) in the vertical members 26 and 28 such that the end panel 274 may be secured in operatively fixed engagement with the vertical members 26 and 28 via fasteners 350 extending through the securing openings 346 and 348 and into the respective bores in the vertical members 26 and 28.

The exemplary fasteners 350 are operative to secure the end panel 274 to the end wall 18, and the vertical members 26 and 28 thereof, in fixed relation. The fasteners 350 may be a fastener that is operative to fix the end panel 274 in operative engagement with the vertical members 26 and 28. The fasteners 350 may include resilient washers 352, similar to resilient washers 318 previously discussed. The resilient washers 350 may be comprised of rigid or semi-flexible rubber, metal washers encased in rubber or other resilient material, or other washer materials suitable to spread the applied force to prevent cracking, splintering, and breaking of the end panel 274. However, the functions of the fasteners 350 and the resilient washers 352 may be operatively achieved through other structures such as brackets in operative connection with the end panel 274 and the vertical members 26 and 28. Such brackets may be comprised of sufficiently rigid yet flexible materials to prevent breaking, cracking, and splintering of the end panel 274. Of course, these arrangements are merely exemplary, and in other arrangements, other configurations and materials may be used.

In some exemplary arrangements the fasteners that extend through the apertures 346 and 348 respectively in the end panel may extend into engagement with a respective top rail of a crib sidewall on an opposed side of the crib end wall. In such arrangements a portion of the top rail that is comprised of the engaging fastener extends through the respective aperture. As can be appreciated in such exemplary arrangements this mounting approach for the end panel 274 provides reinforcement and greater structural rigidity. Further as can be appreciated in alternative exemplary arrangements, the generally planar central portion 236 of the end panel may be positioned internally of the associated immediately adjacent crib end wall. In such arrangements a portion of the end panel including the apertures may be positioned in sandwiched relation between an end surface of the respective immediately adjacent top rail that surrounds the portion of the top rail extending through the aperture and the vertical member in a manner similar to the turned portions of the side panel as previously discussed. In such arrangements, the sandwiched relation of the end panel with an end surface of the top rail and with portions of the top rail extending therethrough may further provide additional reinforcement, structural rigidity and strength to the end panel. Of course it should be understood that these alternative arrangements are exemplary of many different arrangements that may be used.

Figure 23:
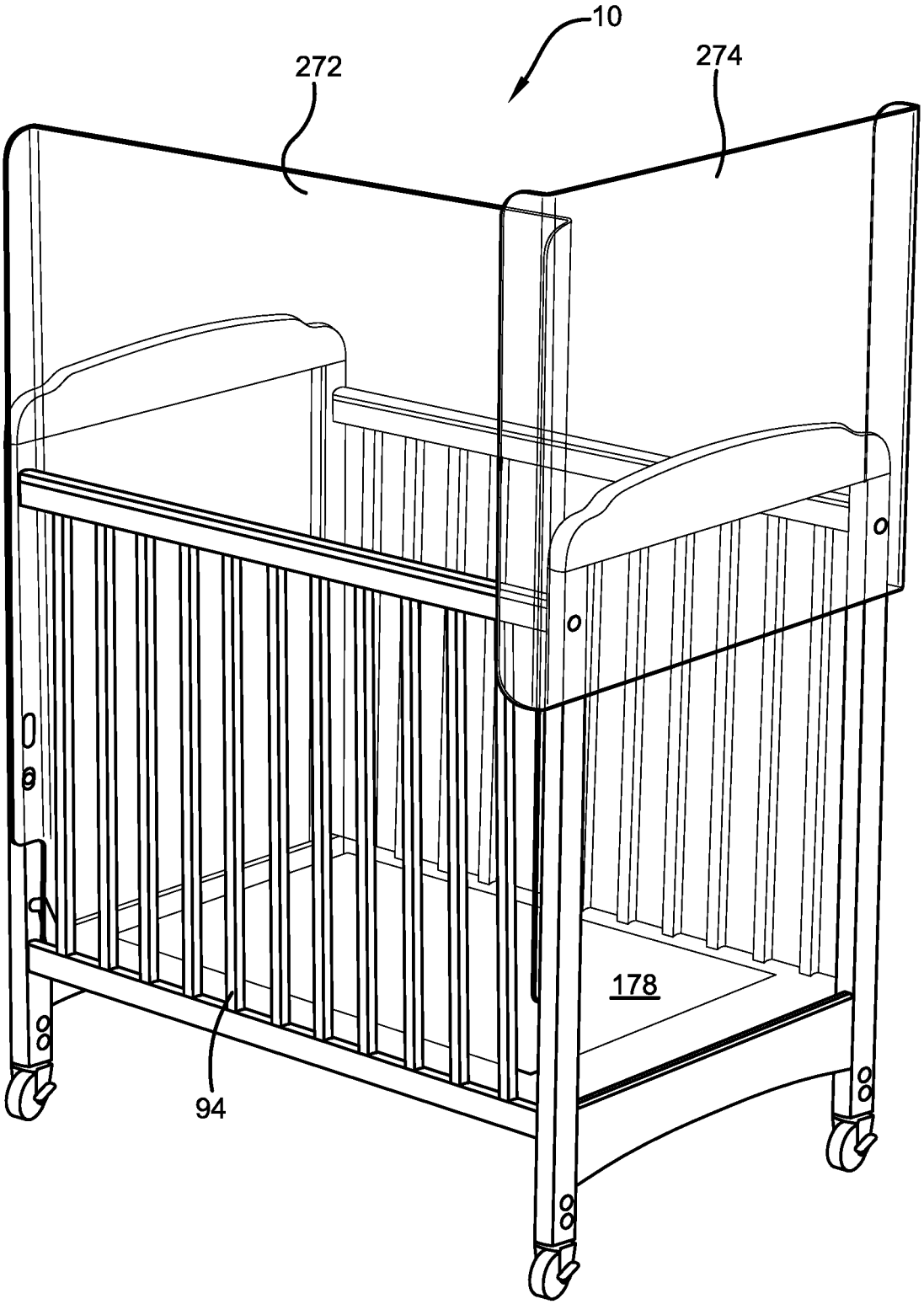
FIG. 23 is a further perspective view of the crib arrangement of FIG. 22.
Figure 24:
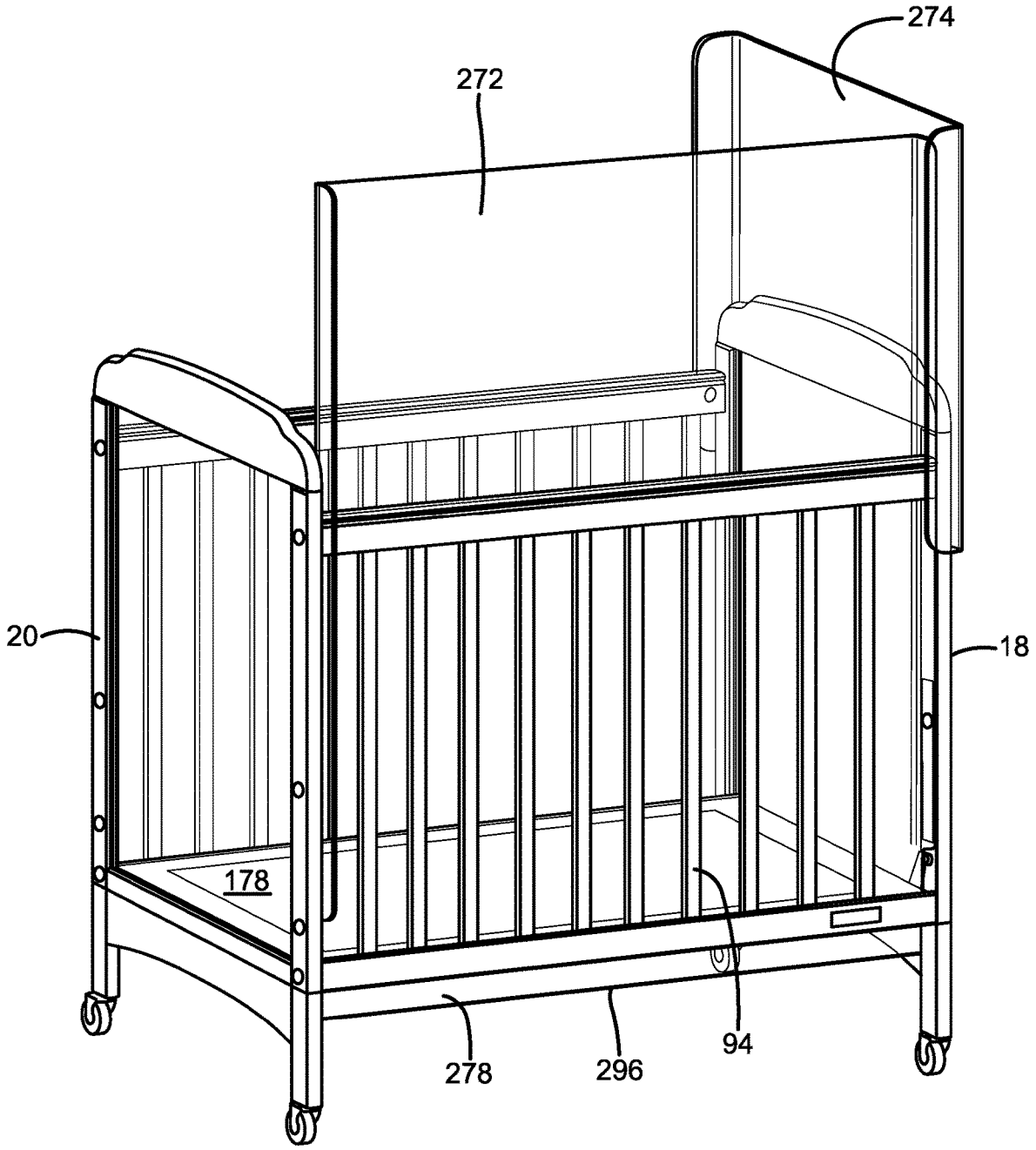
FIG. 24 is a further perspective view of the crib arrangement of FIG. 22.

Further as can be appreciated, in the operative condition of the crib arrangement each respective end panel side flange 328, 330 is horizontally disposed adjacent to, extends above and outwardly overlies the turned portion of the adjacent side panel. This is shown for example in FIGS. 17 and 23. As a result in some arrangements the turned portion of the adjacent side panel may be in interengaging relation with the immediately adjacent end panel side flange to provide additional support thereto. Such support may help to resist deformation and prevent breakage in the event that individuals lean against or otherwise apply force to the end panel side flange. Further in other exemplary arrangements, the end panel side flange may include a projection or recess that is releasably engageable with the other of a projection or recess of the side panel. Such interengaging projections and recesses which are in engagement in the operative condition of the crib arrangement may further help to position, resist deformation and provide support for the immediately adjacent turned portion of the side panel and the end panel side flange. Of course it should be understood that these approaches are exemplary and in other arrangements other approaches may be used.

In alternative exemplary arrangements, the end panel 274 may be further secured to the vertical members 26 and 28 through additional securing openings and fasteners positioned in the side flanges 328 and 330. For example, the flange 328 may include a securing opening adjacent the lower end 322 of the end panel 274, and the vertical member 28 may include a bore in an exterior face 354 thereof, that extends perpendicular to face 44. A further releasable fastener may extend through openings in the side flange 328 and into the bore in the exterior face 354 of the vertical member 28, to further secure the flange 328 to the vertical member 28, and to further secure the end panel 274 to the crib end wall 18. A similar arrangement may be for engaging the side flange 330 and an exterior face 356 of the vertical member 26 that extends perpendicular to face 40. Numerous arrangements may be used to further secure the end panel 274 to the end wall 18.

As can be appreciated, the exemplary end panel 274 may be secured to the crib end wall 18 through additional washers and fasteners, brackets, or other fastening methods that operatively engage the end panel 274 and the top crossbar 30 of the end wall 18. For example, the end panel may further include additional securing openings in the middle portion 336 of the end panel 274 and the top crossbar 30 may include bores in an exterior surface 358 thereof (not shown), the exterior surface disposed on an opposed side from the crib space 12 of the exemplary crib 10. Fasteners operatively equipped with, or in operative connection with additional resilient washers or similar force spreading structures may extend through the additional securing openings in the middle portion 336 and extend into the bores of the exterior surface 358 of the top cross bar 30 to further secure the end panel 274 to the end wall 18.

As can be further appreciated, the end panel 274 may be operatively secured to the crib end wall 18 through a similar securing method as shown and described for securing the side panel 272 to the crib sidewall 14. In addition, the side panel 272 may be secured to the crib sidewall 14 through a similar securing method as shown and described for securing the end panel 274 to the end wall 18. It should be understood that additional or different structures of the crib, end walls and crib sidewalls may be used to achieve the different methods of securing the end panel and the side panels to a respective end wall or sidewall. As can be further appreciated, the sidewall 16 may include a side panel 272 secured thereto in a similar manner as that used for securing the side panel 272 to sidewall 14. Still further, as shown in FIG. 17, the crib end wall 20 may include an end panel 274 secured thereto in a similar manner to that used to secure end panel 274 to end wall 18.

It can further be appreciated that combinations of the exemplary arrangements described herein may be used securing side panels and end panels 274 to crib walls 14, 16, 18, 20. For example, in alternative exemplary arrangements, a side panel 272 may be secured to crib sidewall 16, and an end panel 274 may be secured to crib end wall 20. A further example may include two end panels 274 without side panels 272, one operatively secured to end wall 18 and one operatively secured to end wall 20. A further example may include two side panels 272 without end panels 274, one operatively secured to crib sidewall 14 and one operatively secured to crib sidewall 16. Of course, it should be understood that these arrangements are merely exemplary, and in other arrangements, other approaches may be used to achieve combinations of side panels 272 and end panels 274 in operative connection with crib walls 14, 16, 18, and 20 of the exemplary crib 10.

Figure 25:
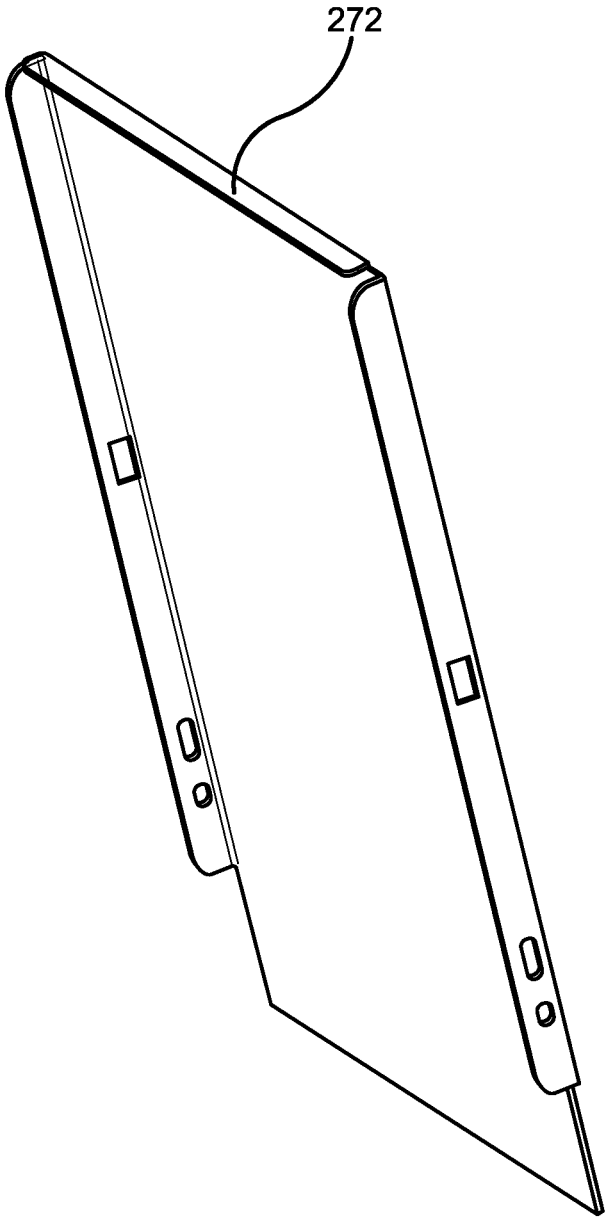
FIG. 25 is a perspective view of an exemplary side panel of the crib arrangement of FIG. 22.
Figure 26:
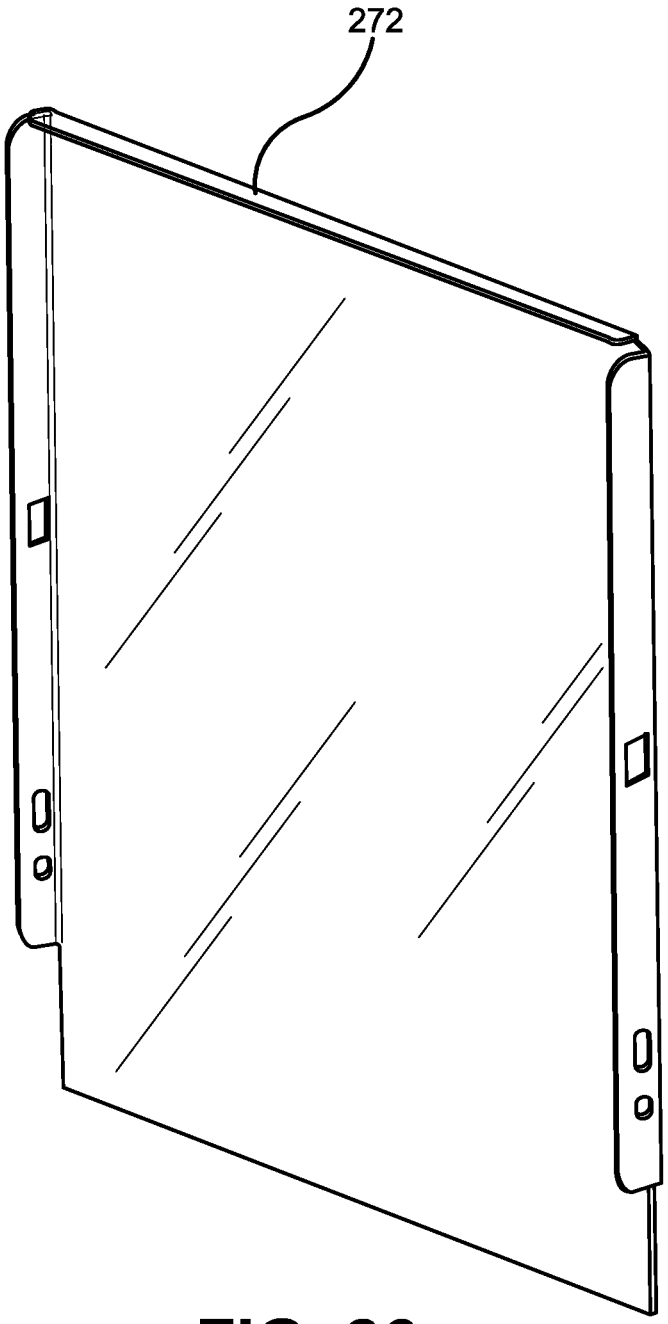
FIG. 26 is a further perspective view of the side panel of FIG. 25.
Figure 27:
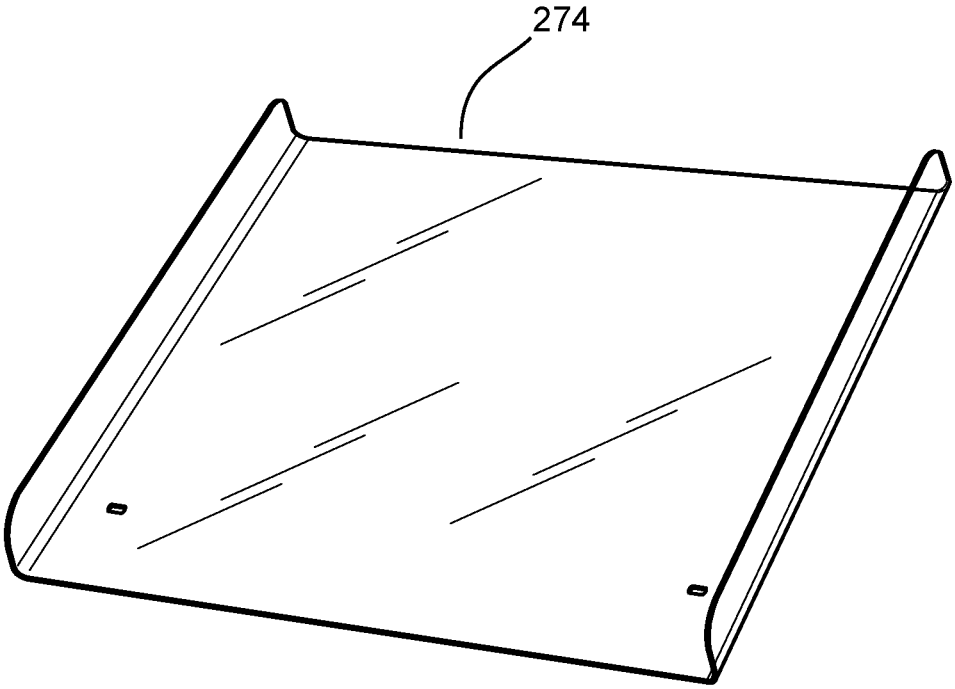
FIG. 27 is a perspective view of an exemplary end panel of the crib arrangement of FIG. 22.
Figure 28:
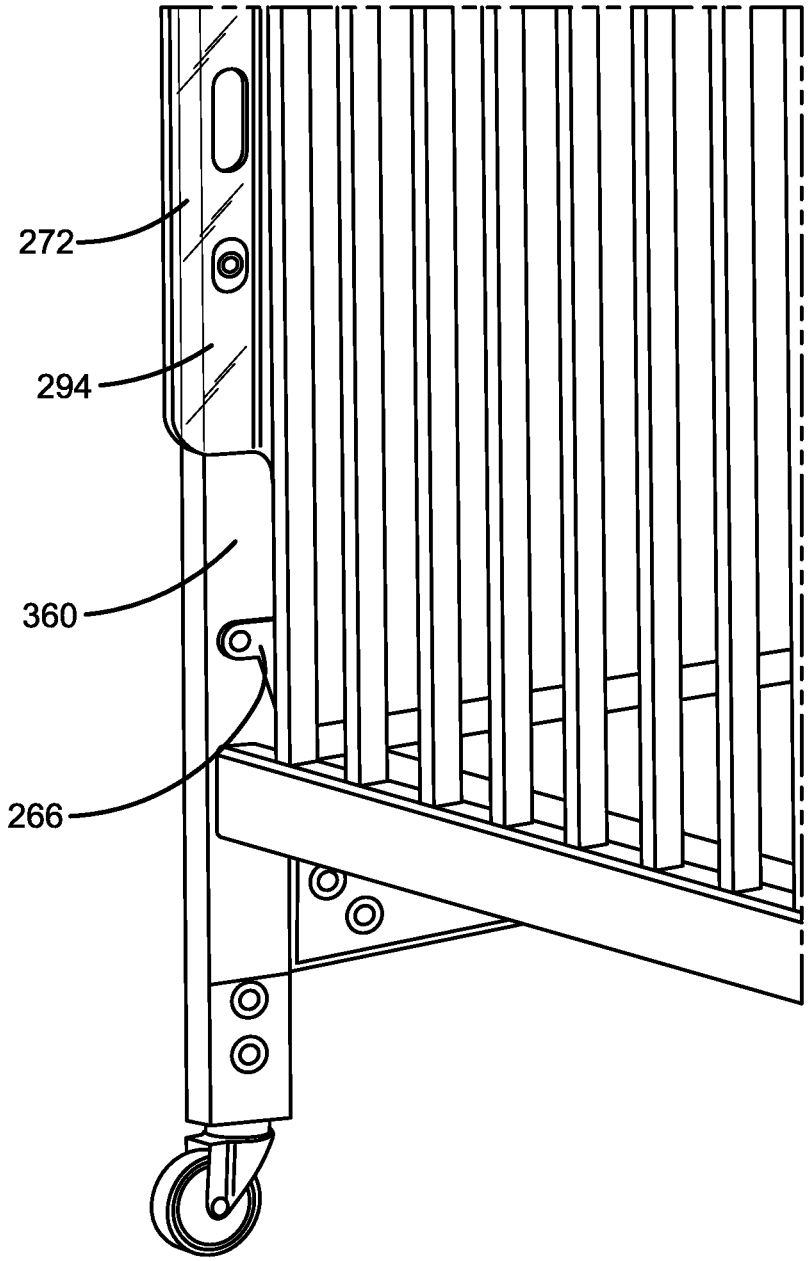
FIG. 28 is a perspective view of a sidewall of the crib arrangement showing an exemplary reinforcing member in operative connection with a vertical member of the crib and a recess in a turned portion of the side panel.
Figure 29:
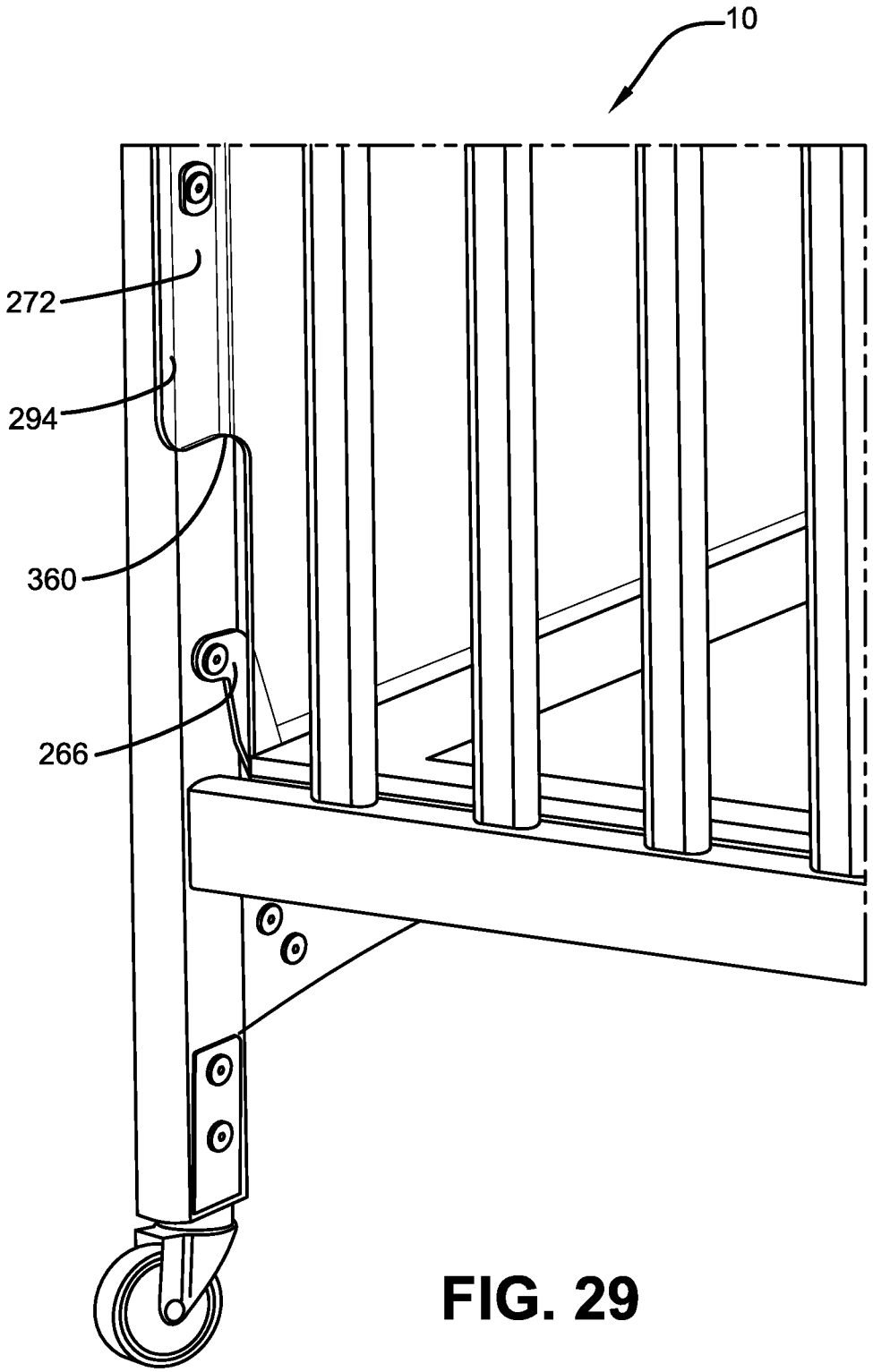
FIG. 29 is a partial perspective view of the crib reinforcing member in operative connection with the vertical member and the recess in a turned portion of the side panel.
Figure 30:
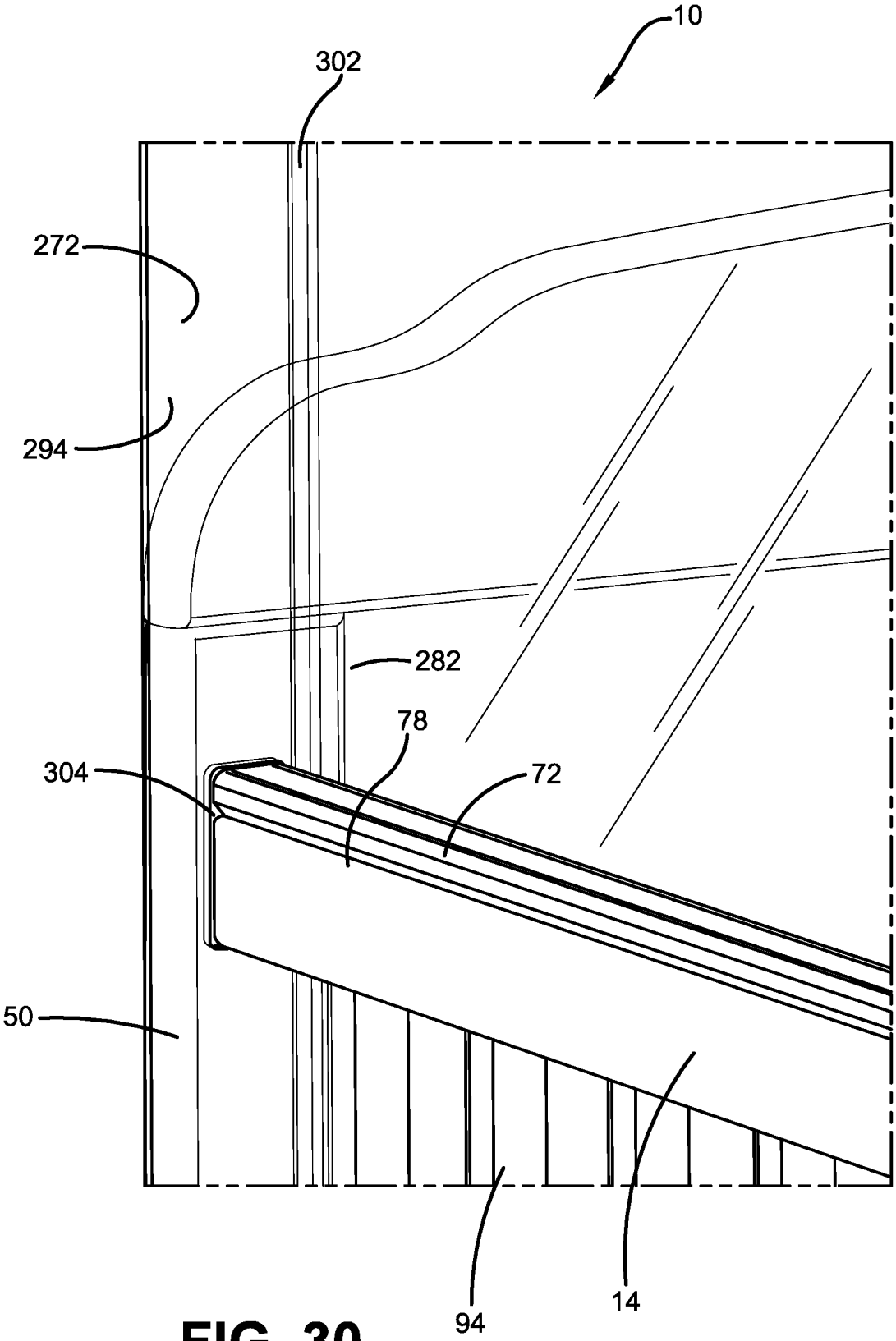
FIG. 30 is a partial perspective view of a sidewall of the crib of FIG. 22 showing a top rail in operative connection with a vertical member of the crib and extending through an aperture in a turned portion of a side panel.

Further exemplary arrangements of the exemplary crib 10 are shown in FIGS. 19-24. The exemplary side panels 272 and end panels 274 are shown in FIGS. 25-27. FIGS. 28 and 29 show alternative views of the exemplary recesses 360 of exemplary side panels 272. FIG. 30 shows an alternative view of the exemplary side panel 272 and the exemplary top rail 72 extending through an upper aperture 304 of the side panel 272.

It should be understood that the exemplary side panels 272 and exemplary end panels 274 may be manufactured on a custom basis such that a crib arrangement may be retrofitted with the exemplary side panels 272 and end panels 274. For example, the height, width, and length of the panels 272 and 274 may be configured to be operatively fixed with structures of an existing crib arrangement. Further, the exemplary flanges and securing openings may be arranged in a custom manner on the exemplary panels 272 and 274 to be operatively fixed with structures of an existing crib configuration.

Further, the exemplary panels 272 and 274 may have antibacterial properties. This may be done by applying antibacterial coatings, including antibacterial materials, and/or through the use of other methods, that reduce the presence of bacteria and other microorganisms. For example, the exemplary panels 272 and 274 may be comprised of clear plastic or other material, with a sufficient quantity of silver or copper compounds included within or on surfaces thereof operative to kill most microorganisms present on the surfaces of the exemplary panels 272 and 274. Further, the inner and outer surfaces of the exemplary panels 272 and 274 may include a texture surface property applied via laser treatment or other application method which is operative to decrease the ability of bacteria and other microorganisms to adhere to such surfaces. Still further, the exemplary panels 272 and 274 may be configured to facilitate quick removal from the other exemplary crib structures. This may enable the use of high heat resistant material for the exemplary panels 272 and 274, so that such panels may be removed for sterilization with a suitable heat cleaning device. Still further, the exemplary panels 272 and 274 may include or be in operative connection suitable structures, circuits, emitting devices, and power supplies to radiate UV light or other sufficient wavelengths of light such that bacteria, viruses, fungi and other similar microorganisms present on the surfaces of the exemplary panels are killed. However, it should be understood that other methods of decreasing or killing viruses, bacteria and other microorganisms present on the surfaces of the exemplary panels 272 and 274 may be used in exemplary arrangements. Further, it should also be understood that such methods of decreasing or killing such contaminants may be applied to other structures which comprise the exemplary crib arrangement 10 including the structures of the walls 14, 16, 18, and 20 as well as the bottom panel 22 in order to decrease or kill viruses, bacteria, fungi and other microorganisms present thereon.

As can be appreciated exemplary crib arrangements may include a side panel 272 positioned adjacent to one of the crib sidewalls. The side panel extends upward to a top portion which may in some arrangements include a flange portion of the type previously discussed. The top of the side panel extends above the top rail of the crib sidewall immediately adjacent to the side panel. Further the exemplary crib arrangement may include at least one end panel adjacent to a crib end wall. The end panel top of the end panel extends at least as high as the top of the side panel. For example as shown in FIG. 17 the end panel top 321 extends somewhat vertically higher than the top of the side panel 272. In exemplary arrangements this helps to prevent airborne containments such as virus droplets or other contaminants from reaching the crib space and provides resistance against deformation.

Further in other arrangements the crib may include a single side panel and a pair of end panels, one disposed adjacent to each crib end wall. Such arrangements may provide for one crib sidewall which does not include a side panel extending above the top rail. This may facilitate accessing the crib space for purposes of providing items to or taking items from the baby or child positioned in the crib space. Leaving one crib sidewall without a side panel that extends above it may also make it easier to place the child in or to remove the child from the crib space. Of course as previously discussed, in other arrangements all of the crib sidewalls may include guard barrier panels. This may further help to prevent the introduction of contaminants or other items into the crib space. Further as previously discussed such panels may be held engaged with the crib by releasable fasteners such that they can be readily removed as necessary for accessing the crib space and for cleaning.

Further as shown in FIG. 17 and other figures herein, in some crib arrangements it may be desirable to provide air circulation to and from the crib space. For example in the exemplary arrangement shown in FIG. 17 the crib end wall is comprised of slats which are air permeable. The end panel 274 is comprised of non-air permeable material such as a transparent clear plastic. The end panel bottom 323 of the end panel 274 is positioned above the bottom panel top surface of the bottom panel. As a result the crib end wall is air permeable intermediate of the bottom panel top surface and the end panel bottom 323. This arrangement may facilitate airflow to and from the crib space below the end panel. Of course it should be understood that this approach is exemplary and in other arrangements other approach is may be used.

Further exemplary arrangements of the crib 10 are shown in FIGS. 31-36. In the alternative exemplary arrangement shown in FIG. 31, a transparent sidewall panel 362 is included on the crib sidewall 14. The exemplary transparent panel 362 is similar to transparent panel 192 and is comprised of the transparent clear plastic or similar materials to those used for the side panels and end panels previously described herein. Further, the exemplary transparent sidewall panel 362 may include the antibacterial properties and other features previously described herein.

The exemplary sidewall panel 362 differs from sidewall panel 192 only in that the sidewall panel 362 includes or is in operative connection with a center support member 364. The exemplary center support member 364 extends vertically between the bottom surface 206 of top rail 72 of crib sidewall 14 and top surface 210 of bottom rail 74 of crib sidewall 14. The exemplary center support member 364 may be in releasable or fixed operative connection with the bottom surface 206 and the top surface 210 through suitable connection means including notches and projections in either of the rails or center support member, interlocking edges, clips, adhesives, fasteners, brackets, or alternatively the support members may be integrally formed with the top and bottom rails. As can be appreciated, in exemplary arrangements, sidewall 16 includes a similar center support member 364 arranged with respect to the supporting structures of sidewall 16 in a similar manner as the transparent sidewall panel 362 of sidewall 14. Of course these arrangements are exemplary, and in other arrangements other approaches may be used.

The exemplary center support member 364 is comprised of a material that is suitable to provide sufficient support to its surrounding and connected structures. For example, the center support 364 may be comprised of polymers, composites, wood, metal, metal alloys, plastic, or any other suitable material.

Figure 32A:
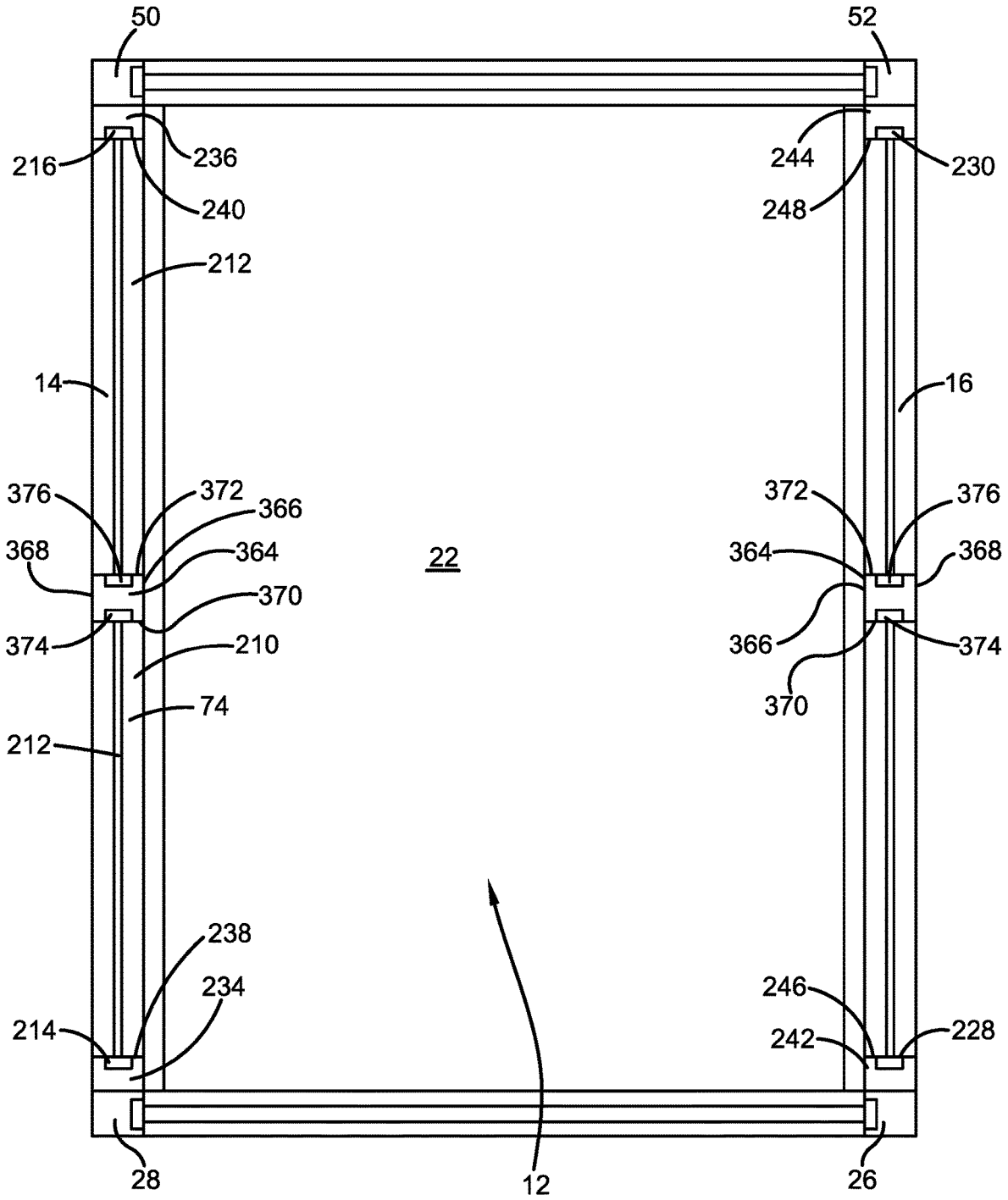
FIG. 32A is a top plan view of a bottom panel of the crib of FIG. 31 and adjacent structures including exemplary slots extending in top surfaces of the bottom rails of the sidewalls, exemplary vertically extending slots in the support members of the sidewalls, and slots extending in the center support members of the sidewalls.
Figure 32B:
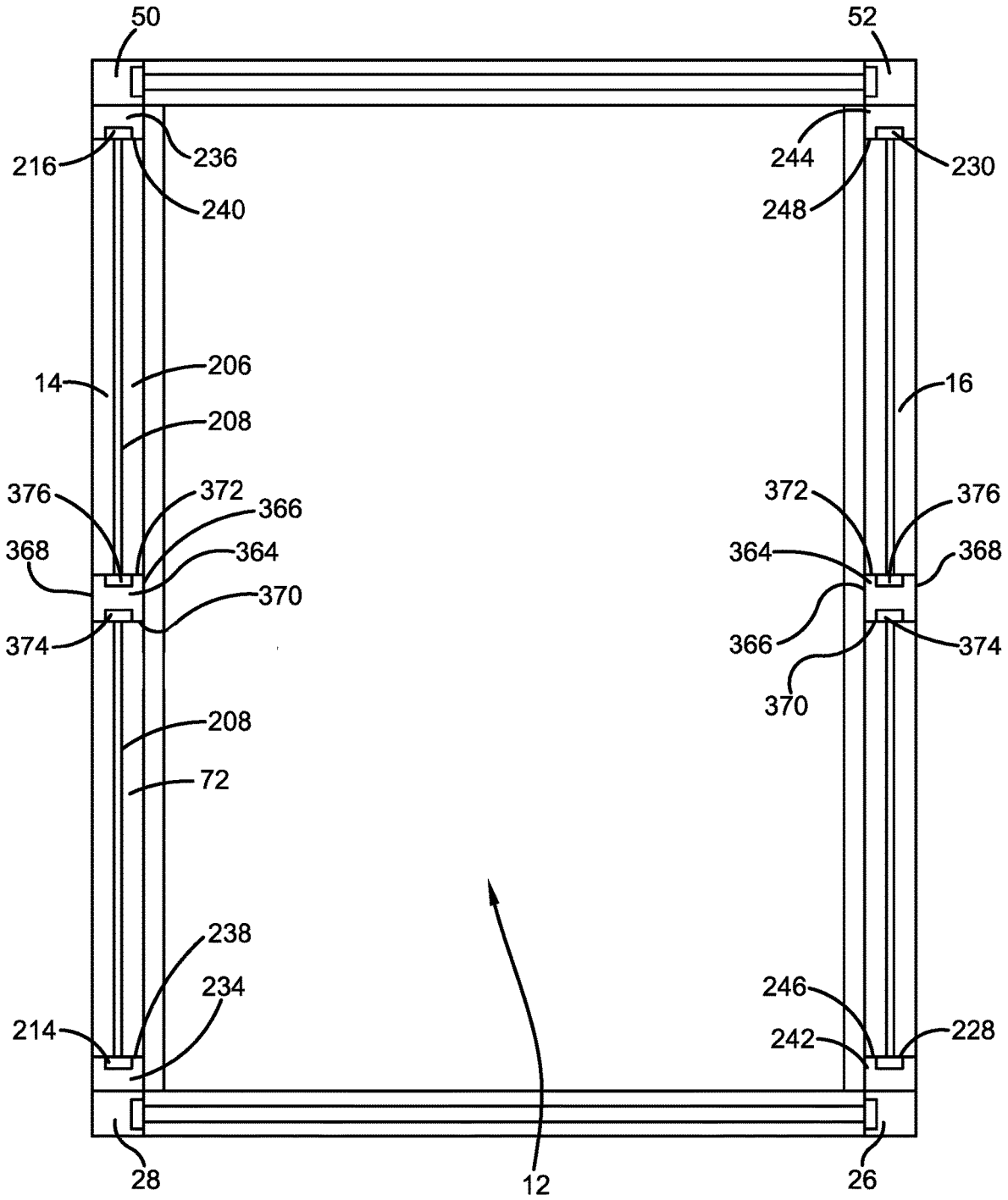
FIG. 32B is a bottom plan view of an upper area of the crib of FIG. 31 including slots extending in the bottom surfaces of top rails of the sidewalls, vertically extending slots in the support members of the sidewalls, and slots extending in the center support members of the sidewalls.

As shown in FIGS. 32A and 32B, the exemplary center support 364 of crib sidewall 14 includes an inner face 366 and an outer face 368. Inner face 366 is directed toward the crib space 12 and the outer face 368 is directed away from the crib space 12. The exemplary center support 364 further includes disposed faces 370 and 372. The face 370 is directed toward the support member 234 and the vertical member 28. The face 372 is directed toward the support member 236 and the vertical member 50. The exemplary face 370 includes a slot 374 that vertically extends between the bottom rail 74 and the top rail 72. The exemplary face 372 includes a slot 376 that vertically extends between the bottom rail 74 and the top rail 72. It should be understood that in exemplary arrangements, the exemplary center support member 364 of sidewall 16 includes a similar structure to the center support 364 described in relation to sidewall 14. It should further be understood that these are merely examples of center supports, and in other arrangements, other configurations may be used.

Figure 33A:
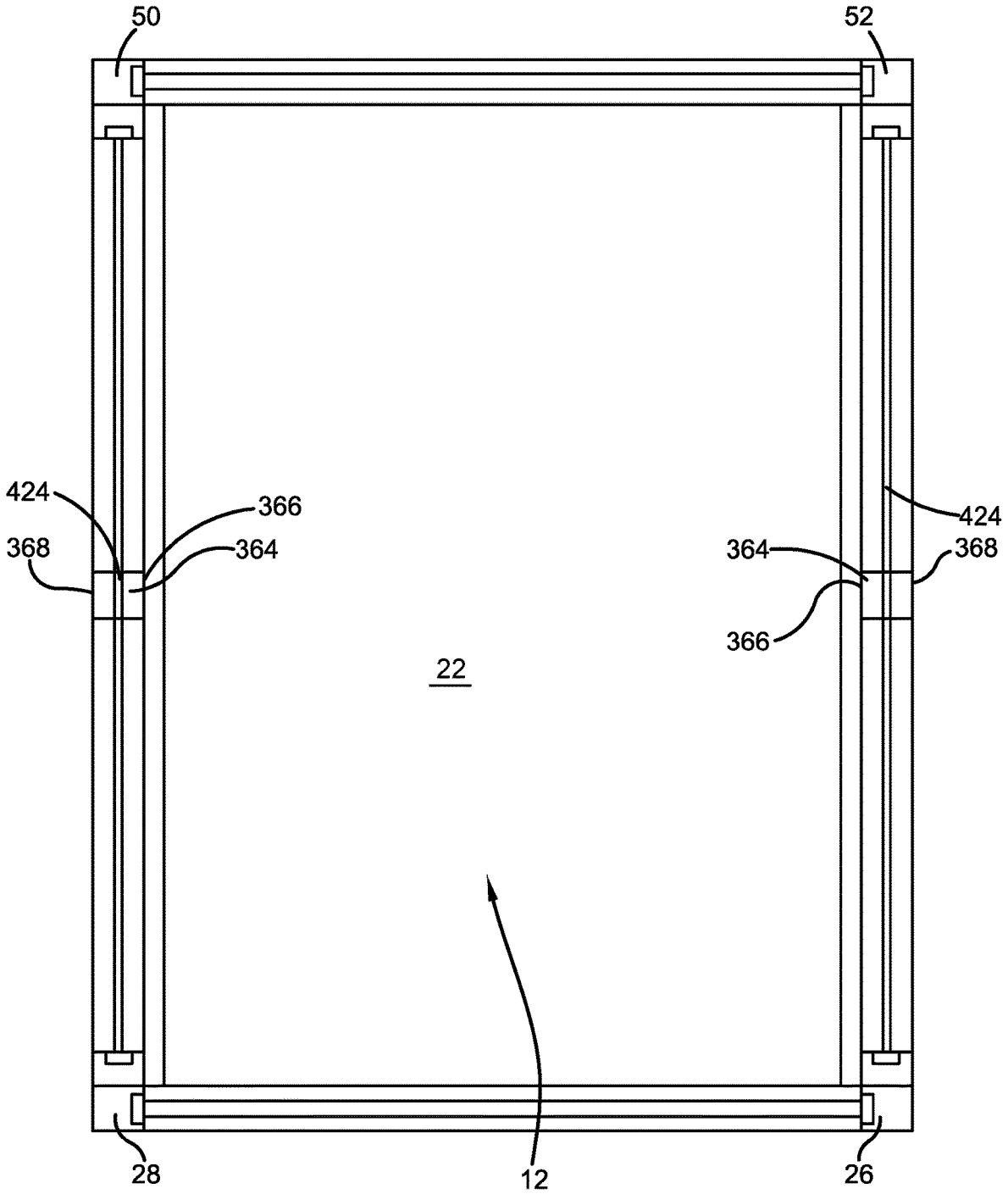
FIG. 33A is a further top plan view of the bottom panel and adjacent structures of the crib arrangement of FIG. 31 and exemplary channels extending through the center support members of the sidewalls.
Figure 33B:
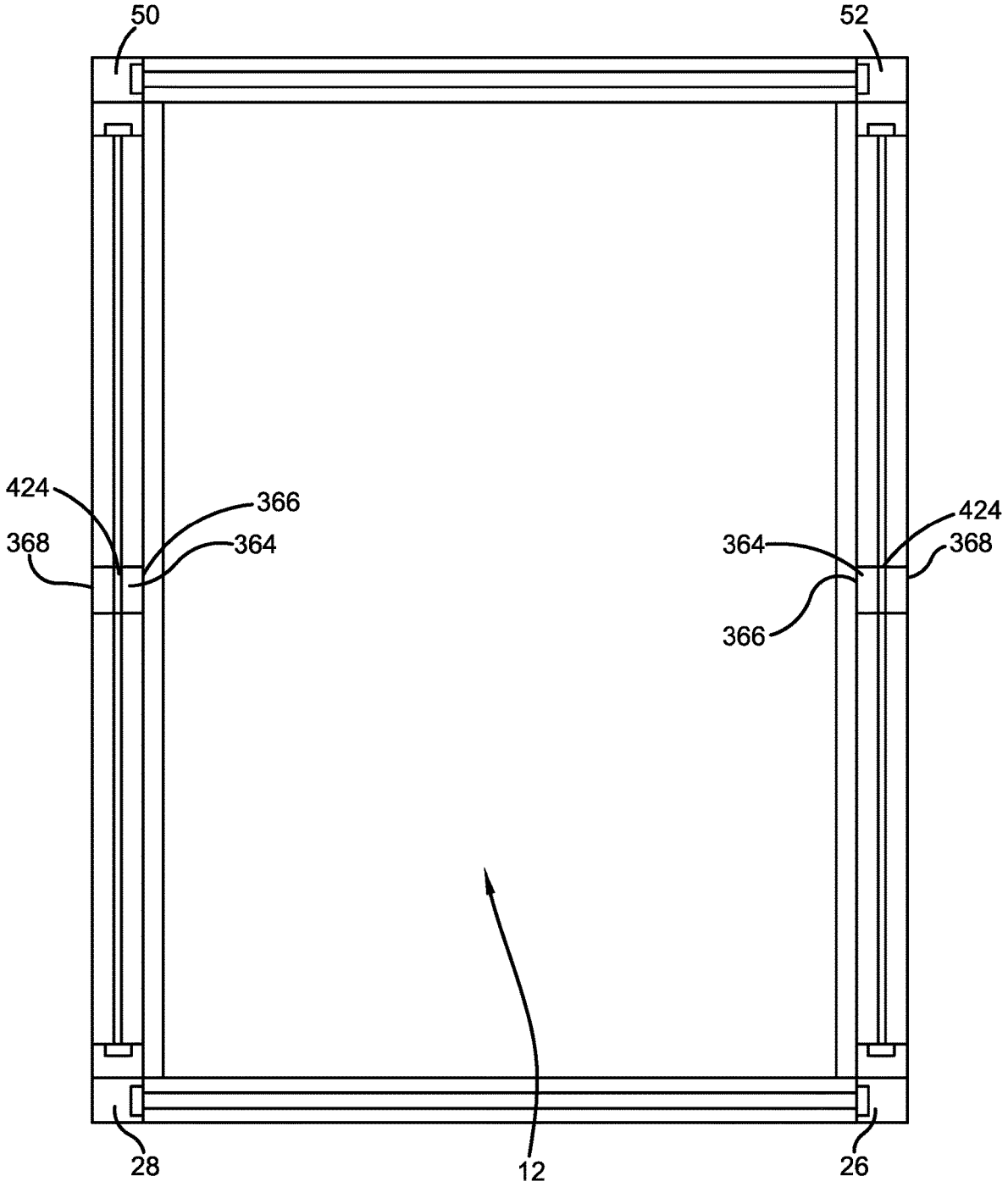
FIG. 33B is a further bottom plan view of the upper area of the crib arrangement of FIG. 31 including channels extending in the center support members of the sidewalls.

In an alternative exemplary arrangement, as shown in FIGS. 33A and 33B, the exemplary center support 364 may include a channel 424 that extends transversely through the center support 364 from the face 370 of the center support to the face 372 of the center support. In such arrangements, as later described, the transparent sidewall panel 362 extends along the respective sidewall from one vertical member or support member, through the center support 364, and to the other vertical member or support member of the respective sidewall.

Figure 34:
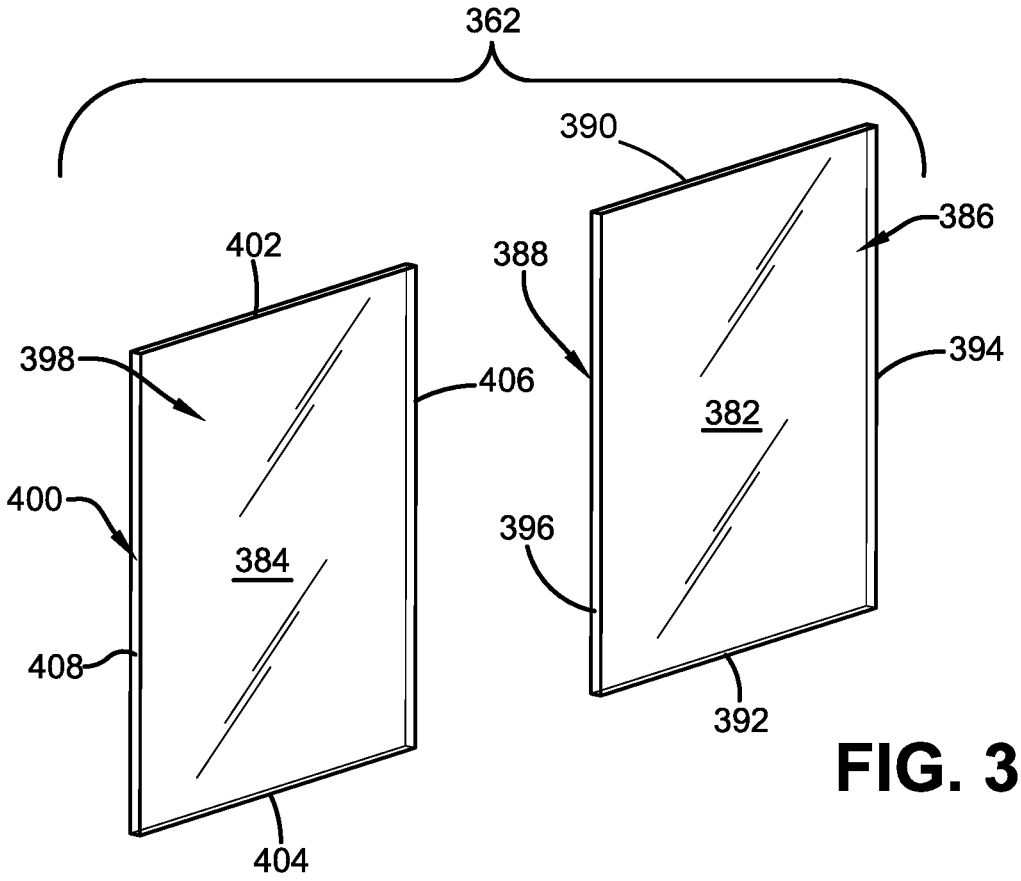
FIG. 34 is a perspective view of exemplary transparent sidewall panels of the crib arrangement of FIG. 31.

In some exemplary arrangements, as shown in FIG. 34, the exemplary sidewall panel 362 is comprised of two panels 382 and 384. The exemplary panel 382 includes an inner surface 386 that bounds the crib space 12 and an outer surface 388 that is directed away from the crib space 12. The panel 382 further includes a top perimeter edge 390, a bottom perimeter edge 392, and side perimeter edges 394 and 396 that extend vertically between the perimeter edges 390 and 392.

The exemplary panel 384 includes an inner surface 398 that bounds the crib space 12 and an outer surface 400 that is directed facing away from the crib space 12. The panel 384 further includes a top perimeter edge 402, a bottom perimeter edge 404, and side perimeter edges 406 and 408 that extend vertically between the perimeter edges 402 and 404. However, these are merely examples of a transparent sidewall panel 362, and in other arrangements, other configurations may be used.

Figure 35:
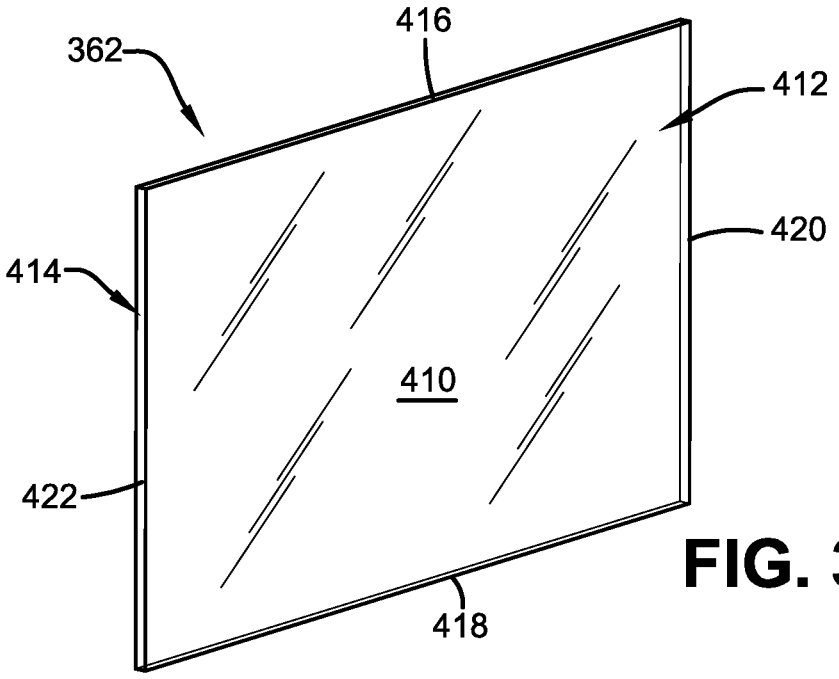
FIG. 35 is a perspective view of an exemplary transparent sidewall panel comprised of a single panel such as is used in the crib arrangement of FIG. 19.

In alternative exemplary arrangements, as shown in FIG. 35, an exemplary transparent sidewall panel may be comprised of one single panel 410. The exemplary single panel 410 includes an inner surface 412 that bounds the crib space 12 and an outer surface 414 that is directed away from the crib space 12. The single panel 410 further includes a top perimeter edge 416, a bottom perimeter edge 418, and side perimeter edges 420 and 422 that vertically extend between the perimeter edges 416 and 418.

Figure 31:
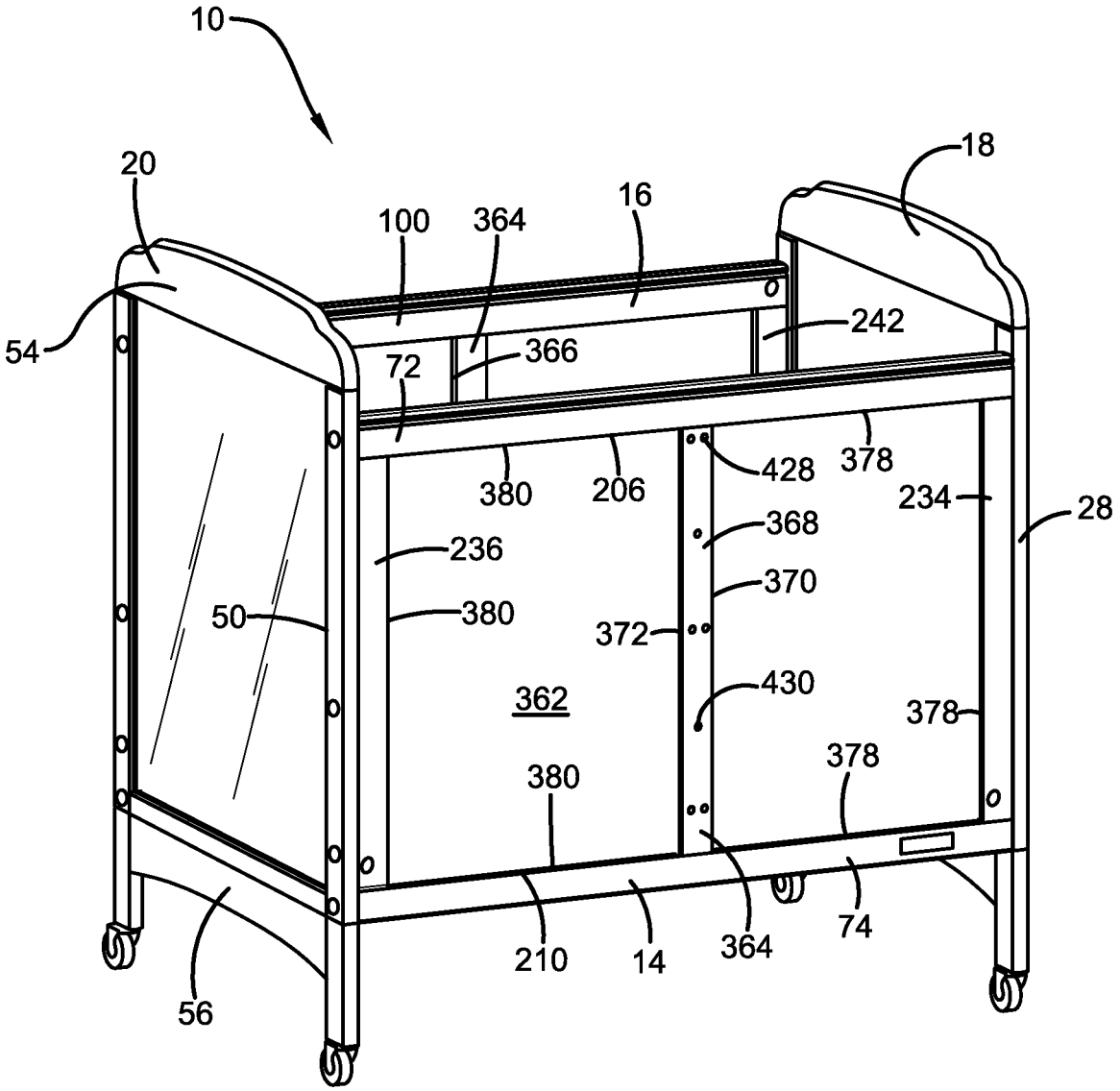
FIG. 31 is a perspective view of a further exemplary crib arrangement including a sidewall center support member.

In exemplary arrangements including the exemplary transparent sidewall panel 362 comprised of the panels 382 and 384, as shown in FIG. 31, the exemplary slot 374 of face 370 of center support 364, the slot 212 of the top surface 210 of bottom rail 74, the slot 208 in the bottom surface 206 of the top rail 72, and the slot 214 of the inner face 238 of support member 234 are in aligned relation such that they form a continuous rectangular slot 378. Additionally, the slot 376 of face 372 of center support 364, the slot 212 of top surface 210 of bottom rail 74, the slot 208 of the bottom surface 206 of top rail 72, and the slot 216 of inner face 240 of support member 236 are also in aligned relation such that they form a continuous rectangular slot 380.

As can be appreciated, the perimeter edges 390, 392, 394, and 396 of the panel 382 extend in respective panels of the continuous rectangular slot 378. Additionally, the perimeter edges 402, 404, 406, and 408 of the panel 384 extend in respective panels of the continuous rectangular slot 380. As also can be appreciated, in exemplary arrangements, a similar arrangement of the panels 382 and 384 is included on the sidewall 16 such that the perimeter edges of the panels 382 and 384 extend in continuous rectangular slots formed by the structures of the sidewall 16 in the same manner as described in relation to the sidewall 14. Of course, these arrangements are exemplary, and other configurations may be used.

Figure 36:
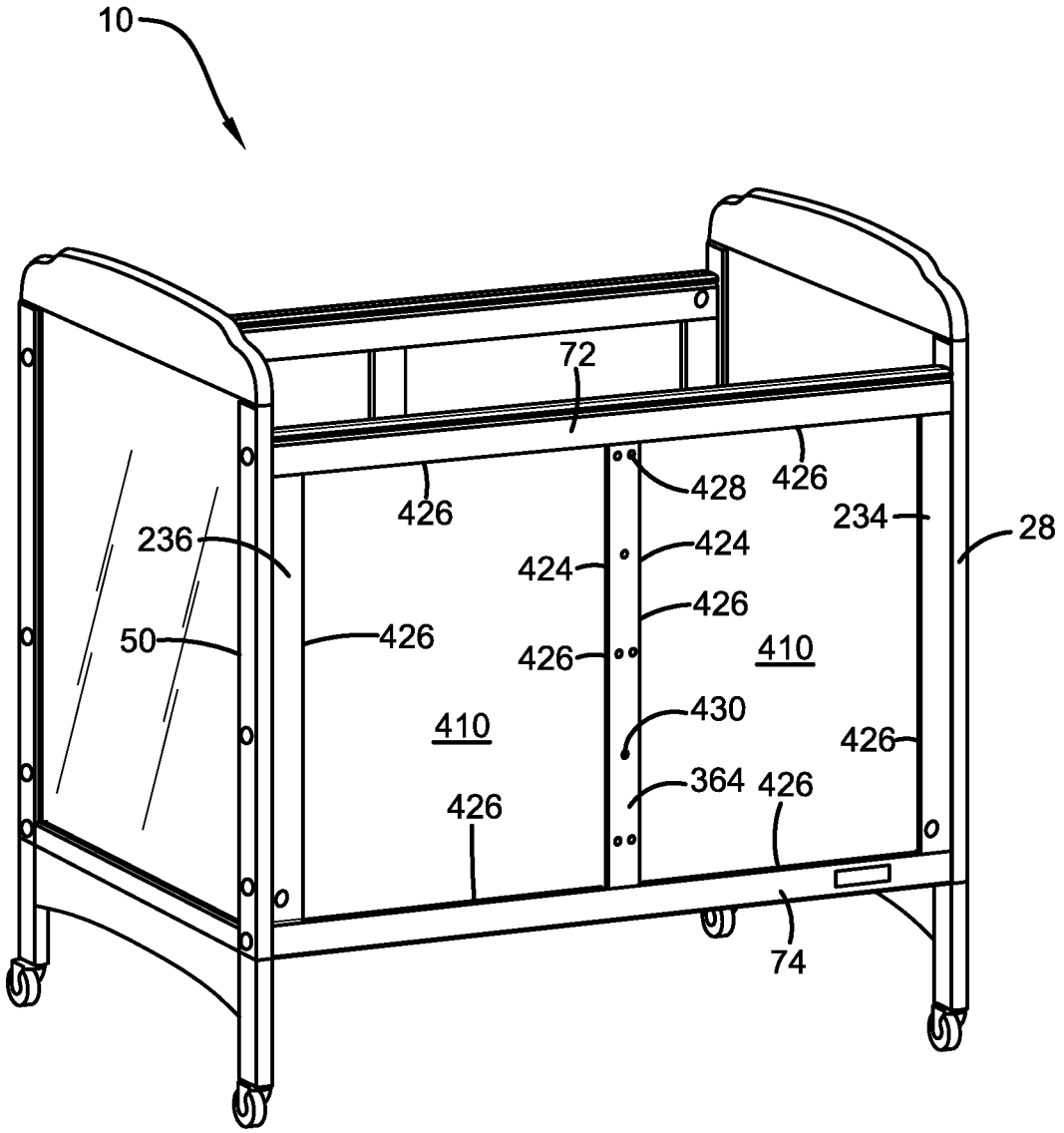
FIG. 36 is a perspective view of an exemplary crib arrangement similar to that in FIG. 31 including a center sidewall support member and a pair of transparent sidewall panels.
Figure 37:
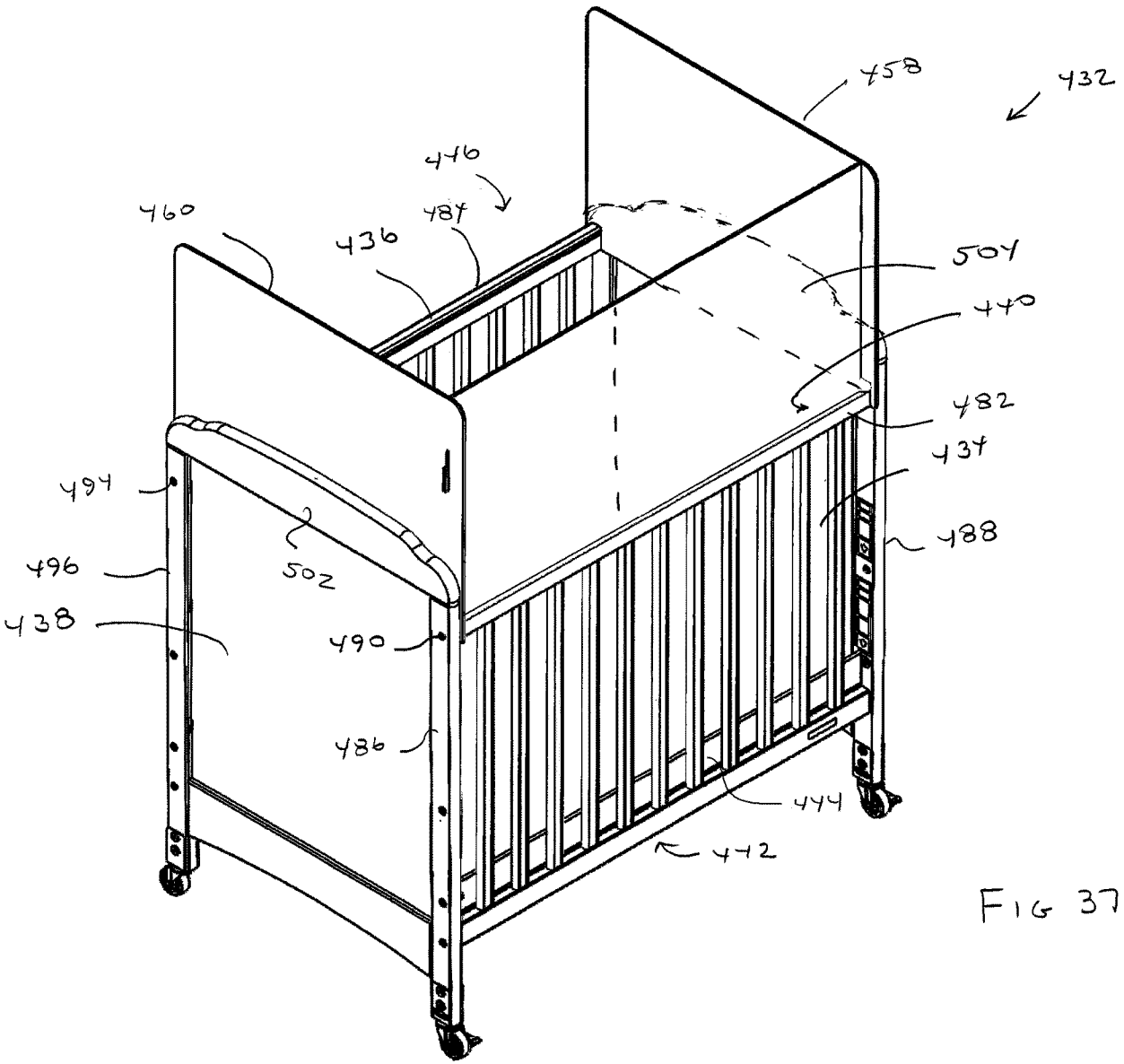
FIG. 37 is a back top perspective view of an alternative crib arrangement.
Figure 38:
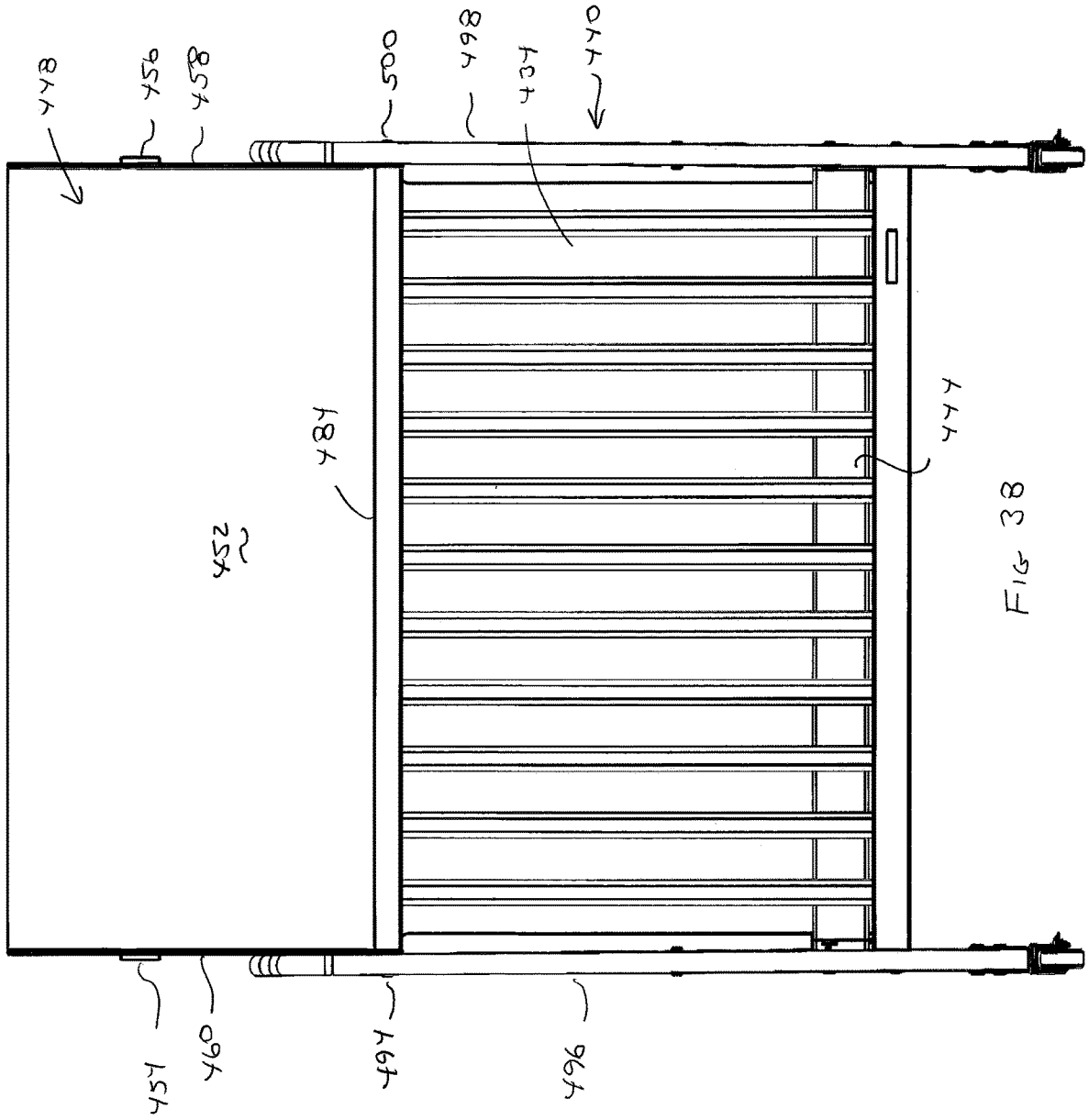
FIG. 38 is a back view of the alternative crib arrangement of FIG. 37.
Figure 39:
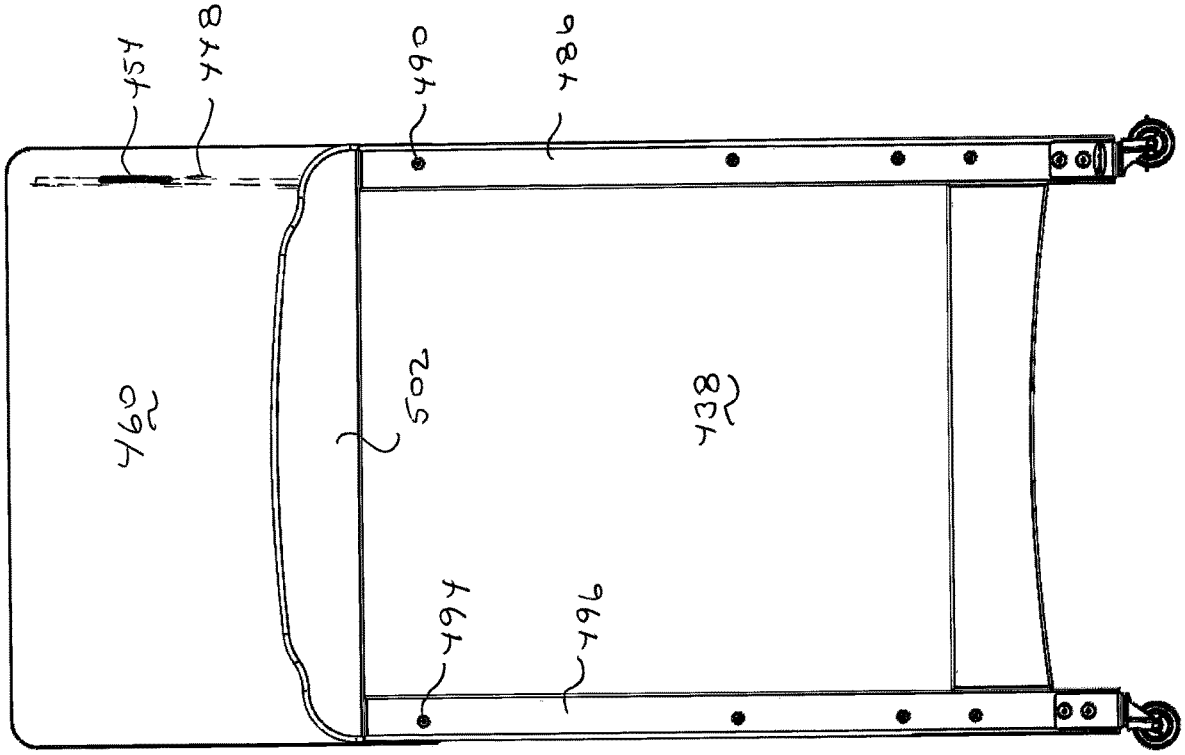
FIG. 39 is a side view of the alternative crib arrangement.
Figure 40:
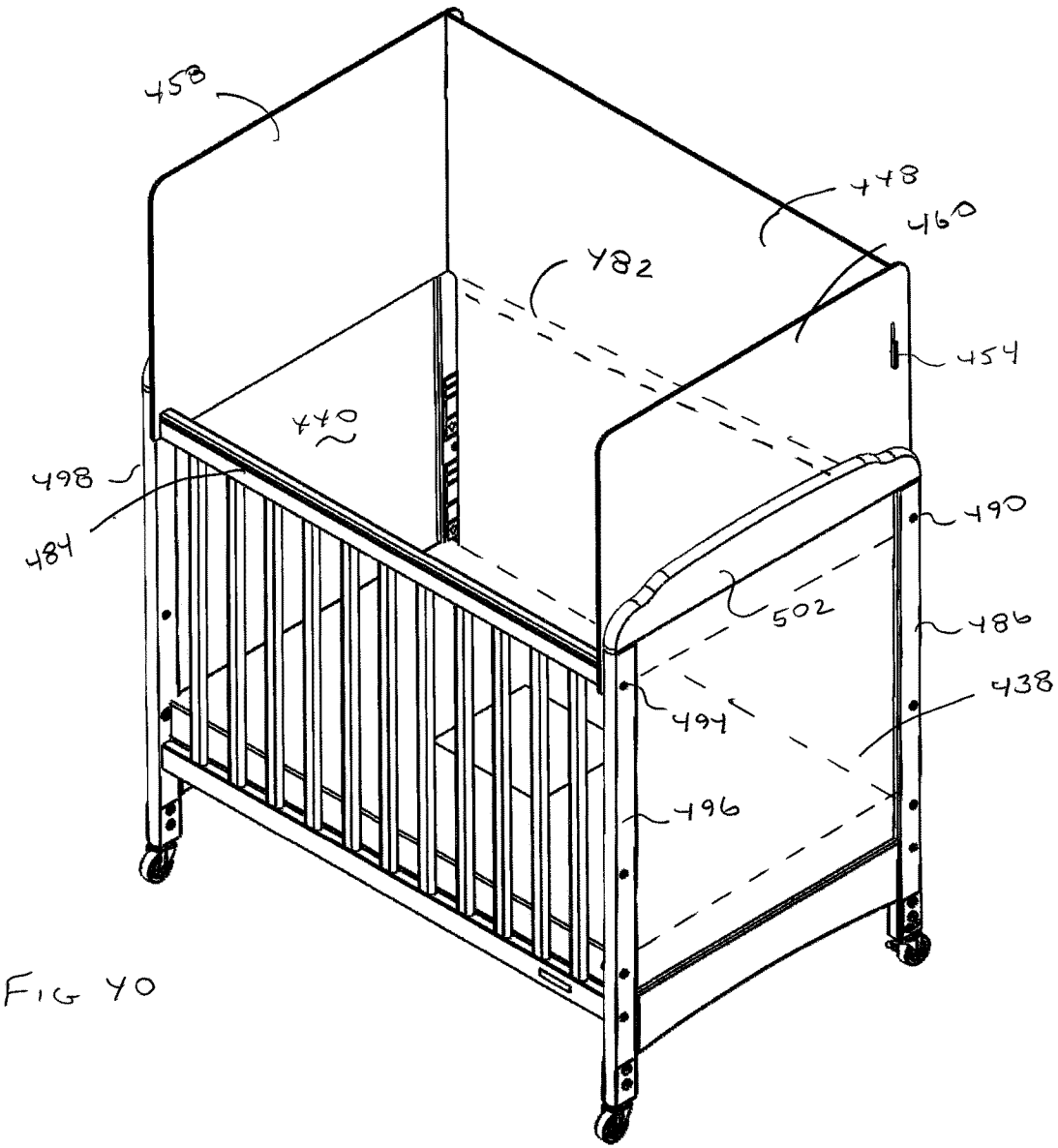
FIG. 40 is a front top perspective view of the alternative crib arrangement.
Figure 41:
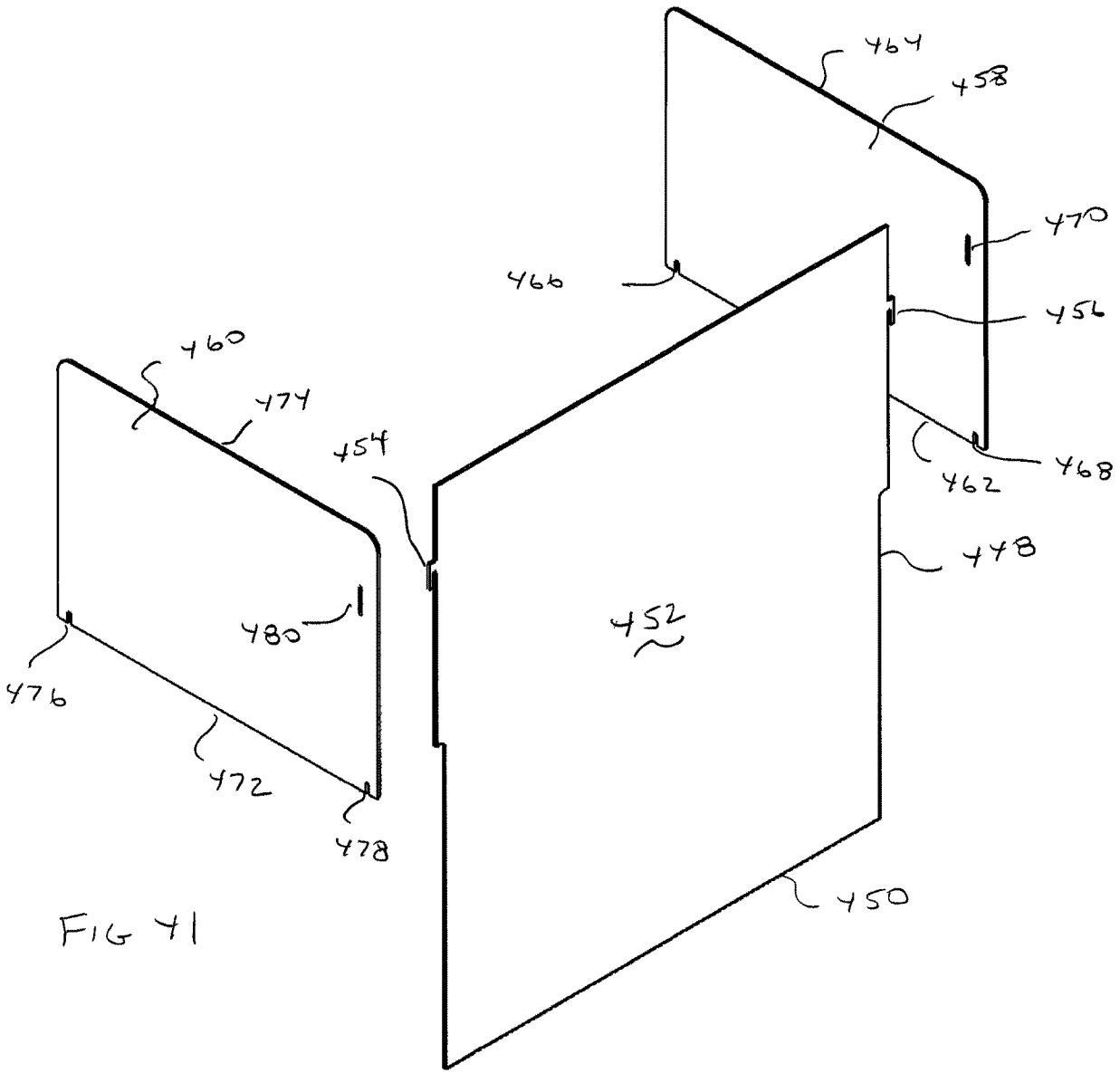
FIG. 41 is a back exploded view of the exemplary side panel and end panels of the alternative crib arrangement of FIG. 37.
Figure 42:
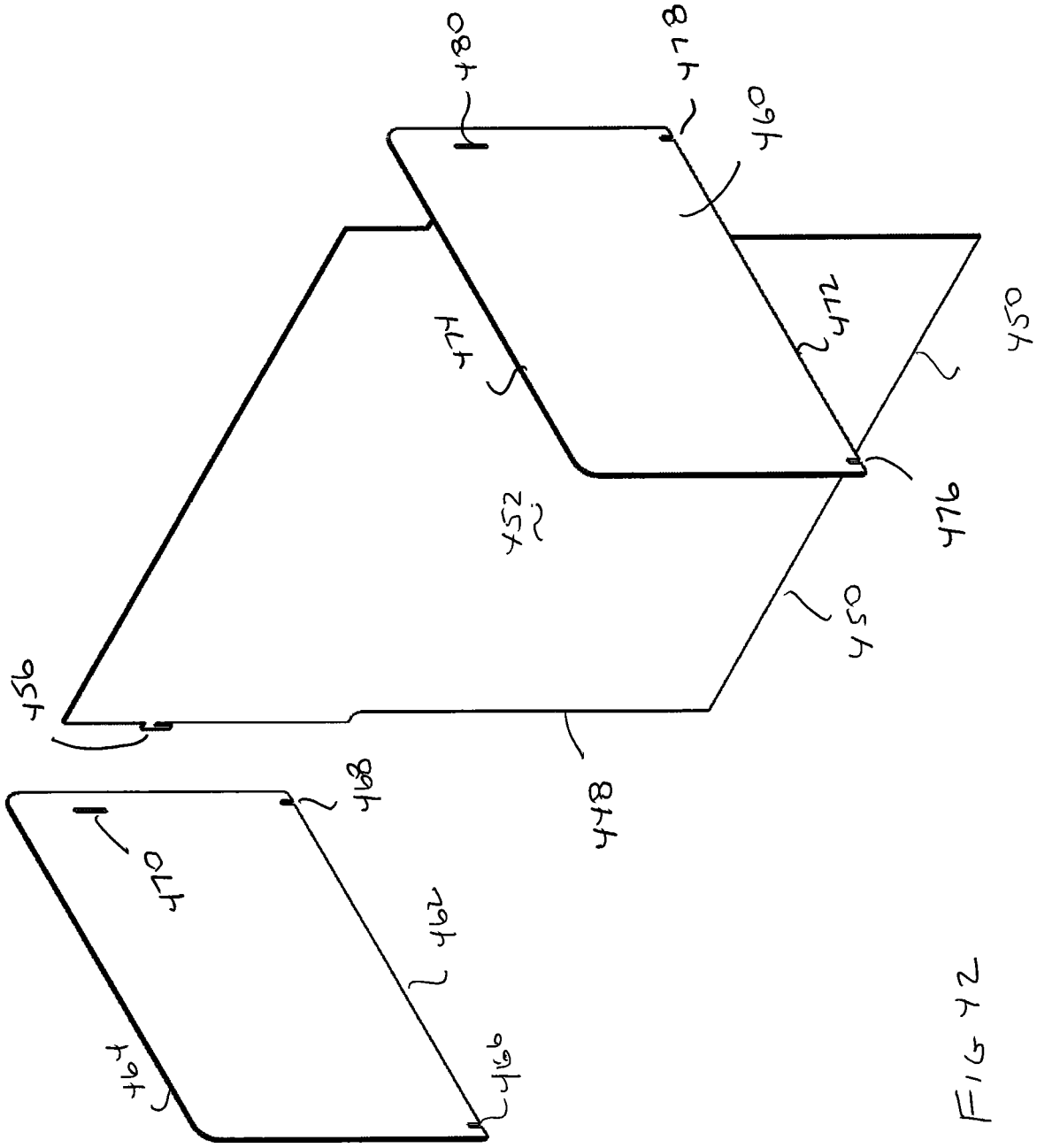
FIG. 42 is a front exploded view of the exemplary side panel and end panels of the alternative crib arrangement of FIG. 37.
Figure 43:
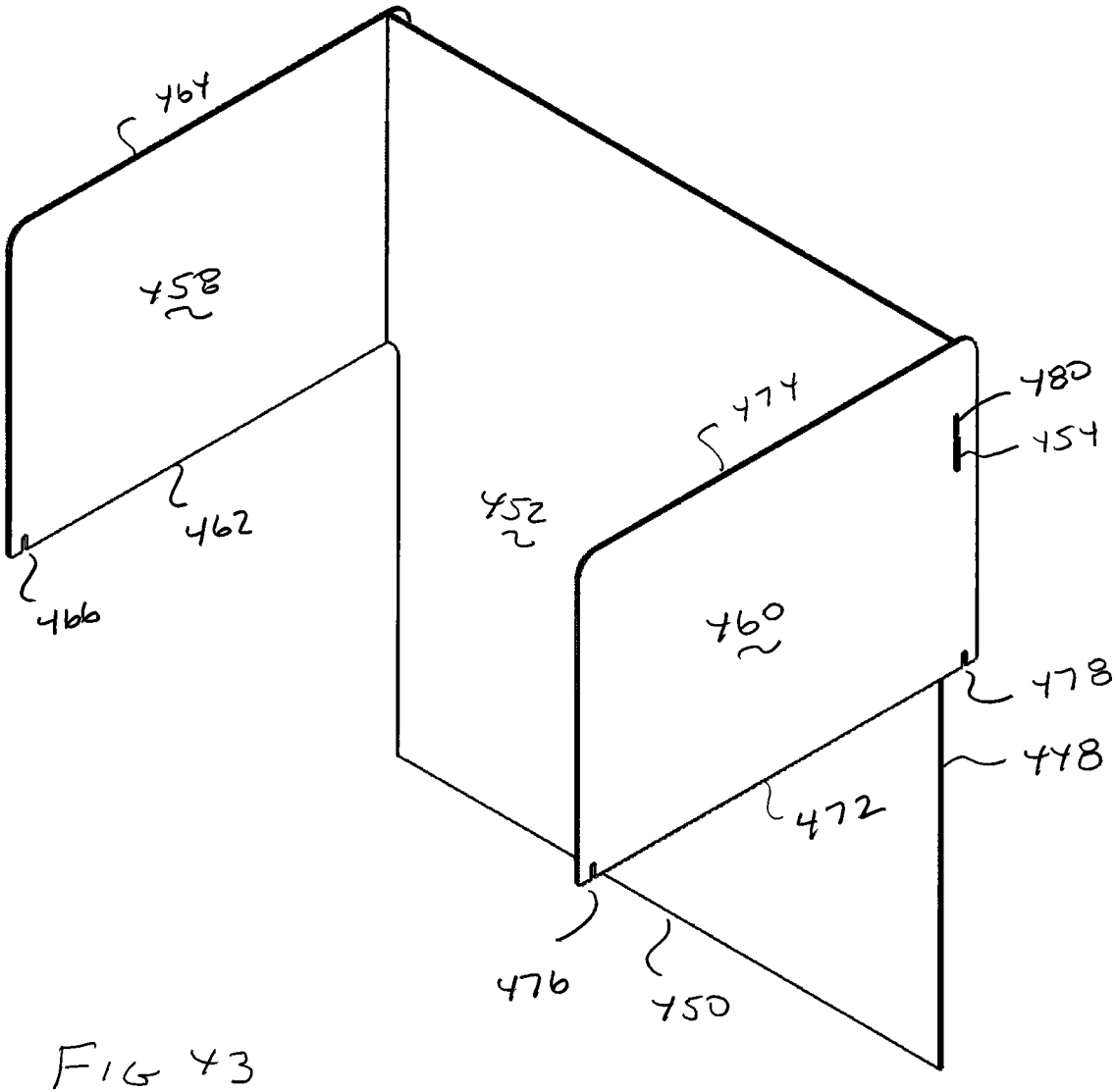
FIG. 43 is a front perspective view of the panels shown in FIG. 42 in an assembled condition.

Referring now to FIG. 36, in exemplary arrangements including the exemplary transparent sidewall panel 362 comprised of the single panel 410 and the exemplary center support 364 including the channel 424, the single panel 410 extends continuously transversely across the entire respective sidewall 14 or 16 from one respective support member or vertical member, through the channel 424 of the center support member, and to the opposing vertical member or support member. In such exemplary arrangements, the perimeter edges 416, 418, 420, and 422 of the single panel 410 extend in respective panels of a continuous rectangular slot 426. The exemplary continuous rectangular slot 426 is comprised of the respective slots in the bottom and top rails and the respective support members or vertical members, similar to the continuous rectangular slots 378 and 380. As can be appreciated, the exemplary single panel 410 extends transversely through the channel 424 of the center support 364 intermediate of the top rail 72 and the bottom rail 74. Of course, this arrangement is merely exemplary, and in other arrangements, other approaches may be used.

In exemplary arrangements, the exemplary panels 382, 384, and 410 may be secured to the center support 364 by fasteners 428 and 430 as shown in FIGS. 31 and 36. The exemplary fasteners 428 and 430 may be suitable fasteners for securing the panels 382, 384, or 410 to the center support 364. For example, fasteners 428 and 430 may include screws or bolts. However, in other exemplary arrangements, fasteners such as adhesives, clips, brackets, notches, interlocking edges, or other suitable fasteners may be used. Further, resilient washers similar to exemplary resilient washers 352 may be used in conjunction with fasteners 428 and 430. The exemplary fasteners 428 and 430 may extend through fastener openings of the center support member 364 and panels 382, 384, and 410 from the outer surface 368 of the center support 364, through the center support and the respective panel 382, 384, or 410, and to the inner face 366 of the center support 364. In other exemplary arrangements, the panels 382 and 384 may be integrally formed with the center support 364 and other respective connected supporting structures, or the panel 410 may be integrally formed with its respective center support and other respective connected supporting structures.

Still further, resilient pads may extend intermediate of the panels 382, 384, and 410 of the exemplary transparent sidewall panel 362 and the respective notch walls of the various supporting structures, or the channel walls of the center support member. The exemplary resilient pads may be comprised of similar material as that of the resilient washers 352. The exemplary resilient pads may further line the continuous rectangular slots and channels of the center support members of the various embodiments to avoid breaking or cracking of the clear plastic sidewall panels. It should be understood that these arrangements of fasteners and resilient materials are exemplary, and in other arrangements, other approaches may be used.

It should be understood that in alternative exemplary arrangements, the support members 234 and 236 may not be included, and the vertical supports immediately adjacent the internal opening in the crib wall may include the slots in which the respective corresponding perimeter edges of the panels 382, 384, and 410 extend.

In alternative exemplary arrangements, the exemplary panels 382, 384, and 410 of the exemplary transparent sidewall panel 362 may be integrally formed with the support members or vertical members, or center support members, or may be directly operatively connected to surfaces thereof through the exemplary fasteners, adhesives, clips, brackets, interlocking edges, plurality of notches and projections, or other suitable connecting methods.

In alternative exemplary arrangements, as can be appreciated, the exemplary end walls 18 and 20 may include similar center support members in operative connection with the associated supporting structures thereof. As also can be appreciated, the exemplary end wall panels 178 may include alternative arrangements such as the single panel or double panel arrangements, similar to the transparent sidewall panel 362. It should be understood that these alternative exemplary arrangements of the end wall panels 178 may have perimeter edges that extend in the slots of the various supporting structures and channels of the exemplary center support members, or are otherwise operatively connected to surfaces thereof, through suitable fastening means or methods like those described herein, including for example, the exemplary resilient washers and pads.

In addition, in other exemplary arrangements, the exemplary side panels 272 and end panels 274 may be operatively connected to surfaces or faces of the exemplary center support members of the sidewalls and end walls, through any of the fastening arrangements described herein including without limitation, the exemplary resilient washers and pads.

In further alternative exemplary arrangements, additional support members may be included in the panels described herein. For example, horizontal support members, diagonal support members, or support members adjacent the perimeter edges or flanges of the respective panel or wall guard may be included in the exemplary arrangements.

FIGS. 37-43 show a further alternative baby crib arrangement generally indicated 432. The exemplary crib arrangement 432 is similar to the crib arrangements previously described. It includes a pair of parallel crib sidewalls 434, 436. A pair of parallel crib end walls 438, 440 extend perpendicular to the crib sidewalls. The crib arrangement further includes a bottom panel 442 that extends horizontally in intermediate relation of each of the crib sidewalls and crib end walls. As in the previously described arrangements, the bottom panel includes a top surface. The top surface is configured for supporting a mattress 444 or similar item. The crib sidewalls and end walls along with the bottom panel top surface, bound a crib space 446.

The exemplary crib arrangement 432 includes a transparent non-air permeable side panel 448. The exemplary side panel 448 may be similar to side panel 272 except as otherwise expressly described. The exemplary side panel 448 may include a lower side panel end surface 450 which extends in releasable engagement in a horizontally extending slot like the slots previously described. Similar to the previously described arrangement the lower side panel end surface may extend in the slot below the bottom panel top surface. Further the exemplary side panel 448 includes a generally planar central portion 452. The central portion 452 in the operative condition of the crib arrangement extends vertically within the crib space. Further the side panel 448 extends above the immediately adjacent crib sidewall 434.

Unlike the side panel 272 previously described, the exemplary side panel 448 does not include turned portions at the disposed horizontal sides of the panel. However in some alternative arrangements, such turned portions may be utilized. Rather the exemplary side panel 448 includes horizontally extending projections 454, 456. In the exemplary arrangement the projections 454 and 456 are hook projections that enable releasable engagement with a slot of an adjacent end panel in a manner like that later discussed. Of course it should be appreciated that the projections shown are exemplary and in other arrangements other interengaging projection and recess arrangements may be used.

The exemplary crib arrangement 432 further includes a pair of transparent, non-air permeable end panels 458, 460. The exemplary end panel 458 is in immediately adjacent relation with crib end wall 440. End panel 460 is in immediately adjacent relation with crib end wall 438. End panel 458 has an end panel bottom 462 and end panel top 464. End panel apertures 466 and 468 extend through the end panel 458. In the exemplary arrangement end panel apertures 466 and 468 are configured as notches that extend inward from the end panel bottom 462. However it should be understood that this approach is exemplary and in other arrangements other aperture types and configurations may be utilized. Further the exemplary end panel 458 includes an engagement recess 470. The engagement recess is configured for releasably engaging projection 456 therein.

The exemplary end panel 460 has a configuration that is similar to end panel 458. End panel 460 has an end panel bottom 472 and end panel top 474. Apertures 476 and 478 extend through end panel 460. End panel 460 further includes a recess 480 therein. Recess 480 is configured for releasably engaging projection 454.

In the exemplary arrangement each of the end panels 458 and 460 are transparent panels comprised of a similar material to side panel 448. In the operative condition the side panels 458 and 460 extend vertically at least as high as the side panel 448. Further it should be understood however that while in the exemplary arrangement the side panel 448 includes projections that are releasably engaged in respective recesses of the end panels, in other arrangements other types of interengaging projections and recesses may be utilized. This may include projections or similar structures that are in fixed operative connection with the end panels, and recesses or similar structures that are in fixed operative connection with the side panel.

In the exemplary crib arrangement the crib sidewall 434 includes a top rail 482 and crib sidewall 436 includes a top rail 484, each of which may be similar to the top rails previously discussed. Top rail 482 is in operatively attached connection with a vertical member 486 of crib end wall 438 and a vertical member 488 of crib end wall 440. The top rail 482 includes a fastener 490 which is engaged therewith and which is for purposes hereof is a portion of the top rail 482 that extends into attached engagement with the vertical member 486. Likewise the top rail 482 includes a further fastener 492 that is a portion of the top rail that extends into engagement with the vertical member 488.

In the exemplary arrangement the top rail 484 is in operative engagement with a fastener 494 that for purposes hereof is considered a portion of the top rail, that is in operative attached engagement with a vertical member 496 of crib end wall 438. Top rail 484 is also in operative connection with a vertical member 498 of crib end wall 440 via a fastener 500 which for purposes hereof is considered to be a portion of the top rail 484.

In the operative condition of the exemplary crib arrangement, the fasteners 494 and 490 respectively extend through apertures 476 and 478 of end panel 460. As a result the end panel 460 is held in sandwiched relation between the immediately adjacent ends of the top rails 482 and 484 and the inner faces of vertical members 496 and 486. Thus the end panel 460 is held in supported connection with the vertical members and the top cross member 502 of the end panel. Likewise the fasteners 492 and 500 extend respectively in apertures 468 and 466 of end panel 458. As a result the end panel 458 extends in sandwiched relation between the immediately adjacent ends of the top rails 482 and 486 and the inward faces of the vertical members 488 and 498. In addition the cross member 504 of crib end wall 440 extends in immediately adjacent relation to the end panel 458.

Additionally in this exemplary arrangement the interengaging relationship of the projections 454 and 456 in the respective recesses 480 and 470 provide additional support and rigidity to the side panel and end panels above the crib side rails by holding the panels in engagement. The hooked projections used in the exemplary arrangement further help to assure that the side panel and end panels are engaged in a manner that maintains the surfaces of the panels in the appropriate position so as to provide abutting support which resists deformation of each of the side panel and end panels. Of course it should be understood that this configuration is exemplary and in other arrangements other approaches may be used.

Further it should be pointed out that in this exemplary arrangement the end panels 458 and 460 have respective end panel bottoms 462 and 472 that are positioned generally at the vertical level of the top rails 482, 484. While in the exemplary arrangement shown in FIGS. 37 through 43, the crib end walls 438 and 440 are comprised of non-air permeable panels, in other arrangements the crib end walls may utilize slats or other air permeable structures. In such arrangements the end panels enable the flow of air through the crib end walls intermediate of the top surface of the bottom panel and the end panel bottoms. This may be desirable in such arrangements to facilitate airflow to and from the crib area.

Of course it should be understood that this arrangement is exemplary and in other arrangements other approaches, including the features and relationships of the previously described crib arrangements, may be utilized to produce further useful crib arrangements.

As can be appreciated, any of the exemplary features and relationships of the various exemplary crib arrangements described herein may be included in any of the other of the exemplary arrangements described herein, such that other crib arrangements may be produced that include combination of such features and relationships.

Thus, the exemplary arrangements described herein achieve improved operation, eliminate difficulties encountered in the use of prior devices and systems, and attain the useful results as described herein.

In the foregoing description, certain terms have been used for brevity, clarity and understanding. However, no unnecessary limitations are to be implied therefrom because such terms are used for descriptive purposes only and are intended to be broadly construed. Moreover, the descriptions and illustrations herein are by way of examples only, and the new and useful arrangements are not limited to the exact features shown and described.

It should be understood that features and/or relationships that are shown in one arrangement can be combined with features and/or relationships of another arrangement. That is, various features and/or relationships from various arrangements can be combined in further arrangements. The new and useful scope of the disclosure is not limited to only the exact arrangements shown or described herein.

Having described the features, discoveries, and principles of the exemplary arrangements, the manner in which they are constructed and operated and the advantages and useful results attained, the new and useful structures, devices, elements, arrangements, parts, combinations, systems, equipment, operations, methods, processes, and relationships are set forth in the appended claims.

We claim:

1. Apparatus comprising:

a child crib arrangement including a pair of crib sidewalls, wherein in an operative condition of the crib arrangement, the crib sidewalls extend parallel to one another, wherein one of the crib sidewalls includes a top rail, wherein the top rail vertically bounds an upper side of the respective crib sidewall, a pair of crib end walls, wherein in the operative condition each of the crib end walls extends perpendicular to the crib sidewalls, a bottom panel, wherein in the operative condition the bottom panel extends horizontally and in intermediate relation of each of the crib sidewalls and the crib end walls, wherein the bottom panel includes a bottom panel top surface, wherein the crib sidewalls, the crib end walls and the bottom panel top surface bound a crib space, a transparent, non-air permeable side panel, wherein in the operative condition the side panel includes a generally planar portion, wherein the generally planar portion extends vertically, parallel to and immediately adjacent the one crib sidewall and extends vertically above the top rail, a transparent non-air permeable end panel, wherein in the operative condition the end panel extends vertically and parallel to an immediately adjacent crib end wall, and vertically above the immediately adjacent crib end wall, wherein at least one of the side panel and the end panel include an aperture, wherein a portion of the top rail extends through the aperture.

2. The apparatus according to claim 1 wherein the one crib sidewall includes a bottom rail, wherein the bottom rail extends parallel to the top rail and vertically bounds a bottom side of the one crib sidewall, an elongated slot, wherein in the operative condition the elongated slot extends horizontally, parallel to and in immediately adjacent relation to the bottom rail of the one crib sidewall, wherein the side panel in the operative condition, is bounded at a lower end by a lower side panel end surface, wherein the lower side panel end surface extends in releasable engagement within the slot and extends below the bottom panel top surface.

3. The apparatus according to claim 2 wherein the side panel includes a turned portion, wherein the turned portion extends perpendicular to the generally planar portion and parallel to an immediately adjacent crib end wall, wherein the turned portion includes the aperture through which the portion of the top rail extends.

4. The apparatus according to claim 2 wherein the side panel includes a turned portion, wherein the turned portion extends perpendicular to the generally planar portion and parallel to an immediately adjacent crib end wall, wherein the turned portion includes the aperture through which the portion of the top rail extends, wherein the end panel includes an end panel side flange, wherein the end panel side flange extends parallel to the generally planar portion of the side panel and in horizontally outwardly overlying relation of the turned portion.

5. Apparatus comprising:

a child crib arrangement including a pair of crib sidewalls, wherein in an operative condition of the crib arrangement the crib sidewalls extend parallel to one another, wherein at least one of the crib sidewalls includes a bottom rail, wherein the bottom rail vertically bounds a bottom side of the respective crib sidewall, a pair of crib end walls, wherein in the operative condition each of the crib end walls extends perpendicular to the crib sidewalls, wherein the crib sidewalls and the crib end walls bound a crib space, a bottom panel, wherein in the operative condition the bottom panel extends horizontally and in intermediate relation of each of the crib sidewalls and the crib end walls, and wherein the bottom panel includes a bottom panel top surface that bounds a lower side of the crib space, an elongated slot, wherein in the operative condition the elongated slot extends horizontally, parallel to and in immediately adjacent relation to the bottom rail of one crib sidewall, wherein in the operative condition, the one crib sidewall includes a horizontally extending top rail, wherein the top rail extends parallel to and vertically above the bottom rail, a transparent, non-air permeable side panel, wherein in the operative condition the side panel includes a generally planar portion, wherein the generally planar portion extends vertically within the crib space parallel to the one crib sidewall and vertically above the one crib sidewall, is bounded at a lower end by a lower side panel end surface, wherein the lower side panel end surface extends in releasable engagement within the slot and extends below the bottom panel top surface, a turned portion, wherein the turned portion extends perpendicular to the generally planar portion and parallel to an immediately adjacent crib end wall, includes an aperture, wherein a portion of the top rail extends through the aperture.

6. The apparatus according to claim 5 wherein the side panel further includes a further turned portion, wherein the further turned portion is horizontally disposed from and extends parallel to the turned portion, wherein the further turned portion extends perpendicular to the generally planar portion, wherein the further turned portion extends parallel to an immediately adjacent further crib end wall, wherein the further crib end wall bounds the crib space on an opposed side from the crib end wall, includes a further aperture, wherein a further portion of the top rail extends through the further aperture.

7. The apparatus according to claim 5 wherein the side panel includes a further aperture, wherein in the operative condition the further aperture is disposed vertically below the aperture, a releasable fastener, wherein the releasable fastener is in operative engagement with the immediately adjacent crib end wall and extends in the further aperture.

8. The apparatus according to claim 5 wherein the side panel further includes a flange portion, wherein the flange portion extends perpendicular to each of the generally planar portion and the turned portion, wherein in the operative condition the flange portion extends in vertically overlying relation above the top rail.

9. The apparatus according to claim 5 and further including a transparent, non-air permeable end panel, wherein the end panel is in operatively attached connection with the immediately adjacent crib end wall, extends outside of the crib space and parallel to the immediately adjacent crib end wall, terminates upward at an end panel top, wherein the end panel top extends at least as high as the side panel.

10. The apparatus according to claim 5 wherein the side panel further includes a flange portion, wherein the flange portion extends perpendicular to each of the generally planar portion and the turned portion, wherein in the operative condition the flange portion extends in vertically overlying relation above the top rail, and further including a transparent, non-air permeable end panel, wherein the end panel is in releasably operatively attached connection with the immediately adjacent crib end wall, extends outside of the crib space and parallel to the immediately adjacent crib end wall, terminates upward at an end panel top, wherein the end panel top extends at least as high as the flange portion.

11. The apparatus according to claim 5 and further including a transparent, non-air permeable end panel, wherein the end panel is in releasably operatively attached connection with the immediately adjacent crib end wall, extends outside of the crib space and parallel to the immediately adjacent crib end wall, terminates upward at an end panel top, wherein the end panel top extends at least as high as the side panel, includes an end panel side flange, wherein the end panel side flange extends perpendicular to the immediately adjacent crib end wall, and extends in horizontally outward overlying relation of the turned portion of the side panel.

12. The apparatus according to claim 5 and further including a transparent, non-air permeable end panel, wherein the end panel is in releasably operatively attached connection with the immediately adjacent crib end wall, extends outside of the crib space and parallel to the immediately adjacent crib end wall, terminates upward at an end panel top, wherein the end panel top extends at least as high as the side panel, includes an end panel side flange, wherein the end panel side flange extends perpendicular to the immediately adjacent crib end wall, and extends in horizontally outward overlying relation of the turned portion of the side panel, includes a further end panel side flange, wherein the further end panel side flange extends perpendicular to the immediately adjacent crib end wall, is horizontally disposed from the end panel side flange, horizontally outwardly overlies the crib sidewall opposed of the one crib sidewall.

13. The apparatus according to claim 5
wherein the side panel further includes a further turned portion,
wherein the further turned portion is horizontally disposed from and extends parallel to the turned portion,
wherein the further turned portion extends perpendicular to the generally planar portion,
wherein the further turned portion
extends parallel to an immediately adjacent further crib end wall, wherein the further crib end wall bounds the crib space on an opposed side from the crib end wall,
includes a further aperture,
wherein a further portion of the top rail extends through the further aperture,
and further including
a transparent, non-air permeable end panel, wherein the end panel
is in releasably operatively attached connection with the immediately adjacent crib end wall,
extends outside of the crib space and parallel to the immediately adjacent crib end wall,
terminates upward at an end panel top, wherein the end panel top extends at least as high as the side panel,
includes an end panel side flange, wherein the end panel side flange
extends perpendicular to the immediately adjacent crib end wall, and
extends in horizontally outward overlying relation of the turned portion of the side panel,
includes a further end panel side flange, wherein the further end panel side flange
extends perpendicular to the immediately adjacent crib end wall,
is horizontally disposed from the end panel side flange,
horizontally outwardly overlies the crib sidewall opposed of the one crib sidewall.

14. The apparatus according to claim 5
and further including
a transparent, non-air permeable a end panel, wherein the end panel
is in releasably operatively attached connection with the immediately adjacent crib end wall,
extends outside of the crib space and parallel to the immediately adjacent crib end wall,
terminates upward at an end panel top, wherein the end panel top extends at least as high as the side panel,
terminates downward at an end panel bottom, wherein the end panel bottom is above the bottom panel top surface and wherein the immediately adjacent crib end wall is air permeable intermediate of the end panel bottom and the bottom panel top surface.

15. The apparatus according to claim 5
wherein the arrangement further includes
a transparent non-air permeable end panel,
wherein the end panel
is in operatively attached connection with a crib end wall,
terminates upward at an end panel top, wherein the end panel top extends at least as high as the side panel.

16. The apparatus according to claim 5
wherein the arrangement further includes
a transparent non-air permeable end panel,
wherein the end panel
is in operatively attached connection with a crib end wall,
terminates upward at an end panel top, wherein the end panel top extends at least as high as the side panel,
terminates downward at an end panel bottom, wherein the end panel bottom is above the bottom panel top surface and wherein the crib end wall is air permeable intermediate of the end panel bottom and the bottom panel top surface.

17. The apparatus according to claim 5
wherein the arrangement further includes
a transparent, non-air permeable end panel, wherein the end panel
is in releasably operatively attached connection with a crib end wall,
extends parallel to the crib end wall to which the end panel is attached,
terminates upward at an end panel top, wherein the end panel top extends at least as high as the side panel,
a transparent, non-air permeable further end panel, wherein the further end panel
is in releasably operatively attached connection with another crib end wall at an opposed side of the crib space from the crib end wall,
extends parallel to the another crib end wall to which the further end panel is attached,
terminates upward at a further end panel top, wherein the further end panel top extends at least as high as the side panel.

18. The apparatus according to claim 5
wherein the arrangement further includes
a transparent, non-air permeable end panel, wherein the end panel
is in releasably operatively attached connection with a crib end wall,
extends parallel to the crib end wall to which the end panel is attached,
terminates upward at an end panel top, wherein the end panel top extends at least as high as the side panel,
terminates downward at an end panel bottom, wherein the end panel bottom is vertically above the bottom panel top surface, and wherein the crib end wall to which the end panel is attached, is air permeable intermediate of the bottom panel top surface and the end panel bottom,
a transparent, non-air permeable further end panel, wherein the further end panel
is in releasably operatively attached connection with another crib end wall at an opposed side of the crib space from the crib end wall,
extends parallel to the another crib end wall to which the further end panel is attached,
terminates upward at a further end panel top, wherein the further end panel top extends at least as high as the side panel,
terminates downward at a further end panel bottom, wherein the further end panel bottom is vertically above the bottom panel top surface, and wherein the another crib end wall to which the further end panel is attached, is air permeable intermediate of the further end panel bottom and the bottom panel top surface.

19. The apparatus according to claim 5
wherein the arrangement in the operative condition further includes
a transparent, non-air permeable end panel, wherein the end panel
is in releasably operatively attached connection with a crib end wall,
extends parallel to the crib end wall to which the end panel is attached,
includes an end panel aperture, wherein a portion of the top rail extends through the end panel aperture.

20. Apparatus comprising:
a child crib arrangement including
a pair of crib sidewalls, wherein in an operative condition of the crib arrangement the crib sidewalls extend parallel to one another,
wherein at least one of the crib sidewalls includes a bottom rail, wherein the bottom rail vertically bounds a bottom side of the respective crib sidewall,
a pair of crib end walls, wherein in the operative condition each of the crib end walls extends perpendicular to the crib sidewalls,
wherein the crib sidewalls and the crib end walls bound a crib space,
a bottom panel, wherein in the operative condition the bottom panel extends horizontally and in intermediate relation of each of the crib sidewalls and the crib end walls, and wherein the bottom panel includes a bottom panel top surface that bounds a lower side of the crib space,
an elongated slot, wherein in the operative condition the elongated slot
extends horizontally, parallel to and in immediately adjacent relation to the bottom rail of one crib sidewall,
wherein in an operative condition, the one crib sidewall includes a horizontally extending top rail,
wherein the top rail extends parallel to and vertically above the bottom rail,
a transparent, non-air permeable side panel, wherein in the operative condition the side panel includes
a generally planar portion, wherein the generally planar portion
extends vertically within the crib space parallel to the one crib sidewall and vertically above the one crib sidewall,
is bounded at a lower end by a lower side panel end surface,
wherein the lower side panel end surface extends in releasable engagement within the slot and extends below the bottom panel top surface,
a transparent non-air permeable end panel,
wherein the end panel
is in operatively attached connection with a crib end wall,
terminates upward at an end panel top, wherein the end panel top extends at least as high as the side panel,
includes an end panel aperture, wherein a portion of the top rail extends through the end panel aperture.

21. The apparatus according to claim 20 wherein the crib sidewall that is opposed of the one crib sidewall includes a further horizontally extending top rail, wherein the end panel includes a further end panel aperture, wherein a further portion of the further top rail extends through the further end panel aperture.

22. Apparatus comprising:
a child crib arrangement including
a pair of crib sidewalls, wherein in an operative condition of the crib arrangement the crib sidewalls extend parallel to one another,
wherein at least one of the crib sidewalls includes a bottom rail, wherein the bottom rail vertically bounds a bottom side of the respective crib sidewall,
a pair of crib end walls, wherein in the operative condition each of the crib end walls extends perpendicular to the crib sidewalls,
wherein the crib sidewalls and the crib end walls bound a crib space,
a bottom panel, wherein in the operative condition the bottom panel extends horizontally and in intermediate relation of each of the crib sidewalls and the crib end walls, and wherein the bottom panel includes a bottom panel top surface that bounds a lower side of the crib space,
an elongated slot, wherein in the operative condition the elongated slot
extends horizontally, parallel to and in immediately adjacent relation to the bottom rail of one crib sidewall,
wherein in the operative condition, the one crib sidewall includes a horizontally extending top rail,
wherein the top rail extends parallel to and vertically above the bottom rail,
a transparent, non-air permeable side panel, wherein in the operative condition the side panel includes
a generally planar portion, wherein the generally planar portion
extends vertically within the crib space parallel to the one crib sidewall and vertically above the one crib sidewall,
is bounded at a lower end by a lower side panel end surface,
wherein the lower side panel end surface extends in releasable engagement within the slot and extends below the bottom panel top surface,
a projection or recess, wherein the projection or recess is vertically above the top rail,
a transparent non-air permeable end panel,
wherein the end panel
is in operatively attached connection with a crib end wall,
terminates upward at an end panel top, wherein the end panel top extends at least as high as the side panel,
includes the other of the projection or recess, wherein the projection and recess are in engaging relation.

23. Apparatus comprising:
a child crib arrangement including
a pair of crib sidewalls, wherein in an operative condition of the crib arrangement the crib sidewalls extend parallel to one another,
wherein at least one of the crib sidewalls includes a bottom rail, wherein the bottom rail vertically bounds a bottom side of the respective crib sidewall,
a pair of crib end walls, wherein in the operative condition each of the crib end walls extends perpendicular to the crib sidewalls,
wherein the crib sidewalls and the crib end walls bound a crib space, a bottom panel, wherein in the operative condition the bottom panel extends horizontally and in intermediate relation of each of the crib sidewalls and the crib end walls, and wherein the bottom panel includes a bottom panel top surface that bounds a lower side of the crib space, an elongated slot, wherein in the operative condition the elongated slot extends horizontally, parallel to and in immediately adjacent relation to the bottom rail of one crib sidewall, wherein in the operative condition, the one crib sidewall includes a horizontally extending top rail, wherein the top rail extends parallel to and vertically above the bottom rail, a transparent, non-air permeable side panel, wherein in the operative condition the side panel includes a generally planar portion, wherein the generally planar portion extends vertically within the crib space parallel to the one crib sidewall and vertically above the one crib sidewall, is bounded at a lower end by a lower side panel end surface, wherein the lower side panel end surface extends in releasable engagement within the slot and extends below the bottom panel top surface, a transparent, non-air permeable end panel, wherein the end panel is in releasably operatively attached connection with a crib end wall, extends parallel to the crib end wall to which the end panel is attached, includes an end panel aperture, wherein a portion of the top rail extends through the end panel aperture.

24. The apparatus according to claim 23 wherein the side panel includes one of a projection or recess, wherein the projection or recess is vertically above the top rail, wherein the end panel terminates upward at an end panel top, wherein the end panel top extends at least as high as the side panel, includes the other of the projection or recess, wherein the projection and recess are in engaging relation.

25. The apparatus according to claim 23 wherein the lower side panel end surface extends continuously in engagement within the slot across substantially an entire horizontal width of the side panel.

* * * * *